US005841452A

United States Patent [19]

Silverbrook

[11] Patent Number: 5,841,452

[45] Date of Patent: Nov. 24, 1998

[54] METHOD OF FABRICATING BUBBLEJET PRINT DEVICES USING SEMICONDUCTOR FABRICATION TECHNIQUES

[75] Inventor: Kia Silverbrook, Wollahra, Australia

[73] Assignees: Canon Information Systems Research Australia Pty Ltd; Canon Kabushiki Kaisha, both of Tokyo, Japan

[21] Appl. No.: 306,537

[22] Filed: Sep. 15, 1994

Related U.S. Application Data

[63] Continuation of Ser. No. 827,986, Jan. 29, 1992, abandoned.

[30] Foreign Application Priority Data

| | | | |
|---|---|---|---|
| Jan. 30, 1991 | [AU] | Australia | PK4374 |
| Feb. 22, 1991 | [AU] | Australia | PK4731 |
| Feb. 22, 1991 | [AU] | Australia | PK4732 |
| Feb. 22, 1991 | [AU] | Australia | PK4733 |
| Feb. 22, 1991 | [AU] | Australia | PK4734 |
| Feb. 22, 1991 | [AU] | Australia | PK4735 |
| Feb. 22, 1991 | [AU] | Australia | PK4736 |
| Feb. 22, 1991 | [AU] | Australia | PK4737 |
| Feb. 22, 1991 | [AU] | Australia | PK4738 |
| Feb. 22, 1991 | [AU] | Australia | PK4739 |
| Feb. 22, 1991 | [AU] | Australia | PK4740 |
| Feb. 22, 1991 | [AU] | Australia | PK4741 |
| Feb. 22, 1991 | [AU] | Australia | PK4742 |
| Feb. 22, 1991 | [AU] | Australia | PK4743 |
| Feb. 22, 1991 | [AU] | Australia | PK4744 |
| Feb. 22, 1991 | [AU] | Australia | PK4745 |
| Feb. 22, 1991 | [AU] | Australia | PK4746 |

[51] Int. Cl.[6] ..... B41J 2/14

[52] U.S. Cl. ..... 347/47; 347/56; 347/57; 347/58; 347/59; 347/63; 347/65; 29/890.1; 216/27

[58] Field of Search ..... 347/59, 58, 57, 347/56, 63, 65, 47; 29/890.1; 216/27

[56] References Cited

U.S. PATENT DOCUMENTS

| | | | |
|---|---|---|---|
| 3,650,019 | 3/1972 | Robinson . | |
| 4,275,290 | 6/1981 | Cielo et al. | 347/56 |
| 4,296,421 | 10/1981 | Hara | 347/56 |
| 4,429,321 | 1/1984 | Matsumoto | 347/59 |
| 4,450,455 | 5/1984 | Sugitani . | |
| 4,490,728 | 12/1984 | Vaught et al. | 347/56 |
| 4,520,373 | 5/1985 | Ayata | 347/56 |
| 4,580,149 | 4/1986 | Domoto | 347/61 |
| 4,611,219 | 9/1986 | Sugitani | 347/56 |
| 4,723,129 | 2/1988 | Endo | 347/56 |
| 4,769,654 | 9/1988 | Tanaka et al. | 347/40 |
| 4,847,630 | 7/1989 | Bhaskar | 347/63 |
| 4,889,587 | 12/1989 | Komuro | 347/62 X |
| 4,961,821 | 10/1990 | Drake | 347/42 X |
| 5,016,024 | 5/1991 | Lam | 347/63 |

FOREIGN PATENT DOCUMENTS

| | | | |
|---|---|---|---|
| 0244214 | 11/1987 | European Pat. Off. | B41J 3/04 |
| 0321075 | 6/1989 | European Pat. Off. | B41J 3/04 |
| 0339926 | 11/1989 | European Pat. Off. | B41J 3/04 |
| 0352726 | 1/1990 | European Pat. Off. | B44J 29/377 |
| 0382423 | 8/1990 | European Pat. Off. | B41J 2/175 |
| 3331488 | 3/1984 | Germany | B41J 3/04 |
| 60-008076 | 1/1985 | Japan | B41J 3/04 |
| 60-018359 | 1/1985 | Japan | B41J 3/20 |
| 61-106270 | 5/1986 | Japan | B44J 29/372 |
| 1186700 | 7/1989 | Japan | H05K 7/20 |
| 1259957 | 10/1989 | Japan | B44J 3/04 |
| 40297448 | 12/1990 | Japan | B41J 2/16 |

*Primary Examiner*—Joseph W. Hartary
*Attorney, Agent, or Firm*—Fitzpatrick, Cella, Harper & Scinto

[57] ABSTRACT

A method of fabricating bubblejet print devices uses semiconductor fabrication techniques, and this method involves forming a heater means and an electrical connection to the heater means on a substrate, and forming a passageway through the substrate. A given end of the passageway is disposed adjacent to the heater means, and this given end is formed as an outlet for ejecting ink.

10 Claims, 54 Drawing Sheets

METHOD OF FABRICATING BUBBLEJET PRINT DEVICES USING SEMICONDUCTOR FABRICATION TECHNIQUES

This application is a continuation of application Ser. No. 07/827,986 filed Jan. 29, 1992, now abandoned.

FIELD OF THE INVENTION

The present invention relates to ink jet printing and in particular, discloses a semiconductor bubblejet print head.

DESCRIPTION OF THE PRIOR ART

Bubblejet print heads are known in the art and have recently become available commercially as portable, relatively low-cost printers generally used with personal computers. Examples of such devices are those made by HEWLETT-PACKARD as well as the CANON BJ10 printer.

FIGS. 1 and 2 show schematic perspective views of prior art bubblejet print heads representative of those used by CANON and HEWLETT-PACKARD, respectively.

As seen in FIG. 1, the prior art bubblejet head 1 is formed by a bubblejet semiconductor chip device 2 abutting a laser etched cap 3. In this configuration, the cap 3 acts as a guide for the inward flow of ink (indicated in the drawing by arrows), into the head 1 via an inlet 4, and the outward ejection of the ink from the head 1 via a plurality of nozzles 5. The nozzles 5 are formed as the open ends of channels in the cap 3. Upon the bubblejet chip 2 are arranged one or more (generally 64) heater elements (not shown) which are energised so as to cause ink to be ejected from each of the nozzles 5 by a bubble of vapourised ink formed within the corresponding channel. The bubblejet chip 2 also includes a semiconductor diode matrix (not illustrated) which acts to supply energy to the heater elements arranged adjacent the channels.

In the prior art HEWLETT-PACKARD thermal ink jet head 10 as seen in FIG. 2, a two part configuration is also used, however ink enters the cap 12 through an inlet 13 arranged in the side of the cap 12 which supplies an array of nozzles 14 arranged perpendicular to the inlet 13. Ink exits through the face of the cap 12. A flat heater 15 is arranged immediately beneath each nozzle 14 so as to cause ejection of ink from the inlet channel 13 into the nozzles.

However, problems exist with these prior art devices due to their two-part construction in creating accurate registration between the two parts. Even if accurate registration were initially achieved, differing rates of thermal expansion or contraction would prevent this accuracy being maintained over appreciable dimensions. Such registration problems limit performance of the prior art devices to image densities generally lower than 400 dots per inch (dpi), and scanning or moving print heads rather than fixed print heads.

It is an object of the present invention to substantially overcome, or ameliorate, the above mentioned problems through provision of an alternative bubblejet print head configuration.

SUMMARY OF THE INVENTION

One embodiment of the present invention relates to a method of fabricating a bubblejet print device using semiconductor fabrication techniques. This method involves the steps of forming a heater means and an electrical connection to the heater means on a substrate, and forming a passageway through the substrate, a given end of the passageway being disposed adjacent to the heater means, the given end being formed as an outlet for ejecting ink.

The present invention relates to bubblejet print technology and deals with one or more of the following aspects:

- a bubblejet print device that is integrally formed; that is, a bubblejet print device comprising a plurality of nozzles each communicating with a corresponding passageway for the supply of ink to the nozzle, and heater means associated with each the passageway or nozzle, characterized in that the nozzles, passageways and heater means are integrally formed.
- an assembly of such bubblejet print devices;
- an image reproducing apparatus using such a bubblejet print device;
- a bubblejet print head including such a bubblejet print device;
- a bubblejet print device having nozzles supplied with ink of different colours;
- a data phaser for the bubblejet print device;
- a bubblejet print device in which the heater arrangement for each nozzle or passageway surrounds the nozzle or passageway;
- a bubblejet print device in which each nozzle and passageway extends between a pair of opposite faces of the device;
- a bubblejet print head including a bubblejet print device of length substantially equal to the width of the paper (i.e. dimension of the paper to be printed transverse the direction of relative motion past the device);
- such a bubblejet print head in which electrical power connections to the device are made substantially along the entire length of the device;
- a bubblejet print device having nozzles arranged in rows, the nozzles of each row being offset in the row direction relative to the nozzles of the adjacent row or rows;
- a method of fabricating the bubblejet print device;
- an integrated electronic structure having an integrated thermal conductor to transport heat from one part of the structure to another part of the structure;
- a bubblejet print device in which each heater arrangement for each nozzle has a plurality of heaters each having a corresponding electronic drive circuit;
- a bubblejet print device in which each heater arrangement has a plurality of electronic drive circuits in which the heaters and the corresponding electronic drive circuits are spaced apart in relation to each other;
- a bubblejet print device having at least one set of redundant nozzles and a main set of nozzles with the heaters of the corresponding redundant nozzles being operable on detection of a failure of the heaters of the corresponding main nozzle; and
- a bubblejet printing assembly having a plurality of bubblejet printing devices in which for each intended print location a sensing circuit is provided to interconnect corresponding heaters of the devices to sense the failure of one of the corresponding nozzle heaters and subsequently operate one other of the corresponding nozzles.

As used herein, the term "a Z-Axis bubblejet chip (ZBJ chip)" is used to describe a chip lying in the x y plane in which ink flows both into and out of the chip in the z direction.

The above and other objects, effects, features and advantages of the present invention will become more apparent from the following description of embodiments thereof taken in conjunction with the accompanying drawings.

BRIEF DESCRIPTION OF THE DRAWINGS

A number of preferred embodiments of the present invention will now be described with reference to the drawings in which.

Table 1 lists details of ZBJ chips for various applications; and

Table 2 lists various fault conditions and their consequence.

DETAILED DESCRIPTION OF THE PREFERRED EMBODIMENT

Figure 1:
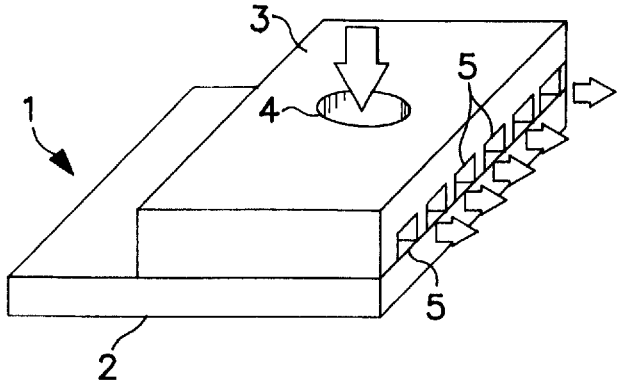
FIG. 1 PRIOR ART
FIGS. 1 and 2 are representations of prior art BJ print heads.
Figure 2:
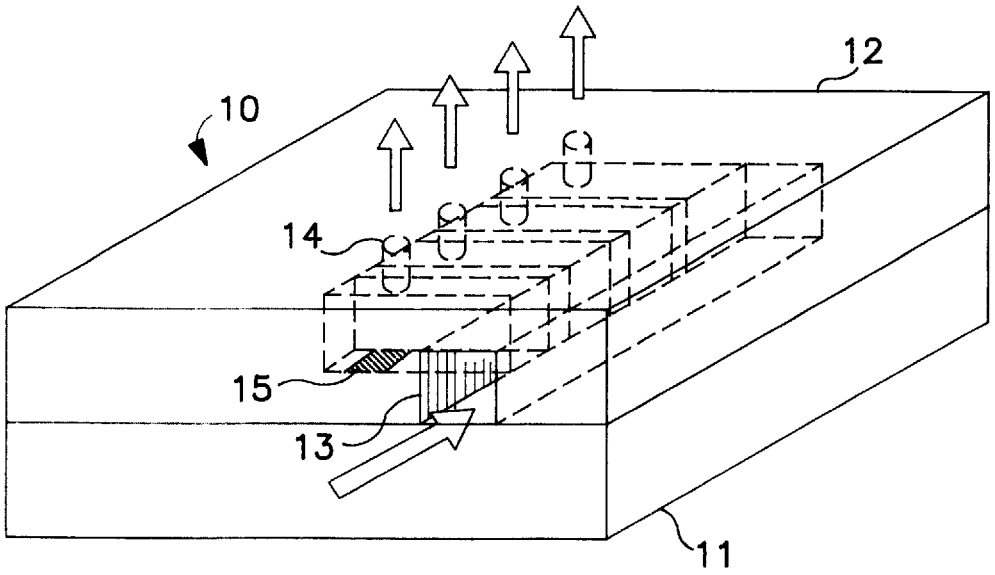
FIG. 2 PRIOR ART
Figure 3:
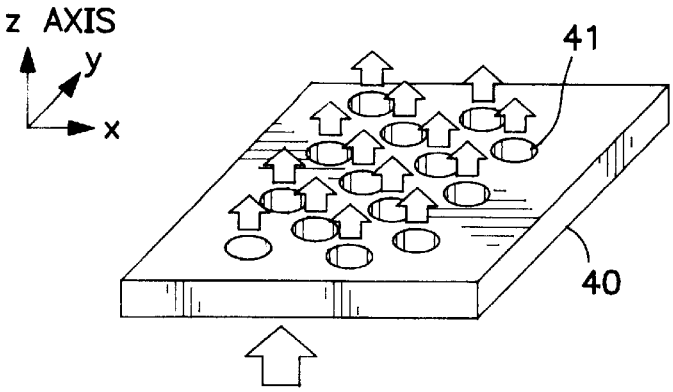
FIG. 3 is a representation of a ZBJ chip of the present invention.

Referring firstly to FIG. 3, the general configuration of Z-axis bubblejet (ZBJ) chip 40 is shown which includes an ink inlet arranged on one (underside as illustrated) plane surface of the chip 40 and a plurality of nozzles 11 which provide for outlets of ink on the opposite side. It is readily apparent from a direct comparison of FIGS. 1 and 2 with FIG. 3 that in the ZBJ chip 40, is provided as a single, monolithic, integrally formed structure as opposed to the two part structure of the prior art. The chip 40 is formed using semiconductor fabrication techniques. Furthermore, ink is ejected from the nozzles 41 in the same direction that ink is supplied to the chip 40.

Figure 4A:
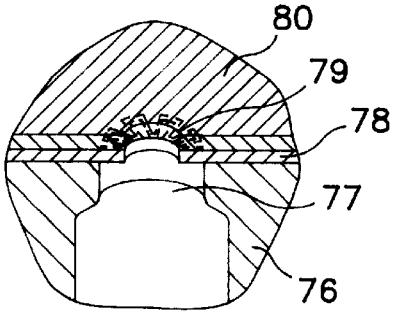
FIGS. 4A and 4B are a cut-away isometric view of a first embodiment of a ZBJ print head.
Figure 4B:
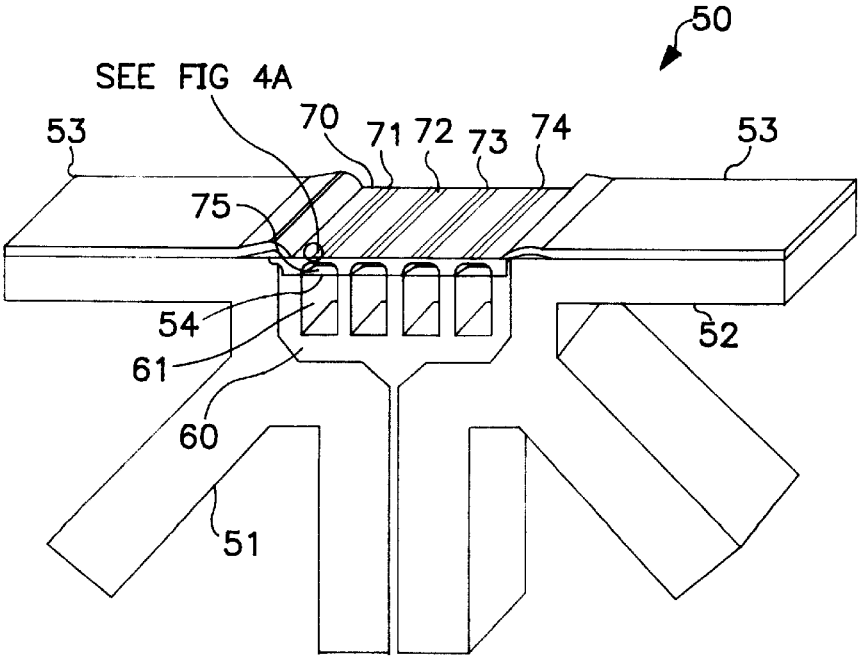

Referring now to FIG. 4, a cross-section of a first embodiment of a stationary (i.e. non-moving) ZBJ printhead 50 is shown which is configured for the production of full length A4 continuous tone colour images at an image density of 1600 dpi or 400 pixels per inch. The head 50 is provided with a ZBJ chip 70 having four nozzle arrays, one for each of cyan 71, magenta 72, yellow 73 and black 74. The nozzle arrays 71–74 are formed from nozzle vias 77 with four nozzles per pixel giving a total of 51,200 nozzles per chip 70. The magnified portion of FIG. 4 shows the basic nozzle cross-section which is formed in a silicon substrate 76 over which a layer 78 of thermal $SiO_2$ is formed. A heater element 79 is provided about the nozzle 77 which is capped by an overcoat layer 80 of chemical vapour deposited (CVD) glass. Each of the nozzles 77 communicates to a common ink supply channel 75 for that particular colour of ink. The ZBJ chip 70 is positionable upon a channel extrusion 60 which has ink channels 61 communicating with the channels 75 so as to provide for a continuous flow of ink to the chip 70. A membrane filter 54 is provided between the extrusion 60 and the chip 70.

Two power bus bars 51 and 52 are provided which electrically connect to the chip 70. The bus bars 51 and 52 also act as heat sinks for the dissipation of heat from the chip 70.

Figure 5A:
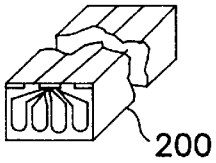
FIGS. 5A and 5B are views similar to FIGS. 4A and 4B but of a second embodiment.
Figure 5B:
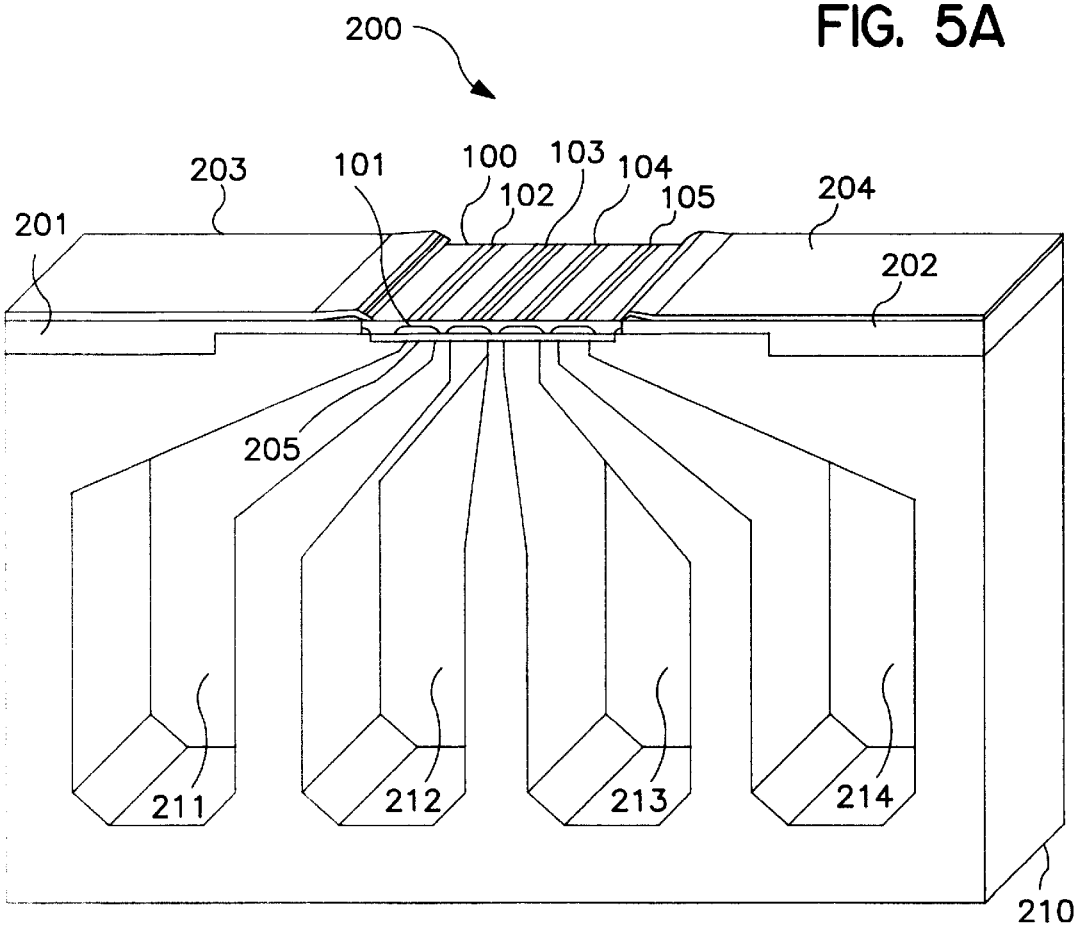

FIG. 5 shows a second embodiment of a ZBJ head 200 similar in configuration to that shown in FIG. 4.

The head 200 has a ZBJ chip 100 including nozzle arrays 102, 103, 104 and 105 for each of cyan, magenta, yellow and black respectively. The chip 100 has ink channels 101 which communicate with ink reservoirs 211, 212, 213 and 214, respectively for the above colours, in a channel extrusion 210.

The channel extrusion 210 has an alternate geometry of higher volumetric capacity than that shown in FIG. 4 for the same size of the chip 100. Also illustrated are tab connections 203 and 204 which connect the power bus bars 201 and 202 to the chip 100. A membrane filter 205 is also provided as before.

So as to be able to print an A4 page, the head 200 is required to be about 220 m long, by 15 mm across, by 9 mm deep. Using the foregoing as a standard arrangement, many configurations of ZBJ heads are possible. The actual size and the number of nozzles per chip depends solely on the required performance of the printer application.

Table 1 lists seven applications of ZBJ printheads and the various requirements for each application considered necessary. Application one is considered suitable for low cost full colour printers, portable computers, low cost colour copiers and electronic still photography. Application two is considered suitable for personal printers, and personal computers, whilst application three is useful in electronic still photography, video printers and workstation printers. The fourth application finds use in colour copiers, full colour printers, colour desktop publishing and colour facsimile. The fifth application is for a monochrome device which sees application in digital black and white copiers, high resolution printers, portable computers, and plain paper facsimiles. Applications six and seven show respectively high speed and medium speed A3 continuous tone applications useful in colour copiers and colour desktop publishing. The high speed version of application six finds use in small run commercial printing and the medium speed version in colour facsimile.

It will be appreciated by those skilled in the art that the foregoing applications are configured for ZBJ heads with a drop size of 3 pl (pico-liters). Other configurations are possible and that higher operating speeds can be achieved at the expense of image quality, by using larger drop sizes.

Figure 6:
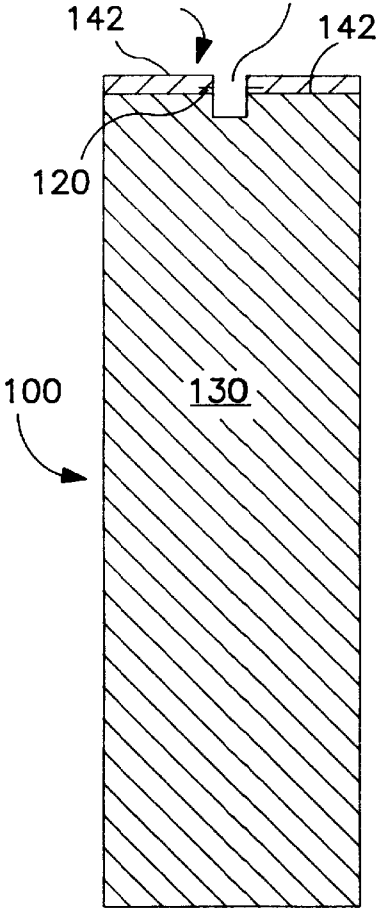

The physical structure of the ZBJ chip 100 will now be described in detail. The ZBJ chip 100, as illustrated in FIG. 5, for example, has four nozzle arrays 102–105, each comprising four rows of nozzle vias 110 (FIGS. 6–9). The nozzle vias 110 are formed by etching through a substrate 130 of the chip 100. The substrate 130 is generally about 500 microns deep and depending on the required application, can be 220 mm long by 4 mm wide. FIGS. 6 to 9 illustrate the etching of the nozzle vias 110 through the substrate 130. So that the ZBJ chip 100 can eject a drop of 3 pl, it is necessary for the diameter of each nozzle 110 to be approximately 20 microns. In one possible manufacturing method a four stage process is used commencing with a 500 micron deep substrate 300 having an overlying glass ($SiO_2$) layer 142 enclosing a heater 120 within as seen in FIG. 5. Firstly, the step as seen in FIG. 6 is a plasma etch of a 20 micron straight-walled round hole, through the glass overcoat 142 and at least 10 microns into the substrate 130. This forms the nozzle tip 111.

Figure 8:
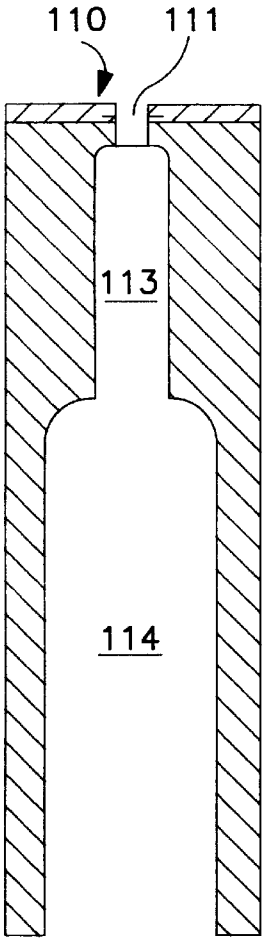
Figure 7:
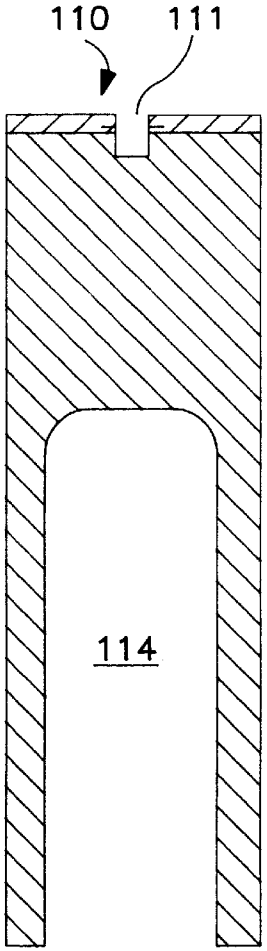

The next step as seen in FIG. 7 requires the etching of a large channel (approximately 100 microns wide by 300 microns deep) in the rear of the chip 100. This forms nozzle channels 114 that supply ink flow to the nozzles 110. The next step, as seen in FIG. 8, is to print nozzle barrel patterns at the bottom of the channels 114 formed in FIG. 7. The nozzle barrels 113 are approximately 40 microns in diameter and are plasma etched to within 10 microns of the front of the chip 100. As the an isotropic plasma etch is relatively non-selective, this method cannot be used to etch the entire cavity without also etching through, and destroying the heater 120.

Figure 9:
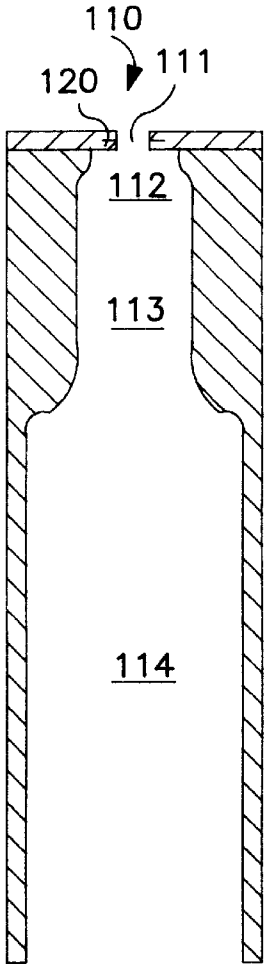
FIGS. 6 to 9 illustrate one etching process which can be used to create the ZBJ nozzles.

Accordingly, as seen in FIG. 9, an isotropic etch is used on all exposed silicon to a depth of 10 microns from the front of the chip 100. This step acts to widen the nozzles 110 and undercut the $SiO_2$ layer 142 containing the heater 120. This step forms the nozzle cavity 112. The step also ensures that the tip 111 joins the barrel 113 without risking plasma etched damage to the heater 120. It will be apparent to those skilled in the art that the above mentioned dimensions are only approximate and show a general concept only. However, the front to back surface etching should be aligned to better than 10 microns and the etch depth control should also be better than 10 microns. In this way, the complete nozzle via 110 is formed including its tip 111, cavity 112, barrel 113 and channel 114.

It will be apparent that, the formation of the nozzle tip 11, nozzle cavity 112 which acts as a thermal chamber, nozzle barrel 113 and nozzle channel 114 creates a passageway for the flow of ink through the substrate 100 for ejection.

Figure 10:
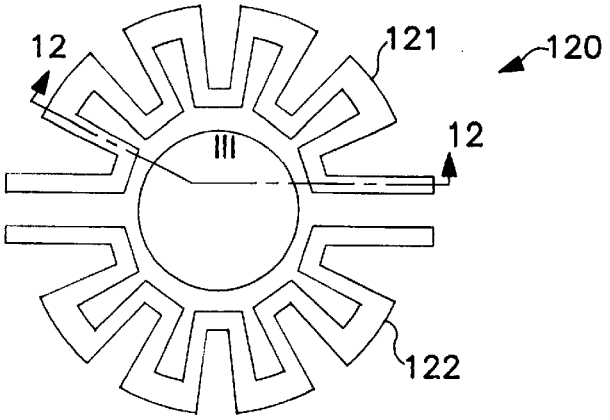
FIGS. 10, 11 and 12 illustrate one possible arrangement of the heater elements within the ZBJ substrate.

Prior art integrated bubblejet heads manufactured by Canon use hafnium boride ($HfB_2$) as the heater element 120. The present Canon BJ10 printer has heater parameters selected for a drop size of 65 pl. The drop size of 3 pl as used in the preferred embodiments of the present invention, being substantially smaller, requires re-dimensioning of the heater configuration. So as to ensure that high temperatures are reached, whilst maintaining heater resistance and minimising overall size, a serpentine design as seen in FIG. 10 can be used. Furthermore, as seen in FIG. 10, the heater 120 comprises two heating elements which take the form of a main heater 121 and a redundant heater 122 arranged about, and surrounding the nozzle tip 111. The redundant heater 122 is provided so as to increase the fault tolerance of the ZBJ chip 100 thereby increasing the yield of the manufacturing process. This configuration of the heaters 120 contrasts with the prior art where, because of the two part structure, the heaters reside on the BJ chip which forms only one of the channel walls.

Figure 11:
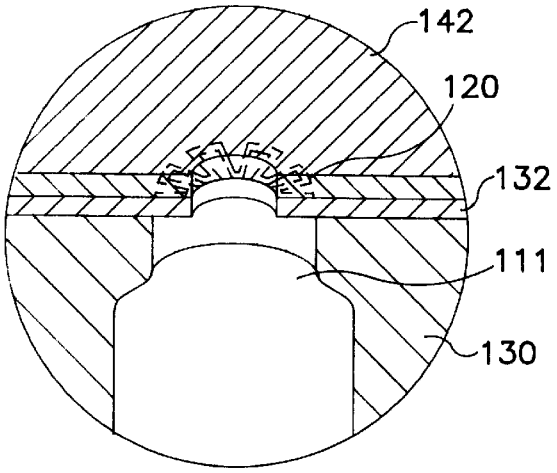

FIG. 11 shows a cut-away section of the nozzle via 110 of FIGS. 6 to 10. In particular, the relative dimensions of the heater 120 and nozzle tip 11 can be assessed.

Figure 12:
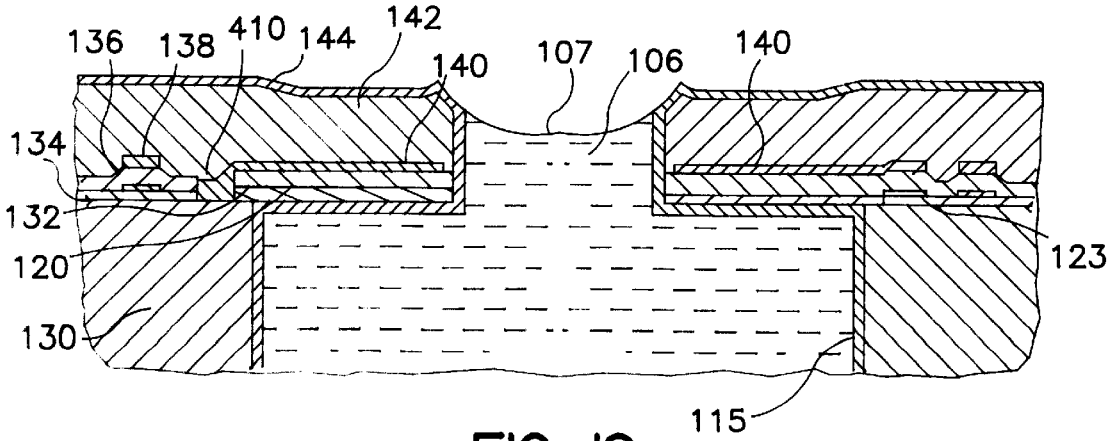

FIG. 12 represents a cross-section along the lines A–A'–B–B' of FIG. 10 of a single, complete, nozzle thermal chamber. The substrate 130 is generally a silicon wafer approximately 200 microns thick (thinned from a 500 micron wafer by back-etching after high temperature processing). The substrate 130, in addition to providing ink paths and thermal paths for waste heat, also acts as a semiconductor substrate for driver electronics which connect to the heater 120.

A thermal insulation layer 132 is provided as a 0.5 micron layer of thermally grown $SiO_2$. The layer 132 has several functions including providing electrical insulation for the heater 120 from an overlying passivation layer 144, providing mechanical cushioning of the heater 120 from the force of a collapsing vapour bubble, and acting as an integral part of a MOS driver circuit (to be later described). To allow for the best heat transfer from the heater 120 to the ink 106, the thermal layer 132 is preferably manufactured to be as thin as possible without sacrificing reliability. As the layer 132 is thermally grown $SiO_2$ and not CVD $SiO_2$, it has no pin holes. Thus, it is possible for it to be thinner than the corresponding layer on prior art bubblejet heads.

The heater 120 is a 0.05 micron layer of hafnium boride or other compound of group IIIA to VIA metal borides. This provides a high electrical resistance element to convert an electrical driving pulse to a thermal pulse. The very high melting point of $HfB_2$ (3100° C.) means that there is a substantial margin in the actual heater temperature. The electrical contact to the heater 120 is provided by a heater contact 123 comprised of 0.5 microns of aluminium. This is formed part of a first metal level 134.

The first metal level 134 is a layer of aluminium 0.5 microns thick. The first level 134 is formed at the same time as the contacts 123 to the heaters 120. This layer provides connections between the heaters 120 and the drive electronics (to be described), as well as connections within the drive electronics. It is to be noted that for the colour ZBJ heads described in this specification, there are a large number of nozzles 110 in a small area, requiring a high interconnection density and fine line width. Because of this, interconnection sizes of the order of 2 microns are required.

An interlevel insulation layer 136 is provided as a layer of CVD $SiO_2$ or PECVD $SiO_2$ (PE=photon enhanced), approximately 1 micron thick. The thickness of the layer 136 is important to the operation of the ZBJ chip 100, as it provides a thermal lag between the heater 120 and a thermal shunt 140, thereby ensuring that the majority of the heat is transferred to the ink 106 rather than to the substrate 130. The interlevel insulator 136 also provides the electrical insulation between the first metal level 134 and a second metal level 138, but in this role, the thickness is not critical.

A second metal level 138 is provided and forms the second level of electrical interconnections as well as the thermal shunt 140. The interconnection density of the high speed ZBJ heads earlier described (with 250 nozzles per linear millimeter) is high enough to require two levels of metal if 2 micron design rules are used. Other head designs may only require one level of metal. If one level of metal is used, an alternative arrangement for the thermal shunt 140 is required, as this is formed on top of the interlevel oxide 136.

The thermal shunt 140 is formed from a disc of aluminium approximately 0.5 microns thick. The shunt 140 is thermally connected to the substrate 130 through vias 410 in the thermal layer 132 and the interlevel layer 136, but serves no electrical purpose. The purpose of the thermal shunt 140 is to couple waste heat from the heater 120, to the substrate 130 at a controlled rate. The heat must be substantially removed in the period between heater energisation pulses, so that the quiescent temperature of the ink 106 remains low.

It is intended that the thermal shunt 140 be formed at the same time as the second metal level 138. This is possible if the thickness of the thermal shunt 140 corresponds to that of the second metal level 138. The required thickness is determined by the quality of heat coupling between the thermal shunt 140 and the heater 120. The actual amount of heat coupling required is best determined by accurate computer modelling for the particular nozzle geometry used. The amount of heat coupling can be varied from that illustrated (in FIGS. 32–35 to be described hereafter) either by etching holes in the heat coupling disc of the shunt 140 so as to decrease the thermal conductivity. Alternatively, the thermal coupling can be increased by increasing the thickness of the shunt 140 and/or replacing it with a material of higher thermal conductivity, such as silver.

Another purpose of the thermal shunt 140 is to prevent a overcoat 142 formed of thick CVD glass from being heated. This will slow CVD carrier gas diffusion through the thick layer 142, and therefore slow the formation of gas bubbles which can destroy the heater 120.

The overcoat 142 is a thick layer of CVD or PECVD glass, and has three functions. Firstly, to provide the nozzle for ink ejection, secondly to provide mechanical strength to resist the shock of exploding or collapsing vapour bubbles, and thirdly to provide protection against the external environment.

Because the ZBJ chip 110 must be exposed to air for the printing process to operate, its surface therefore requires increased levels of protection than that required for hermetically sealed devices. The thickness of the overcoat 142 can be about 4 microns although this can be substantially thicker to provide adequate nozzle length.

A passivation layer 144 is provided by means of a 0.5 micron layer of tantalum, or other materials, which is conformably coated over the entire structure of the chip 100 to provide chemical and mechanical protection thereto.

Finally, the ink 106 in FIG. 12, as well as having the obvious function of providing the printing mechanism, also acts to remove waste heat. A 3 pl drop of ink generally removes 13 nJ of heat for each degree celsius that its temperature has been raised.

Figure 13:
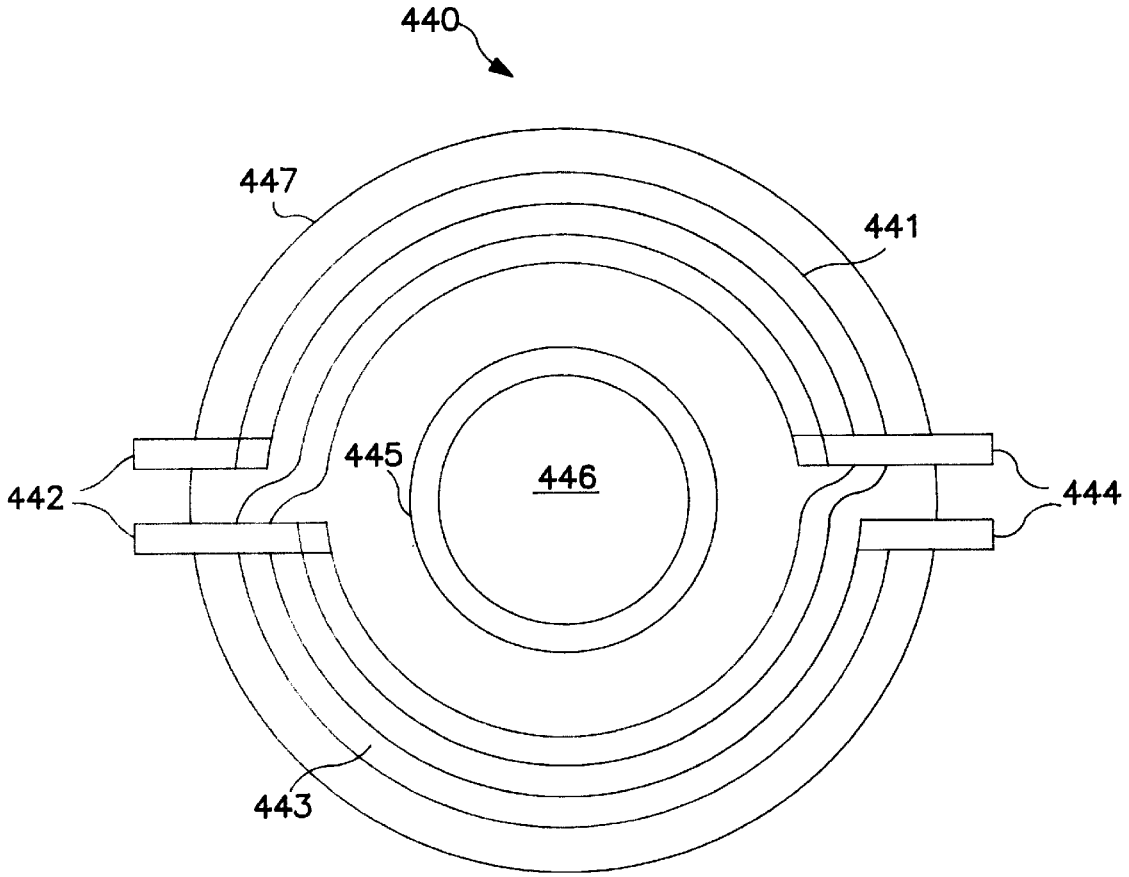
FIG. 13 shows an alternative heater configuration.

In FIG. 13, an alternate configuration of the heater is shown. Here, a heater 440 has a main heater 441 and a redundant heater 443 each of which are annular and surround the nozzle 445 out of which an ink drop 446 is ejected.

The heaters 441 and 443 are made of deposited HfB2 and are interlaced by overlapping aluminium connections 442 and 443 (respectively). With this configuration, the heater 440 surrounds the underlying thermal cavity 447 and can therefore produce an annular ink vapour bubble (see FIGS. 24 to 31). This bubble therefore tends to exert near equal pressure to all sides of the ink drop 446. Because the main heater 441 and redundant heater 443 are identical with respect to shape and location, they have identical drop ejection characteristics. The heaters 441 and 443 are also slightly eccentric with respect to the nozzle 445 and so the drop ejection angle does not change significantly if the main heater 441 fails and the redundant heater 443 is used.

Although FIG. 12 illustrates a nozzle 110 having a cylindrical cavity 112 and narrower tip 11, forming an underlying thermal chamber or cavity 115, various alternative nozzle geometrics are also useful, some of which are illustrated in FIGS. 14 to 23.

Figure 14:
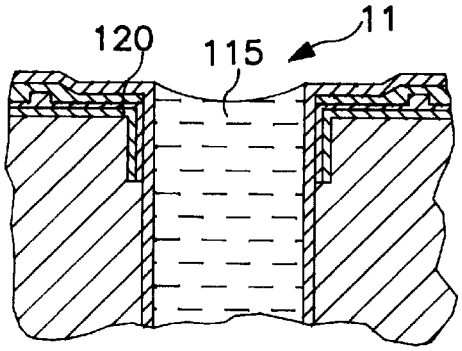
FIGS. 14 to 23 show various alternate nozzle configurations.

In FIG. 14, the thermal chamber 115, which surrounds the nozzle tip 111 is arranged as a cylinder, with the heater 120 deposited in the walls of the cylinder. This arrangement has several disadvantages, including:

(1) the heater film must be deposited vertically inside the cylinder and whilst this can be achieved by chemical vapour deposition (CVD), it is then very difficult to etch the heater 120 into the required size and shape;

(2) it is difficult to achieve a redundant heater configuration for fault tolerance (to be later described);

(3) the heater 120 must be buried below the surface so that there is ink 106 to eject, or the vapour will simply vent out of the tip 111; and (4) the ink is separated from the heater 120 by CVD $SiO_2$ instead of crystalline $SiO_2$, which has a higher thermal conductivity.

Figure 15:
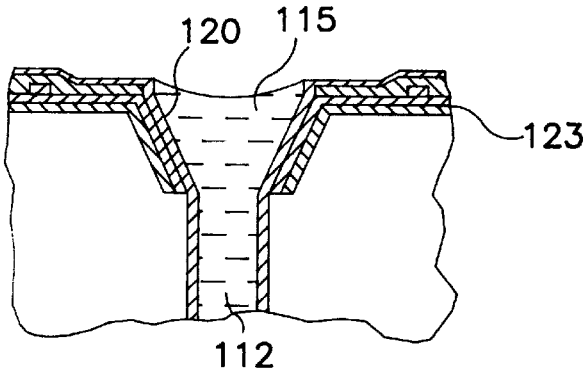

In FIG. 15, the thermal chamber 115 is arranged as a cone. This is to allow the heater 120 to be etched to increase its resistance. This arrangement has the following difficulties:

(1) if the cone angle is made too shallow, the nozzle 110 will not fill with ink 106 by capillary action.

(2) if the cone angle is made too steep, like the cylindrical chamber it is still difficult to etch the heater 120; and (3) the nozzle barrel 123 is very narrow, thus increasing the ink refill lime.

Figure 16:
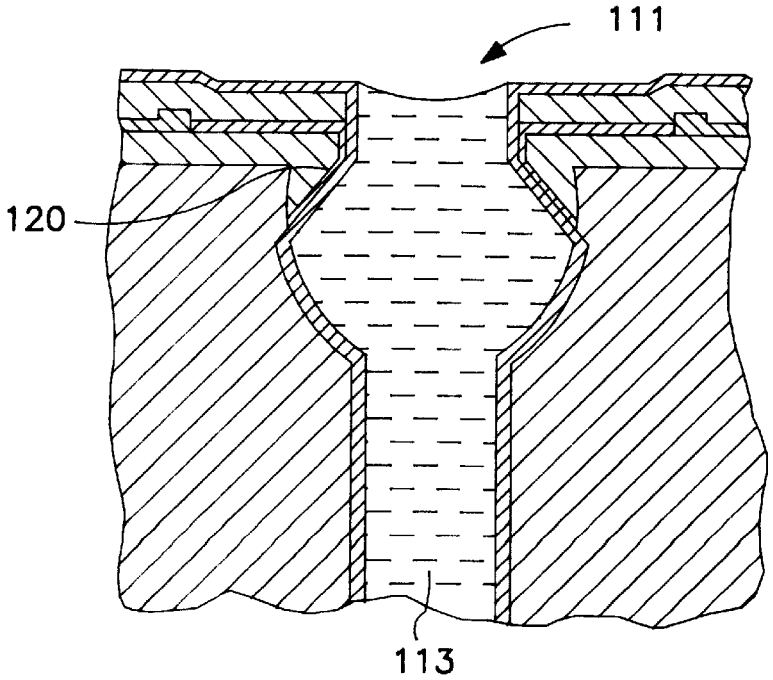

FIG. 16 shows a quasi-hemispherical chamber in which the heater 102 is formed on a frusto-conical section which faces into a substantially hemispherical chamber.

FIGS. 17 to 22 show size preferred nozzle structured which permit monolithic construction, a small drop size of 3 picoliters thus permitting 1600 dpi printing, fault tolerant heater design, nozzle spacing anywhere on the surface of the substrate and permitting use in multi-colour print devices. Further, more detailed discussion of the fabrication of the following nozzle structures can be found later in this document.

Figure 17:
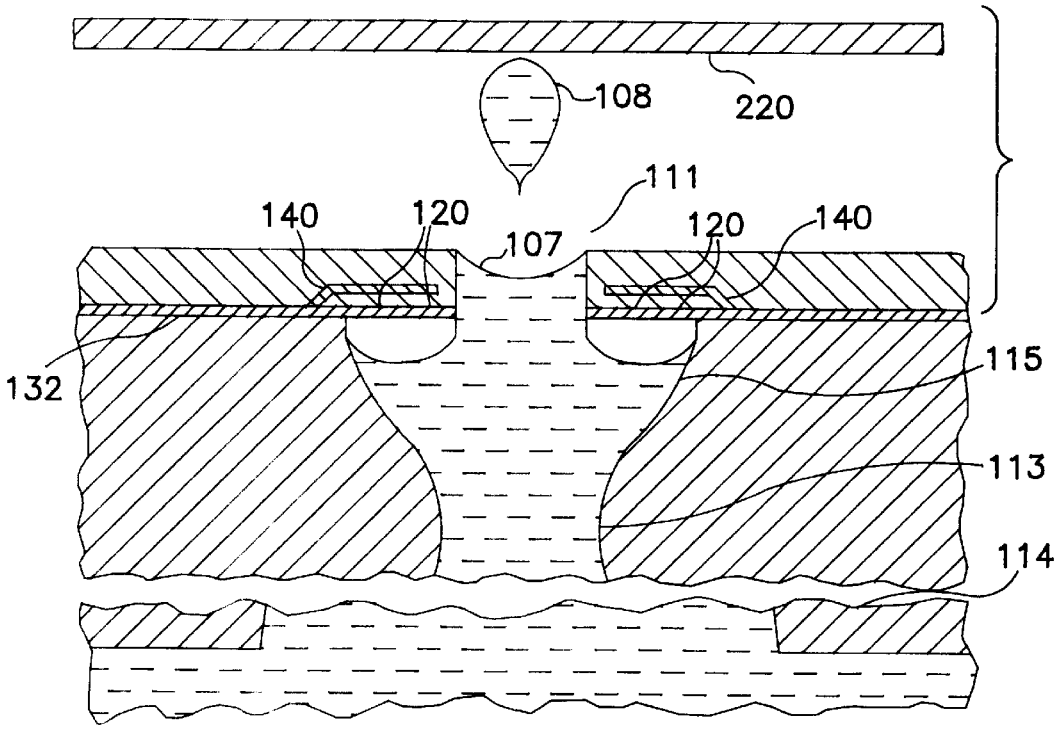

FIG. 17 illustrates a substantially hemispherical thermal chamber 115 and which is formed by applying an undercutting isotropic plasma etch of silicon before reactive ion etching (RIE) of the nozzle barrel 113. This configuration is characterised by a reverse action in which the formation of the bubble 116 is in the direction opposite to the ejection of the ink drop 108. The thermal shunt 140 conducts heat away from the nozzle area into the substrate 130 to reduce the time taken for the thermal chamber 115 to cool sufficiently prior to the ejection of the next ink drop 108.

This configuration has advantages of planar construction of the heater 120 whereby accurate control of the heater shape and size can be achieved. Also, the thermal coupling between the heater 120 and the ink 106 is significant, because the heater 120 is isolated from the ink 106 by the thermal $SiO_2$ layer 132 which is more thermally conductive than CVD glass. Also, this layer can be manufactured thinner than a corresponding layer of CVD glass, as it is not prone to pinholes. Depending on the slope of the barrel 113 as it enters the thermal 115, and the contact angle of the ink with the passivation layer 144 (see FIG. 12), this nozzle geometry will permit automatic filling by capillary action.

Disadvantages of this configuration reside in the reversed operation by which bubble formation is in the opposite direction to ink ejection which reduces efficiency. Also, the thick CVD glass over coat 142 is required which forms the nozzle region. Finally, waste heat must be dissipated via a long path through approximately 600 microns of silicon substrate 130. This limits the nozzle density and/or the maximum firing rate of the nozzles. Other disadvantages relate to potential difficulties with the nozzle 111 filling with ink 106, by capillary action, if the angle of the barrel 113 and and the thermal chamber 115 are not closely monitored.

Figure 18:
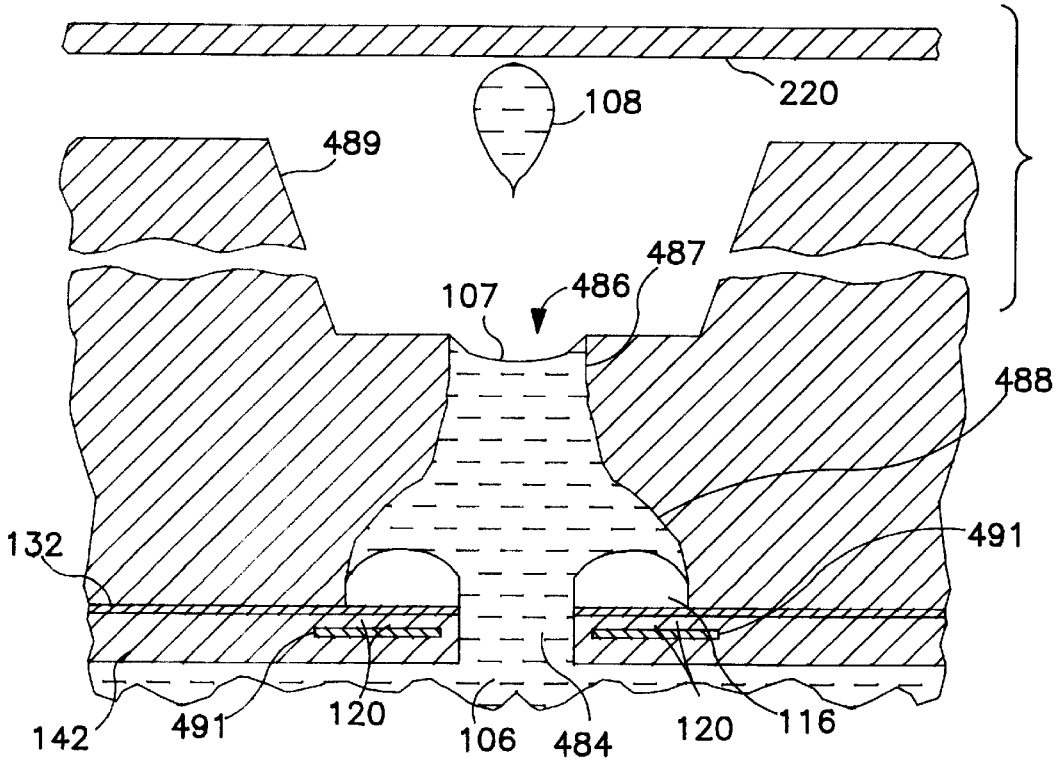

FIG. 18 is similar to the configuration of FIG. 17 except that in this geometry, the direction of flow of ink 106 through the chip 100 is reversed giving a reversed nozzle arrangement 485 in which bubble formation is in the same direction as ink drop ejection.

As seen in FIG. 18, ink 106 enters the nozzle passageway through an aperture 484 and a meniscus 107 is formed at the nozzle tip 486 boundary between the barrel 487 and the channel 489. Formation of bubbles 116 acts to expel an ink drop 108 through the channel 489 and onto a medium such as paper 200.

The configuration of the reverse nozzle arrangement 485 differs in one significant way from the earlier configuration described. The earlier configurations (e.g. FIG. 17) utilise a thermal shunk 140 which acts to shunt heat away from the heater 120 and into the substrate 130. However, in the configuration of FIG. 18, immediately adjacent the heaters 120 is an underlying reservoir of ink 106. Accordingly, a thermal diffuser 491 is used to increase the area of heat transport from the heater 120 through the overcoat 142 and into the ink 106 reservoir. In this configuration, because the heat conductive path is much shorter than that of FIG. 17, greater heat dissipation can be achieved. Also, heat dissipation can be further enhanced by re-circulating the ink 106 through a heat exchanger using a supply pump (not illustrated).

This configuration has the advantages of planar construction, good thermal coupling and heat dissipation. Also, bubble direction is in the direction of ink ejection which reduces kinetic losses. A disadvantage of this configuration is that the nozzle is not self priming, and must be initially primed using positive pressure. Once primed, the shrinking bubble will draw ink into the thermal chamber 488 after the drop 108 has been fired. Also, the cantilevered section supporting the heaters 120 must be sufficiently thick to withstand the shock from collapsing bubbles 116.

Figure 19:
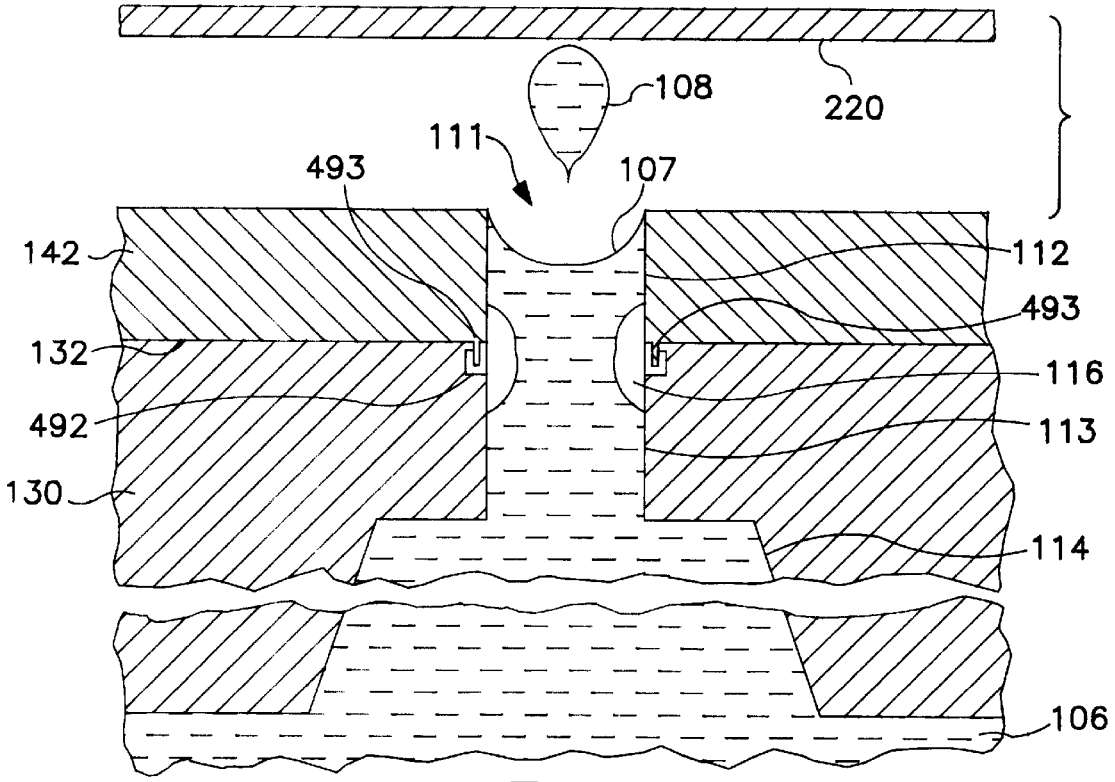

Turning now to FIG. 19, a nozzle arrangement is shown which includes a trench implanted heater 493. In this embodiment, the nozzle cavity 112 is formed as a straight cylinder communicating with the nozzle barrel 113 and the optionally etched nozzle channel 114. An annular trench 492 is etched into the silicon, and a layer of $SiO_2$ is grown adjacent and about the nozzle cavity 112. The annular heater 493 is plated on the trench 492 which acts to form vapourised bubbles 116 which expand across the cavity 112 transverse the direction of drop ejection. Advantages of this configuration include good thermal coupling and self-priming. Disadvantages includes poor heat dissipation because liquid cooling by forced ink flow is not effective as the bulk of the ink is isolated from the bubble generating surface by 600 microns of substrate 130. Also, it is difficult to obtain adequate nozzle length as this must be generated by very thick layers of CVD glass forming the overcoat 142. Additionally, bubble formation being transverse permits non-optimal motion coupling. Also, thermal conduction into the substrate 130 is high causing heat to be wasted therethrough. Finally, the length of the heater 493 is constrained by the circumference of the nozzle, or half the circumference if fault tolerance is employed, and so it is difficult to obtain a high resistance heater 493.

Figure 20:
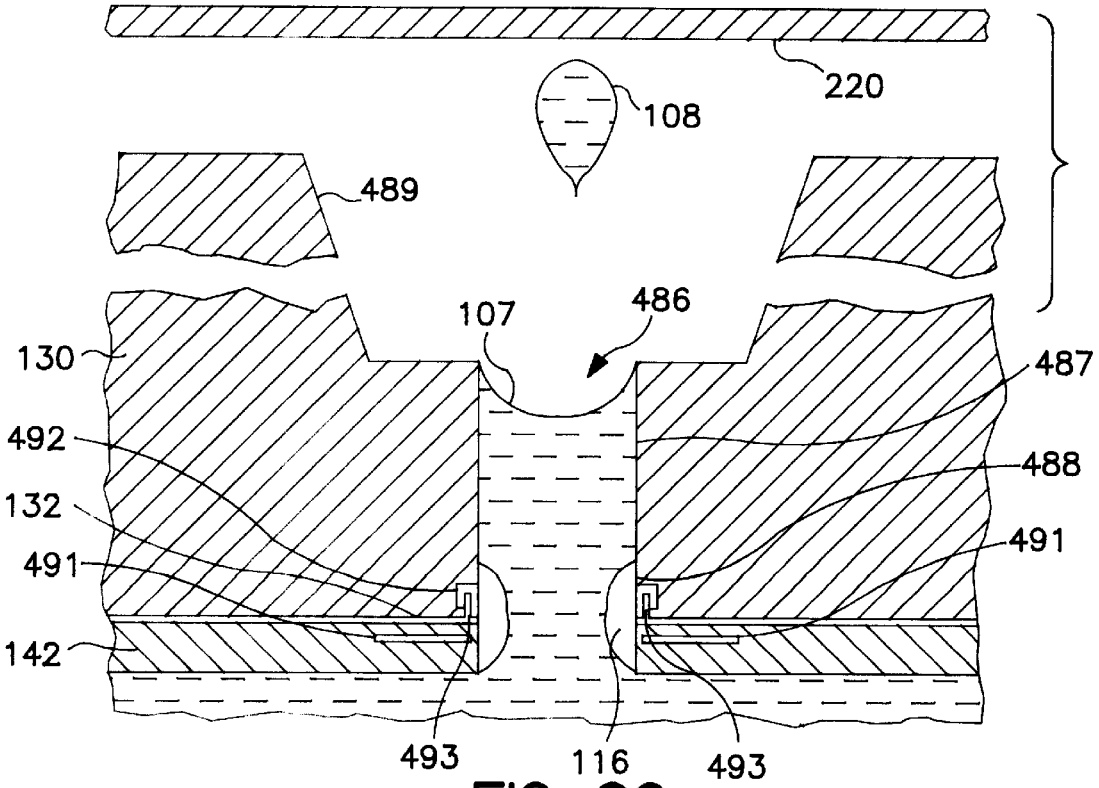

FIG. 20 illustrates the annular trench configuration of FIG. 19 shown in the reversed arrangement. Here the annular trench 492 extends towards the nozzle tip 486 as does the diffused heater 493 therein. A thermal diffuser 491 is also provided in the previous manner. Unlike FIG. 19, due to the configuration of the channel 489 the nozzle length can be easily varied. Advantages of this configuration reside in thermal coupling, ease of heat dissipation, self priming and ease of manufacture. Disadvantages include the bubble direction being transverse to the direction of ink drop ejection, and difficulty in controlling the length of the heater 493. Also, thermal conduction to the silicon substrate 130 is high which causes heat to be wasted.

Figure 21:
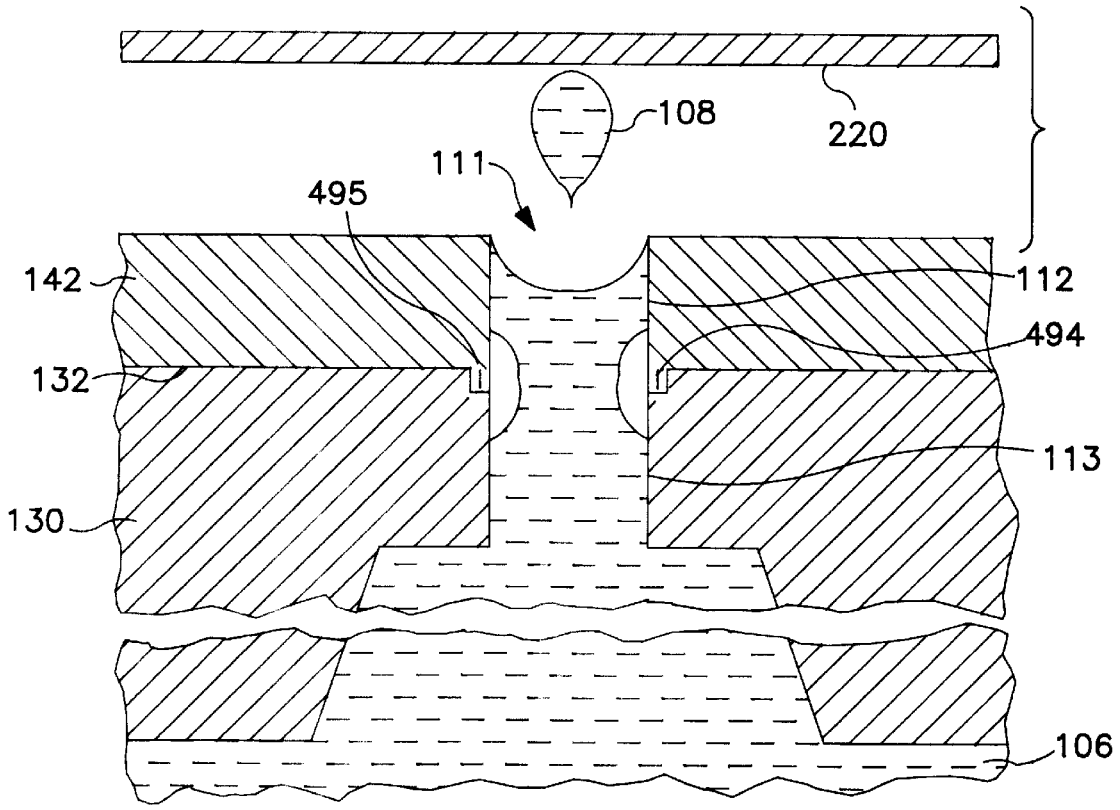

FIG. 21 shows a further configuration utilising an elbow heater. In this embodiment, a cylindrical nozzle passageway is formed between the nozzle tip 111 and the barrel 113. Thermally grown $SiO_2$ is provided as a layer 494 which extends into the barrel 113. An elbow oriented heater 495 is then plated onto the layer 494 and an electrical contact 496 made on the top surface of the heater 495. Overcoat layer 142 of CVD $SiO_2$ is then provided over the contact and heater and extends into the nozzle barrel 113. Advantages of this configuration are self priming and thermal insulation of the heater 495 from the substrate 130. Disadvantages include poor heat dissipation, difficulties in controlling the nozzle length by varying the thickness of the overcoat 142, transverse bubble direction, poor thermal coupling due to the heater 495 being isolated from the ink 106 by a layer of amorphous CVD glass, difficulties in controlling heater length, and manufacturing complexity (described later).

Figure 22:
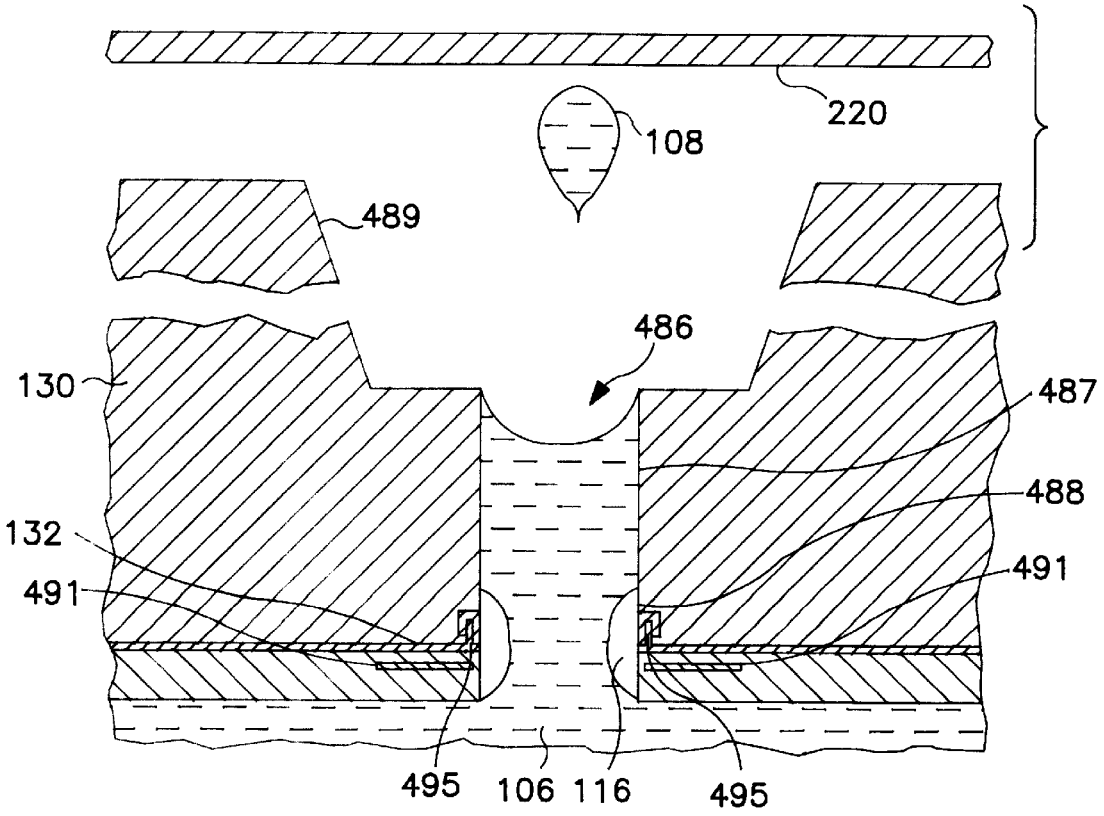

FIG. 22 illustrates the reverse arrangement of the elbow connected heater 495 which is manufactured in a similar manner. Advantages include heat dissipation through the ink reservoir, self priming and the heater 495 being thermally insulated from the substrate 130. Disadvantages include transverse bubble direction, poor thermal coupling through the amorphous CVD glass between the heater 495 and ink 106, and constraints to the heater length.

Figure 23:
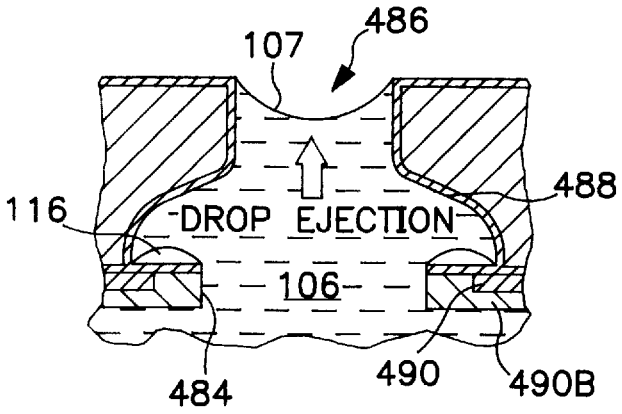

FIG. 23 illustrates a nozzle arrangement similar to that of FIG. 18, however the relative sizes of the nozzle aperture 484 and the nozzle tip 486 have been varied to improve capillary action for the filling of the nozzle and the formation of the meniscus 107. One disadvantage of the configuration of FIG. 18 is that the nozzle aperture 484 and the nozzle tip 486 have equal diameters. The diameter of the nozzle tip 486 varies depending on a number of design criteria such as the desired drop size.

In order to prime the nozzle and provided the meniscus 107 as illustrated, the ink 106 must flow through the aperture 484 but then stop at the tip 486. Generally, if both are the same size, the ink will either form a meniscus at the aperture 484, or drip through the tip 486 depending on the priming pressure. Neither of these conditions are desired. What is specifically desired is that the aperture 484 be of sufficient diameter to allow for priming of the nozzle, and that the tip 486 be of a different, smaller diameter to provide for the formation of the meniscus 107. The nozzle is then primed using a pressure greater than the "bubble pressure" of the nozzle 486. The configuration of FIG. 23 which illustrates a suitable arrangement wherein the diameter of the aperture 484 is approximately 50% larger than that of the tip 486. This configuration also provides for accurate control of the drop size whilst maintaining high refilling rates of the nozzle.

Figure 24:
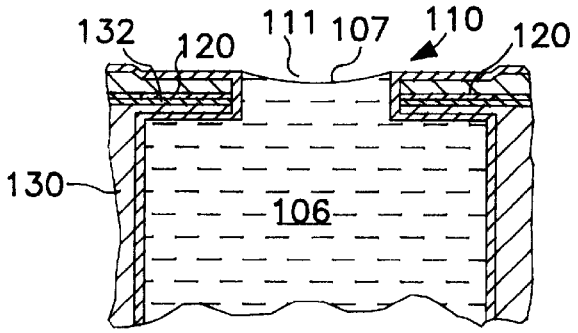
FIGS. 24 to 31 show the manner of expulsion of ink from one nozzle of the ZBJ chip.

The operation of the ZBJ chip 100 differs from that of prior art bubblejet heads through the use of an alternate drop ejection mechanism which is illustrated in FIGS. 24 to 31. In FIG. 24, a single nozzle 110 of the ZBJ print head 100 is shown in its quiescent state where the heater 120 is off. Ink 106 within the nozzle 110 forms a meniscus 107.

Figure 25:
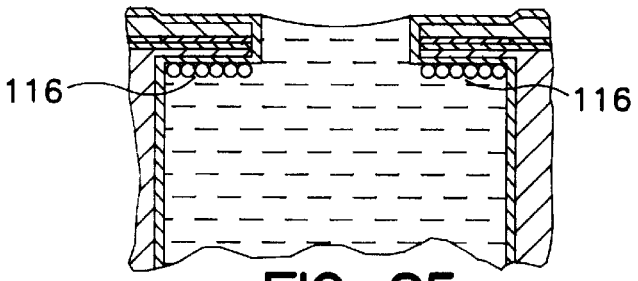

In FIG. 25, the heater 120 is turned on thus heating the surrounding substrate 130 and thermal layer 132 which in turn heats the ink 106 within the nozzle 110. Some of the ink 106 evaporates to form small bubbles 116.

Figure 26:
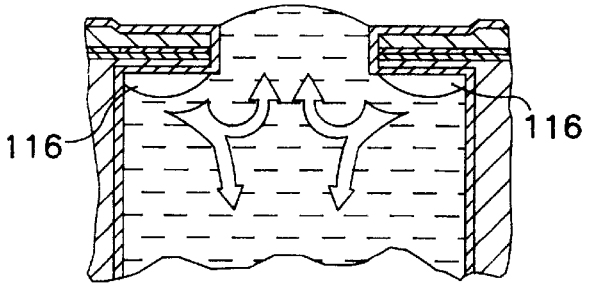

As seen in FIG. 26, as the evaporated ink 106 is heated, it expands and coalesces into large bubbles 116.

Figure 27:
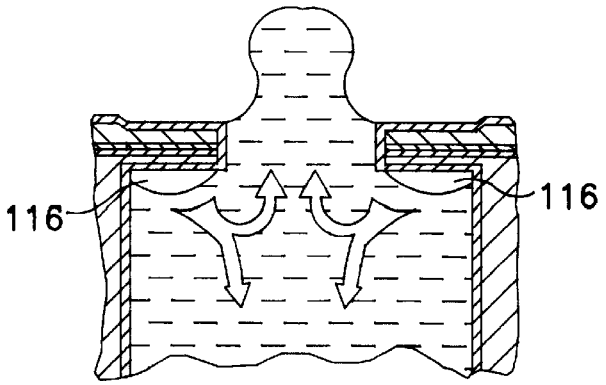

In FIG. 27, pressure from the expanding gas bubbles 116 forces ink 106 out of the nozzle tip 111 at high speed.

Figure 28:
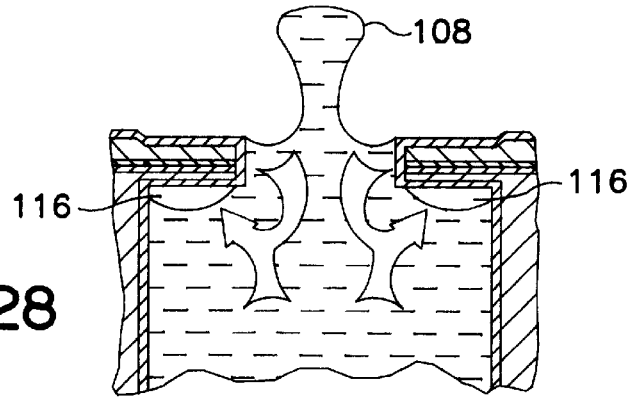

In FIG. 28, the heater 120 is turned off which acts to contract the bubble 116 and draw ink 106 from the drop 108 that is formed.

Figure 29:
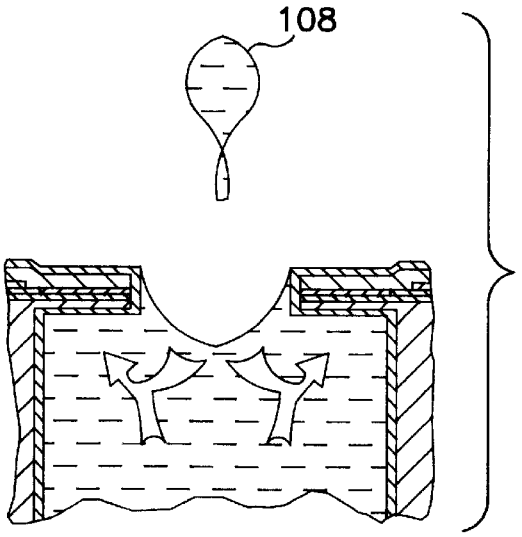

In FIG. 29, the drop 108 separates from the ink 106 within the nozzle 110 and the contracting bubble 116 draws an ink meniscus 107 backwards into the nozzle 110.

Figure 30:
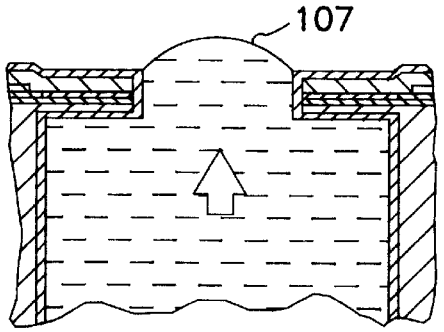

As seen in FIG. 30, surface tension causes the nozzle 110 to refill with ink 106 from the underlying reservoir and in which the velocity of ink 106 causes overfilling.

Figure 31:
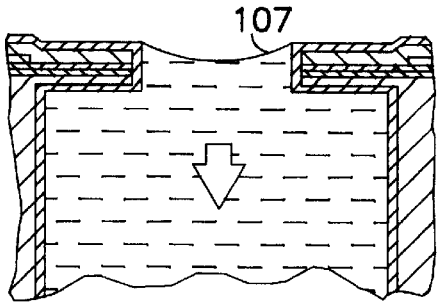

Finally in FIG. 31, the ink 106 oscillates, and eventually returns to the quiescent state. The oscillating damping time is one factor which determines the maximum dot repetition rate.

Figure 32A:
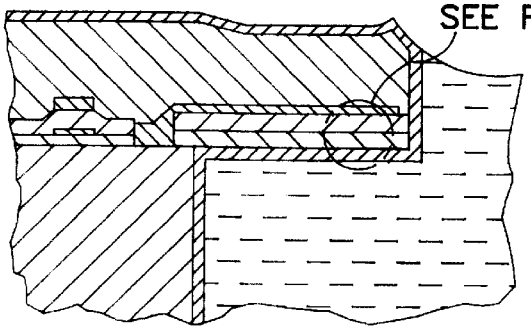
FIGS. 32A to 36 illustrate the transfer of heat about the ZBJ chip.
Figure 32B:
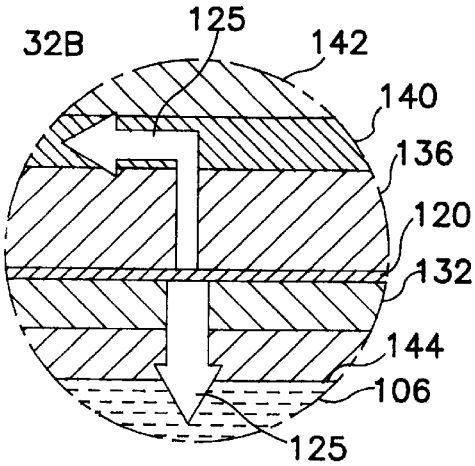

As depicted in FIG. 32, when the heater 120 is turned on, a portion of the heat will flow into the ink 106, and the remainder flows into the material surrounding the nozzle in the manner indicated.

Figure 33A:
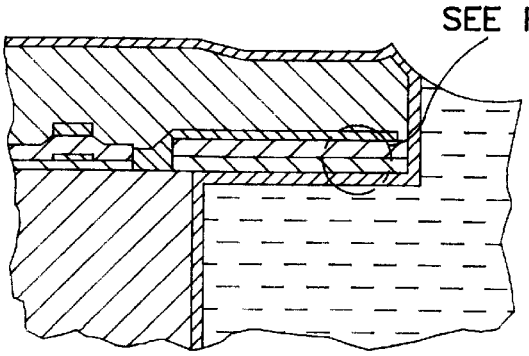
Figure 33B:
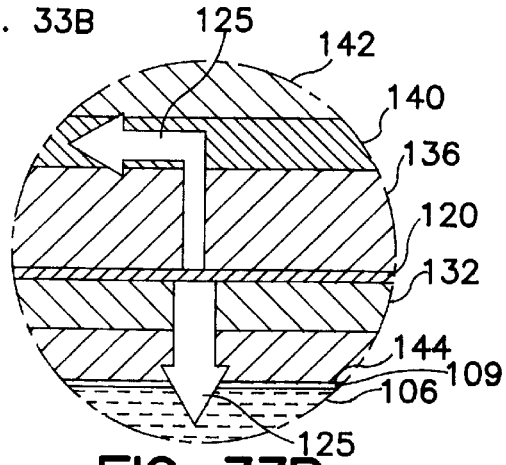

FIG. 33 illustrates the super heating of ink in which a thin layer of superheated ink 109 forms adjacent the passivation layer 144 within the nozzle cavity 112.

Excess heat must be rapidly removed after the heater 120 is turned off. Within 200 microseconds of the heater 120 being energized, there should be no ink 106 remaining at a temperature above 100° C., at which bubbles 116 form due to the ink 106 being substantially composed of water. If this is not achieved, the next ink drop 108 will not fire correctly as there will be an insulating layer of vapour between the heater 120 and the ink 106.

The waste heat is removed by three separate paths. Firstly, heat is removed through the ink which acts to raise its temperature slightly. However, the thermal conductivity of ink is low, so the amount of heat removed by this path is also low.

Because the walls of the nozzle 110 are made of silicon from the substrate 130, and have high thermal conductivity, heat dissipation through the walls is fast. However, not all of the bubble 116 will be in contact with the side walls of the nozzle 110.

Figure 34A:
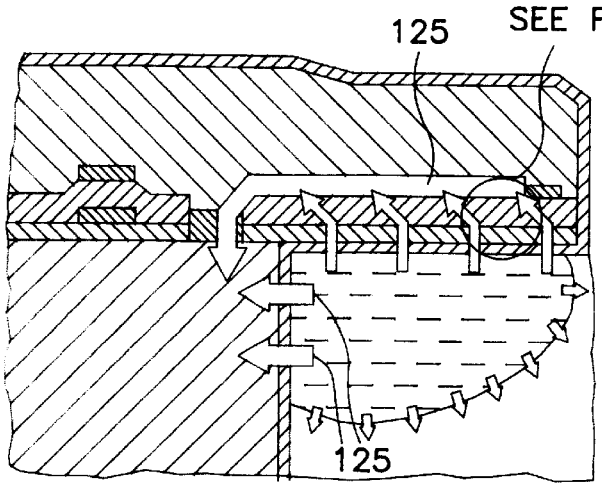
Figure 34B:
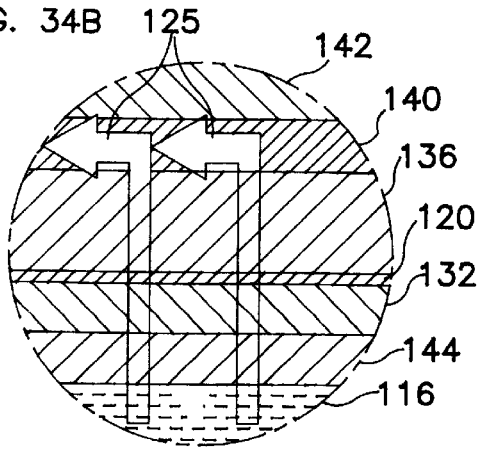

Also, waste heat is removed through the heater element 120. Heat dissipation through the heater element 120 is important, as no ink vapour must be in contact with the heater 120 when the next drop is fired. Because the bulk of material around the heater 120 is glass, with low thermal conductivity, the thermal shunt 140 is included, to shunt waste heat to the substrate 130. If the removal of this heat can be achieved within approximately 200 microseconds, then it is not necessary to include the thermal shunt 140. FIG. 34 illustrates the heat flow from the cooling bubble 116 as described above.

Figure 35:
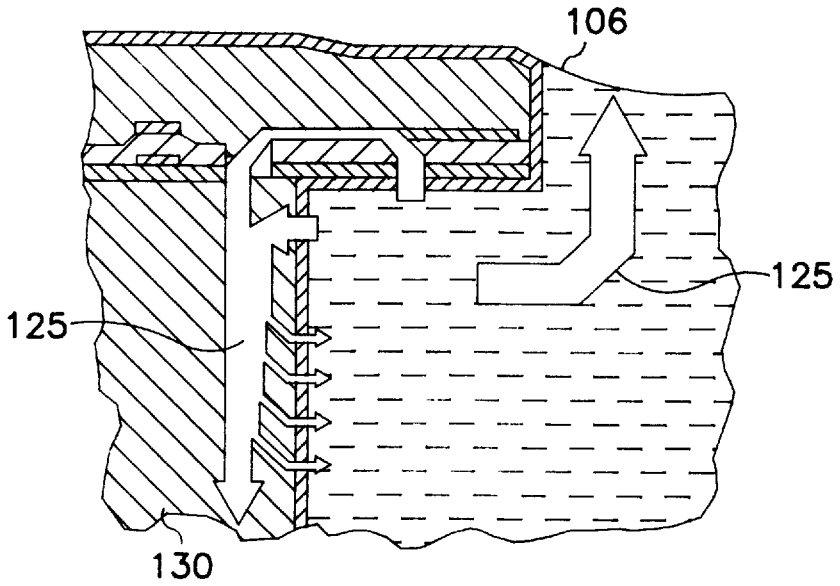

FIG. 35 also shows waste heat removal paths 125 in which heat will flow through the substrates 130 as the main thermal conduit away from the heater 120. Some of this heat will flow back into the ink 106 and eventually be ejected with subsequent drops 108. The remainder of the heat will flow through the substrate 130 and into the aluminium heat sink (51, 52), seen in FIG. 4.

Figure 36:
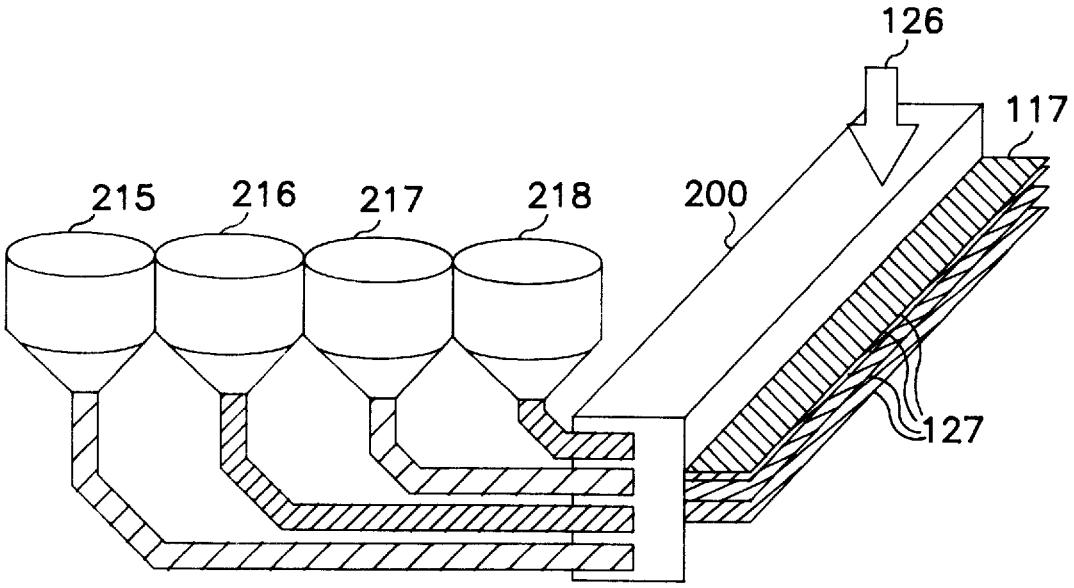

FIG. 36 illustrates the macroscopic heat dissipation for the ZBJ head 200 with 51,200 nozzles printing four colours. If the heater action does not raise the average temperature of the entire head assembly 200 more than about 10° C. to 20° C. above that of the incoming ink 106, it is not necessary to provide an external cooling mechanism. In this manner, the ZBJ head 200 can be effectively cooled by a steady flow of ink 106 from ink reservoirs 215, 216, 217 and 218 as illustrated. The quantity of ink flow is in direct proportion to the heat generated, as ink 106 is expelled every time the heaters are turned on.

Generally, about 50 watts of electrical power 126 is supplied to the head 200 which outputs a spray 117 of 12,800 drops per colour per 200 μs use. This represents an output 127 of about 1.28 ml of ink drops per second at ambient temperature plus 10°–20° C. It should also be noted that the driver circuit on the chip 100 also dissipates some power but this is minor compared to that dissipated by the heaters 120 themselves.

However, if the nozzle efficiency (thermal and the substantially smaller kinetic output compared with electrical input) is less than that indicated above, more heat will be generated than can be expelled with the drops without raising the ink temperature excessively. In this case, other heat sinking methods (such as forced air cooling or liquid cooling using the ink) can also be used.

While the average temperature of the ZBJ print head 200 is low, the operating temperature of the ZBJ heater elements 120 is above 300° C. It is important that the active elements (drive transistors and logic) of the ZBJ chip 100 do not experience this temperature extreme. This can be achieved by locating the drive transistors and logic as far from the heater elements 120 as possible. These active elements can be located at the edges of the chip 100, leaving only the heaters 120 and the aluminium connecting lines in the high temperature region.

Figure 37:
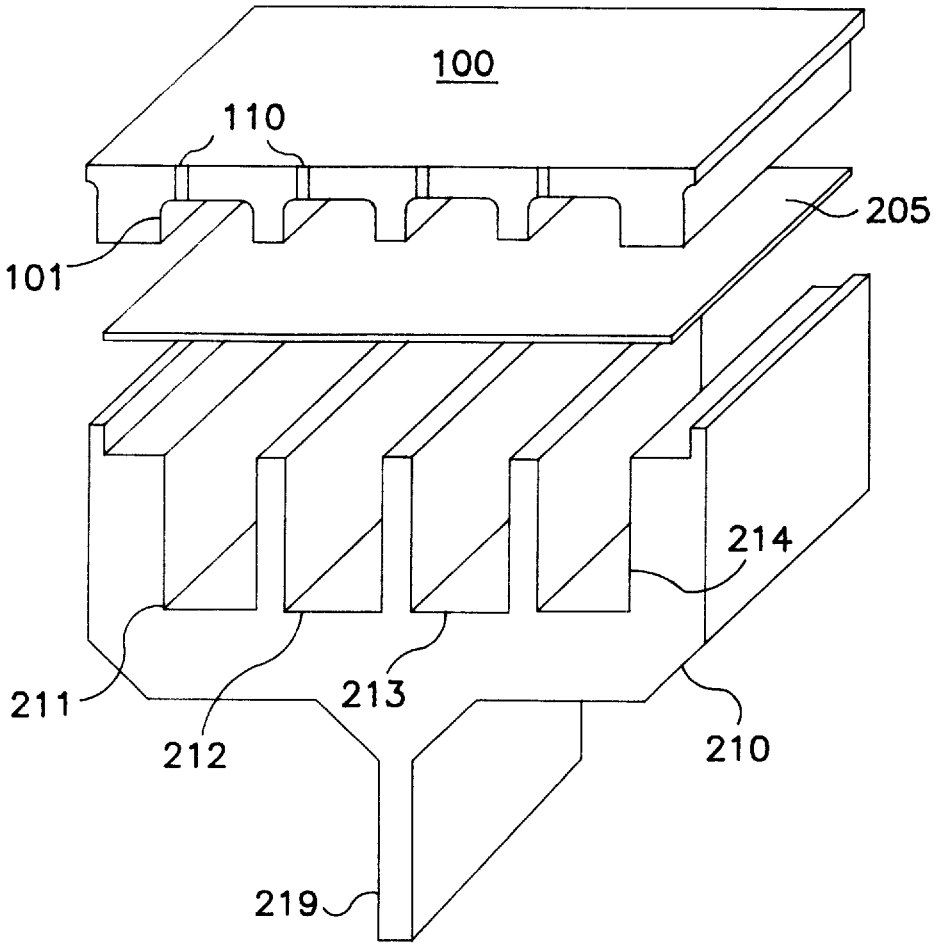
FIGS. 37 and 38 show the configuration of a ZBJ print head including a chip, membrane filter and ink channel extrusion.
Figure 38:
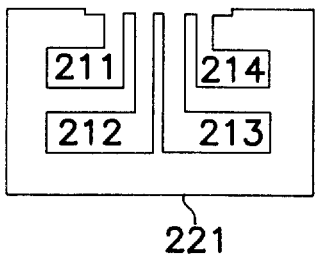

Ink Channel:

As seen in FIGS. 37 and 38, a full colour ZBJ print head 200 has four ink channels, one for each of cyan 211, magenta 212, yellow 213 and black 214. These channels 211–214 are formed as an aluminum extrusion 210 and are filtered and sealed against the back of the ZBJ chip 100.

In some applications, the ink channels 211–214 of FIG. 37 are not sufficient to provide adequate ink flow. In such a situation, the extrusion profile of FIG. 38 can be used so as to increase the volume of flow. As seen in FIG. 37, a 10 micron absolute membrane filter 205 is provided between the ink channel extrusion 210 and the ZBJ chip 100 so as protect against ink contamination. If the membrane filter 205 is compressible, then it can also form as a gasket to prevent ink flow between the four colours. The edges of the head assembly 200 are preferably sealed to prevent gas ingress. For the above configuration, a manufacturing accuracy of approximately ±50 microns need only be maintained.

Blocked Heads:

Two potential sources of blocked heads and these are dried ink and contamination.

When the print head 200 is not in use, the exposed surface will dry out. If it dries too much, the pressure of a bubble 116 will be insufficient to dislodge any dried ink. This problem can be alleviated by:

1. Automatically capping of the head 200 with an air tight seal when not is use;
2. applying a solvent to the front surface of the ZBJ head 200 during a cleaning cycle;
3. The use of a self-skinning ink; and/or
4. A vacuum cleaning system.

Figure 44:
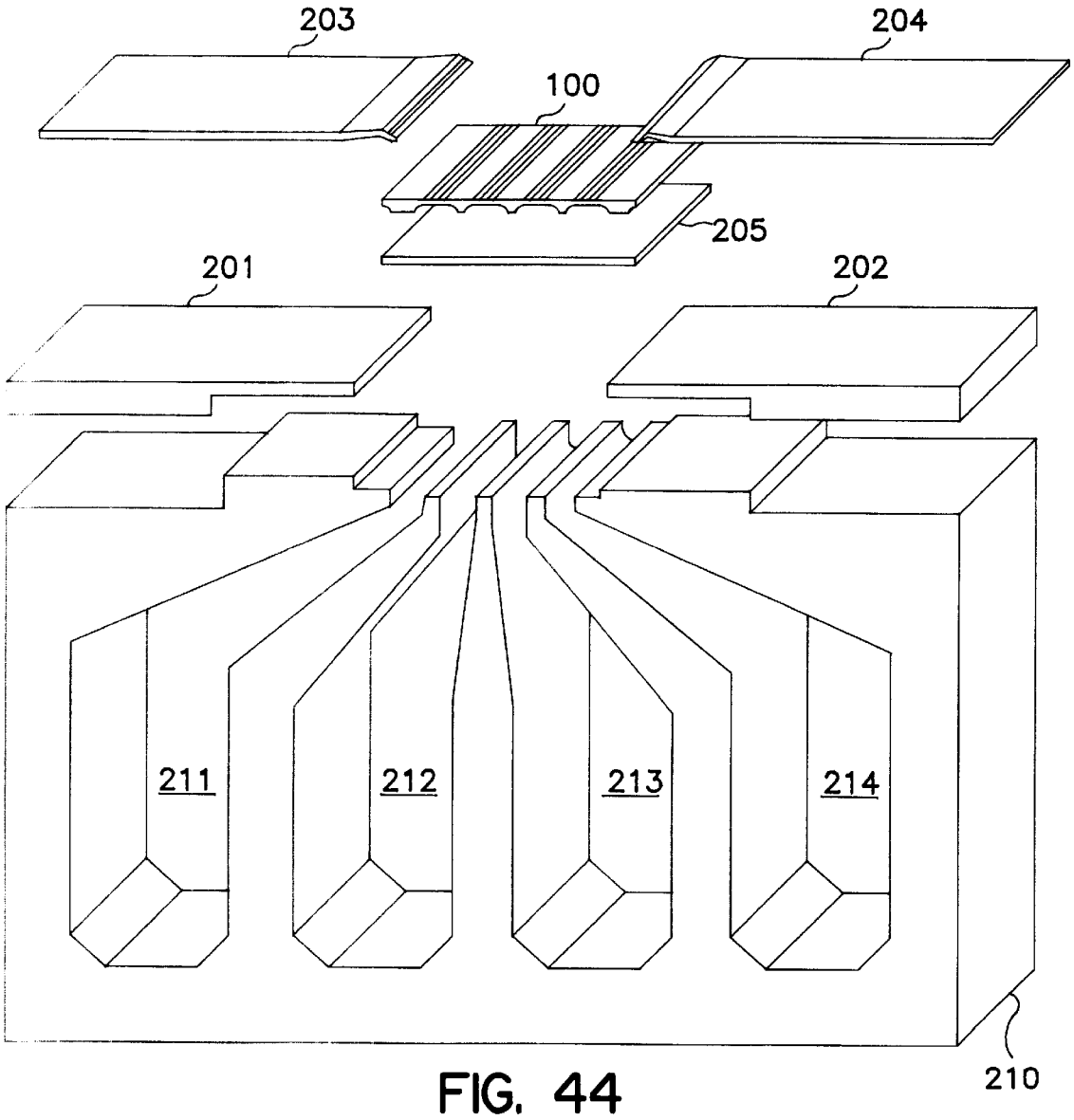
FIG. 44 is an exploded perspective view of a thin section of the full colour ZBJ print head assembly of FIG. 5.

The ZBJ chip 100 is susceptible to blockage by particulate contamination of the ink 106. Any particle of a size between 20 microns and 60 microns will permanently lodge in the nozzle cavity 112, as it cannot be ejected with the ink drop 108. A filter such as the membrane filter 205, is included in the ink path to remove all particles larger than 10 microns. This can be a 10 micron bonded fibreglass absolute filter and preferably has a relatively large area to allow sufficient ink flow. This is seen in FIGS. 35 and 44.

The continuous tone ZBJ chip 100 with four nozzles 110 per pixel has a degree of tolerance of blocked nozzles 110. A blocked nozzle 110 will result in a 25% reduction of colour intensity for that pixel rather than a complete absence of colour.

Nozzle to Heater Registration:

The existing prior art bubblejet technologies of Canon and Hewlett-Packard's thermal ink jet systems use a two-piece construction to form the nozzles. The heaters are formed on a silicon chip whereas the nozzles are formed using a cap manufactured of a different material. This technique has proven to be highly successful for the production of scanning thermal ink jet heads with moderate numbers of nozzles. However, to achieve full-width A4 printing (i.e. with a stationary head) with very small drop sizes, this technique becomes more difficult. With nozzle pitches of 64 microns and head lengths of 220 mm, differences in thermal expansion between the substrate and the nozzle cap as small as 0.02% are sufficient to cause malfunction. Even small ambient temperature changes will cause this degree of differential thermal expansion if the cap and substrate are made of differing materials. One solution to this problem is to make the cap out of the same material as the substrate, usually silicon. Even if this is done, differences in temperature between the silicon substrate and the silicon cap (caused by waste heat from the heaters) can be sufficient to cause mis-registration.

The ZBJ chip 100 does not suffer from these problems, as the heaters 120, nozzles 110 and ink paths 101 are all fabricated using a single silicon substrate 130. Nozzle to heater registration is determined by the accuracy of the photolithography with which the ZBJ chip 100 is manufactured. Due to the relatively large feature sizes of this configuration, there is little difficulty in ensuring that the nozzles are correctly aligned as the ZBJ chip 100 is a monolithic chip capable of being manufactured using a 2 micron semiconductor process.

Continuous Tone Images:

As it is difficult to vary the size of drops from a bubblejet head, continuous tone operation is achieved by varying the number of drops.

In the present case, 16 drops per pixel are used to create an image density of 400 pixels per inch. This gives 16 levels of grey tone per pixel. The tonal subtleties required to produce continuous tone images can be produced by standard digital dot or line screening methods or by error diffusion of the least significant 4 bits of an 8 bit colour intensity value. This results in a perceived colour resolution of 256 levels per colour, while maintaining a spacial resolution of 400 pixels per inch. There are two nozzle configuration considered herein: one nozzle per pixel; and four nozzles per pixel. In both cases, the drop size is assumed to be approximately 3 pl.

Figure 39:
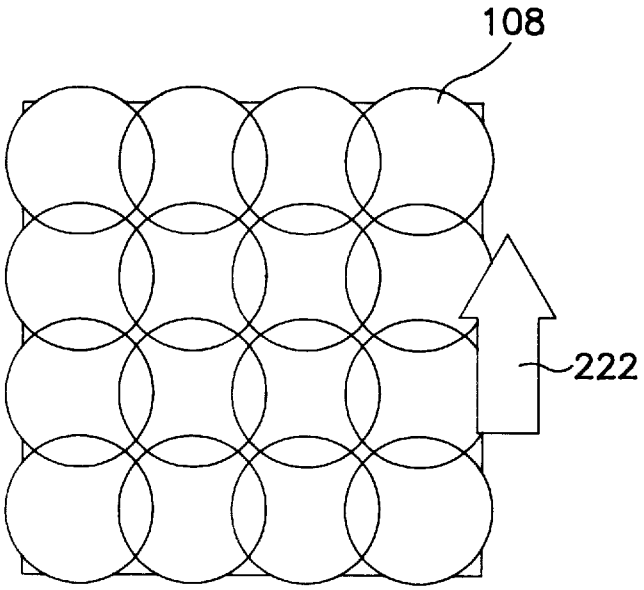
FIGS. 39 and 40 illustrate ink drop positions for a single pixel using a four nozzle per pixel print head and a single nozzle per pixel print head respectively.

FIG. 39 illustrates the ink drop positions for one pixel of a four nozzle per pixel configuration. In this case, the drops are patterns to fill the pixel in a 4×4 array of dimensions 64 mm×64 mm. Horizontal spacing is provided by the spacing between the nozzle 110, and vertical spacing is provided by paper movement. This arrangement provides sufficient linearity in the relationship between the number of drops and the colour intensity. Four nozzles per pixel also allows a print speed four times faster than that of one nozzle per pixel design, with only slightly larger chip area. The effect of a blocked or defective nozzle is also limited by a reduction in colour by 25%.

Figure 40:
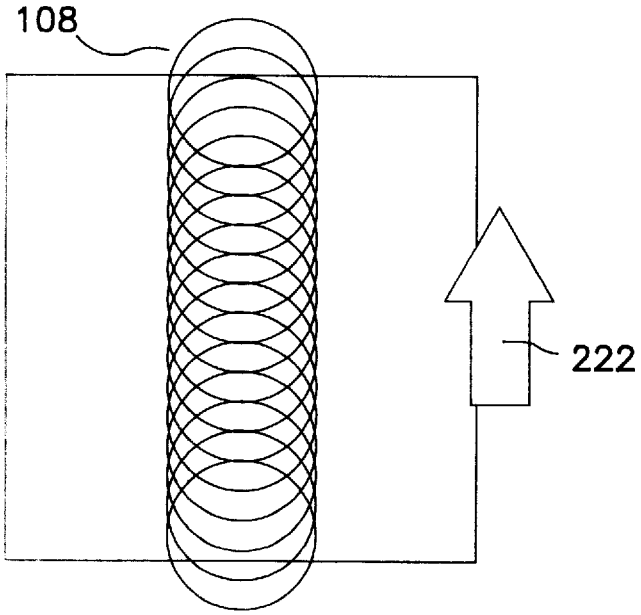

FIG. 40 shows a single nozzle type and the ink drop positions for one pixel. In this case, the vertical drop spacing is provided by paper movement. If sixteen drops are deposited in a 64 micron pixel, drops are spaced at 4 microns. The pixel is filled horizontally by the flow of wet ink from overlapping drop.

This arrangement has the disadvantages of severe non-linearity in the relationship between the number of drops and the colour intensity, and a lower print speed. The advantage is a lower cost of manufacture than that of the four nozzle per pixel embodiment.

Nozzle Configuration:

There are several factors which affect the optimum configuration of the nozzles 110. These include:

(1) For a print resolution of 400 dpi, 64 micron square pixels are required;

(2) The number of nozzles per pixel has a different effect on the nozzle configuration;

(3) The nozzle barrel 113 diameter affects the nozzle layout because the barrel 113 is larger than the diameter of the drop 108. In the preferred embodiment 100, the barrel 113 is 60 microns in diameter. To maintain mechanical strength of the chip 100, it is assumed that each nozzle 110 must be at least 80 microns from its nearest neighbour;

(4) The firing duty cycle, which is 1:32, allows a 6.25 microsecond heater pulse every 200 microseconds. This gives time for the ink meniscus 107 to stabilise before the next drop 108 is fired;

(5) To prevent major variations in the supply current energising the heaters 120, all of the 32 available time slots allowed by the 1:32 duty cycle are used by an equal number of nozzles 110. This means that:

$$\text{current} \leqq \text{number of nozzles} \times \text{nozzle current}/\mathbf{32};$$

(6) If adjacent nozzles 110 are fired in order, then the heat from one nozzle 110 can interfere with the next, and an area may become too hot. To minimise this problem, widely spaced nozzles 110 are fired in sequence. This is the reason why the firing orders, seen in FIGS. 42 and 43 (to be described) appear to be unnecessarily complex; and (7) The optimum arrangement for a colour head is not simply a monochrome head repeated four times. The extra nozzles of the colour head can be used to achieve better thermal distribution.

Figure 41:
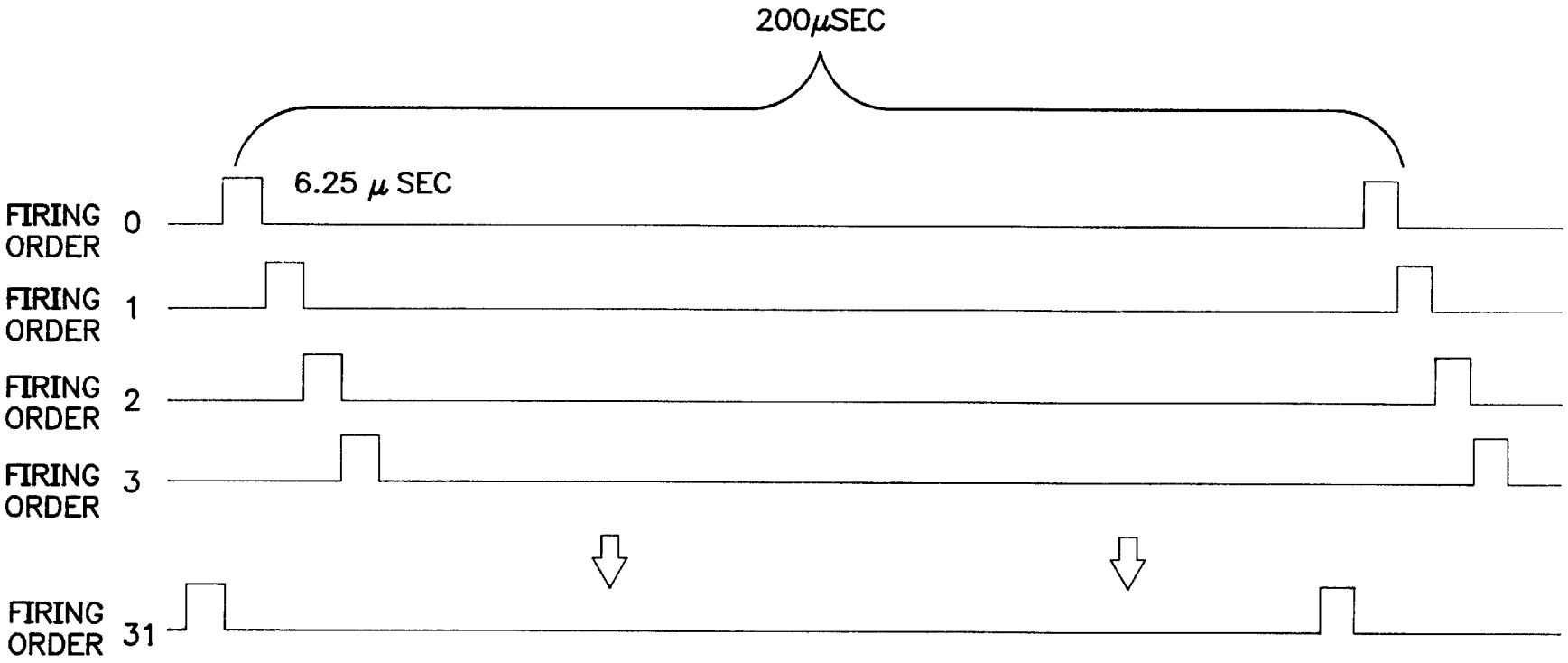
FIG. 41 is a timing chart illustrating nozzle firing order.

FIG. 41 shows the use of a head timing which is divided into 32 different time slots, or "firing orders" each separated by 6.25 microseconds. This produces a repeated cycle of 200 microseconds before the same nozzle as fired again.

Movement of the print medium (e.g. paper 220 in FIG. 18) in the 6.25 microseconds between nozzle firings is equivalent to head placement. The nozzles 110 can readily be skewed to cancel any dot skew caused by paper movement, however this skew will be very small.

Figure 42:
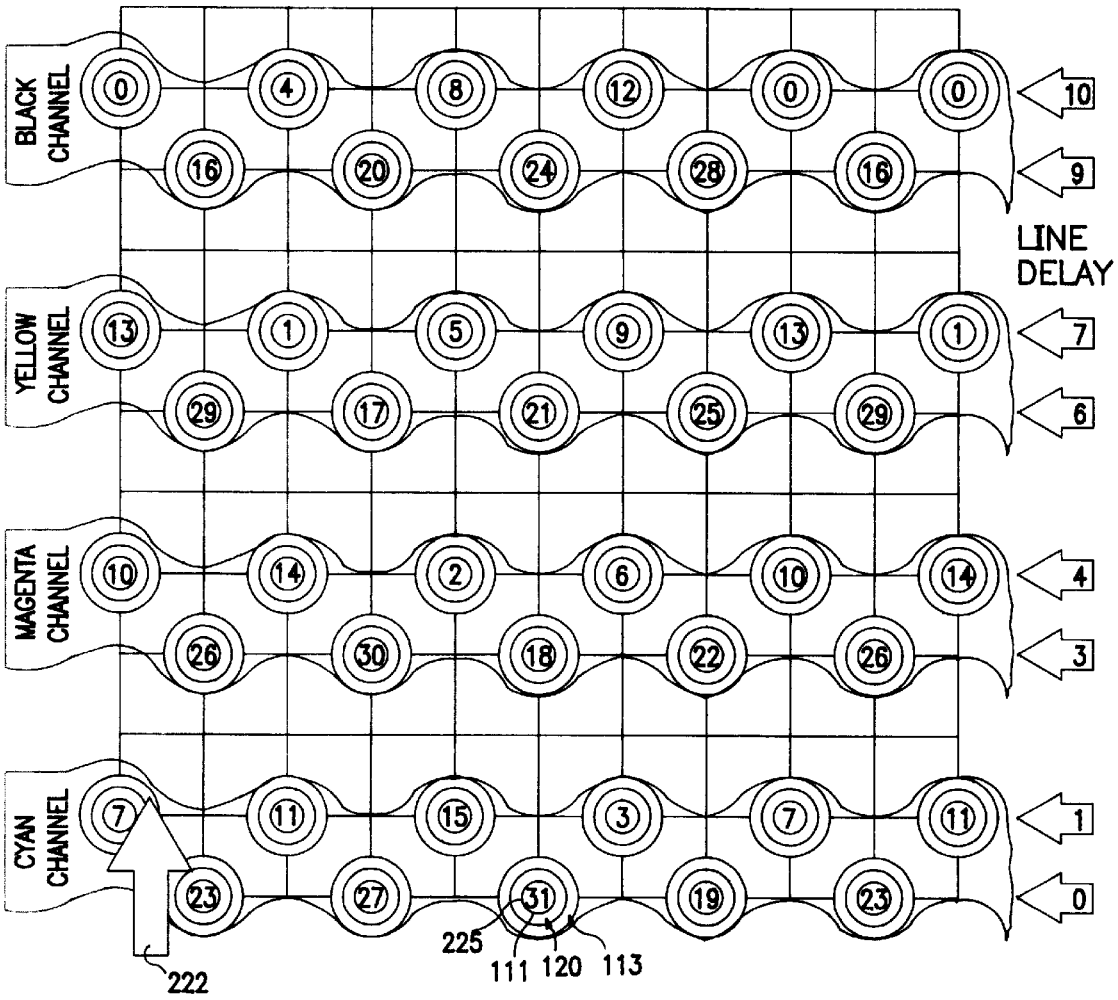
FIG. 42 shows nozzle firing patterns for a one nozzle per pixel colour print head.

Referring now to FIG. 42, this shows a possible nozzle layout for a full colour ZBJ head with one nozzle per pixel and 16 drops per pixel. Horizontal spacing of the nozzles 110 is 1 pixel (64 microns). The nozzles 110 are placed in a zig-zag pattern to maintain spacing of at least 80 microns between nozzle barrels 113, in order to maintain the mechanical strength of the head. Such a head design can be produced with three micron lithography.

To compensate for the physical displacement of the nozzles 110 from a straight line, line delays must be introduced into the driving circuit. The number of lines delayed is indicated on the right hand side of FIG. 42. The firing order 225 is indicated in the centre of each nozzle 110 and paper movement by the arrow 222.

Figure 43:
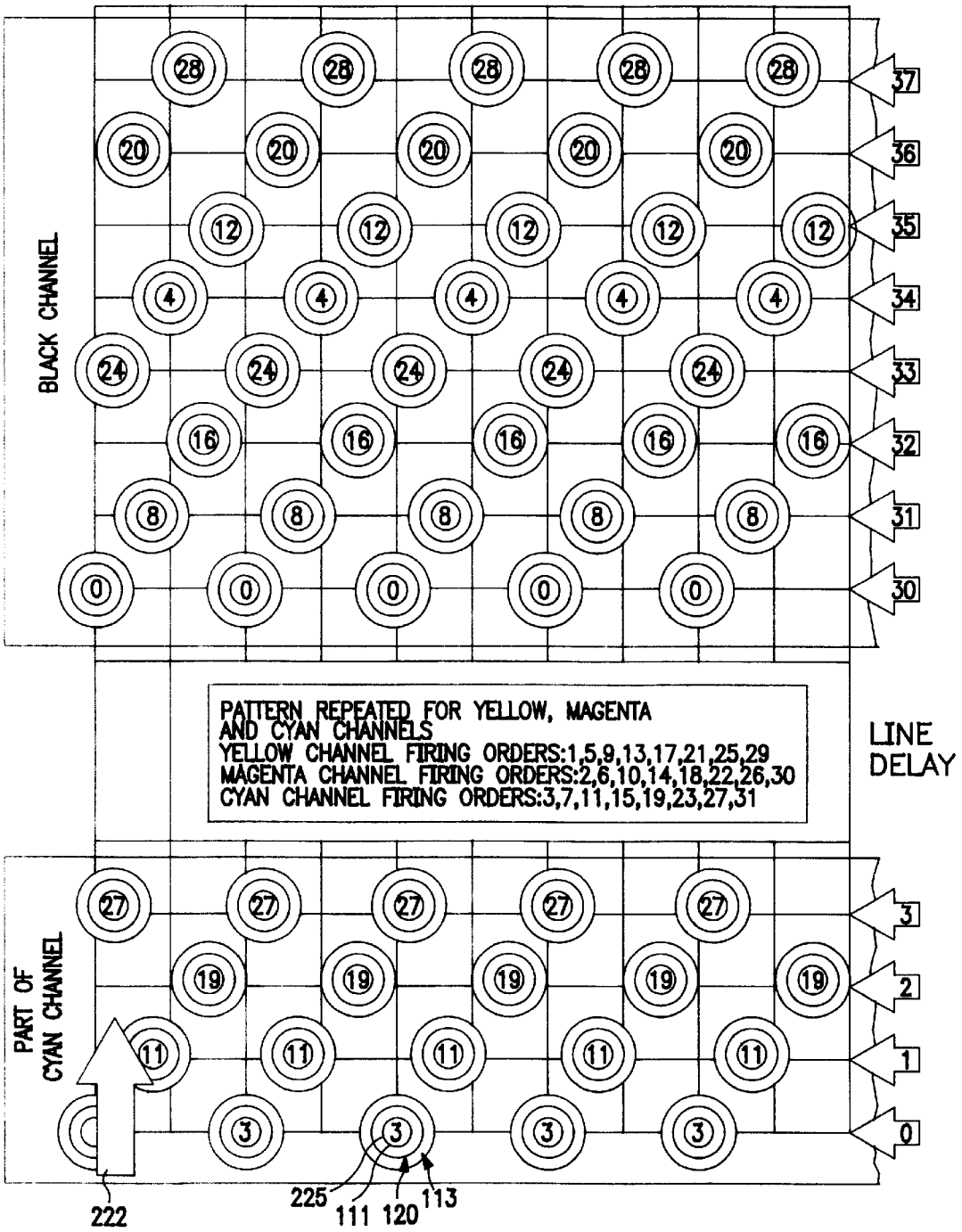
FIG. 43 shows nozzle firing patterns for a four nozzles per pixel colour print head.

FIG. 43 shows a nozzle layout for the full colour ZBJ head 200 with four nozzles 110 per pixel, each firing four times per pixel to give 16 drops per pixel. Horizontal spacing of the nozzles 110 is 16 microns (a quarter of a pixel). The nozzles 110 are arranged in 8 rows in zig-zag pattern to maintain at least 80 microns spacing therebetween. The nozzles 110 of the adjacent rows are also positioned (offset to one another) to compensate for any skew caused by paper movement, indicated by the arrow 222. This head design requires 2 micron lithography for nozzle interconnects and drive circuitry.

It should be noted that although the detailed description of this specification concentrates on the four nozzle per pixel configuration, as this is the most difficult, a one nozzle per pixel configuration can be readily derived.

ZBJ Head Assembly:

The head assembly 200 must deal with several specific requirements: ink supply; ink filtration; power supply; power dissipation; signal connection; and mechanical support.

The ZBJ head 200 with 51,200 nozzles, each of which can eject a 3 pl ink drop every 200 microseconds, can use a maximum of 1.28 ml of ink per second. This occurs when the head 200 is printing a solid four-colour black. As there are four colours, the maximum flow is 0.23 ml per colour per second. If the ink speed is to be limited to around 20 mm per second, then the ink channels 211–214 must have a cross-sectional area of 16 $mm^2$ each.

Any particles carried in the ink that are less than 60 microns in diameter will be carried into the nozzle channel 114. Any of these particles which are greater than 20 microns in diameter cannot be ejected from the nozzle 110. Even if pre-filtered ink is supplied to the user, there is a possibility of particle contamination when the ink is re-filled. Therefore, the ink must be effectively filtered to eliminate any particles between 20 and 60 microns.

With regard to power supply, the peak current consumption of the full width colour ZBJ head 200 is about several amperes. This must be supplied to the entire length of the chip 100 with insignificant voltage drop. Also, the ZBJ head has more than 35 signal connections, the exact number depending upon the chosen circuit design, and accordingly insignificant voltage drop is also required.

Mechanical support to the ZBJ chip 100 can be provided by the ink channel extrusion 210 in the manner shown in FIG. 37. The ink channel 210 extrusion has three functions: to provided the ink paths and keep the four colours separate; to provide mechanical support for the ZBJ chip 110; and to assist in dissipating the waste heat to the ink 106.

It is for these reasons it is preferable that the ink channels extrusion 210 be extruded from aluminium, and anodised to provide electrical insulation from the busbars 201 and 202. Manufacturing accuracy of the extrusion 210 need only be maintained to approximately ≦50 microns, as the extrusion 210 is not in contact with the nozzles 110. The edges of the channel extrusion 210 should be sealed against the ZBJ chip 100 to prevent air from entering the head assembly 200. This can be achieved with the same epoxy as that used to glue the assembly 200.

FIG. 44 illustrates an exploded perspective view of a preferred construction of a high speed full colour ZBJ assembly 200. The filter 205 is preferably a 10 micron (or finer) absolute filter such as a filterite "Duofine" (Trade Mark) bonded fiberglass filter. The surface area of this filter through which the ink must flow is 528 $mm^2$. With an ink flow rate of 1.28 ml per second, the ink must pass through the filter at a velocity of 2.4 mm per second. If the filter 205 is compressible, it can also form a gasket to prevent pigment flow between the four colours. In this case, the ZBJ chip 100 can be glued to the extrusion 210 under pressure. Alternatively, a silicone rubber seal can be used. In this case, care must be taken not to contaminate the ink channels 211–214.

One way of supplying the necessary power to the chip 110 is by power connections which run the full length of the chip 110. These can be connected using tape automated bonding (TAB) to the busbars 201 and 202 which form part of the head assembly 200. The signal connections to the ZBJ chip 100 can be formed using the same TAB tapes as are used to supply power to the ZBJ chip 100. Furthermore, as in FIG. 4, the busbars 201,202 can be configured as heat sink elements surrounding the extrusion 210.

Figure 46:
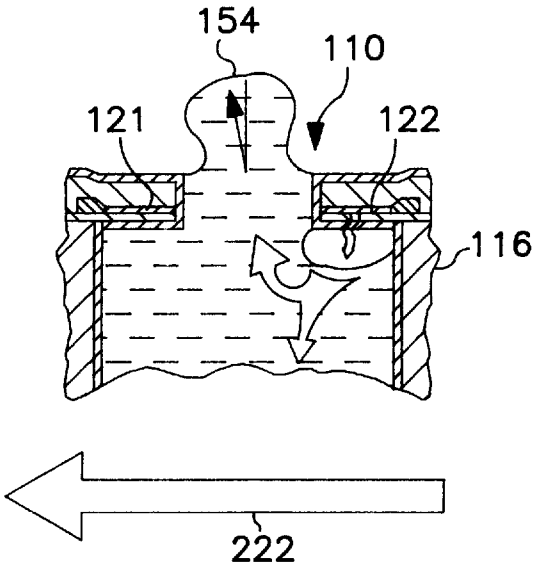
FIGS. 45 and 46 illustrate the deflection angle imparted on the ink drop due to the main and redundant heaters respectively.
Figure 45:
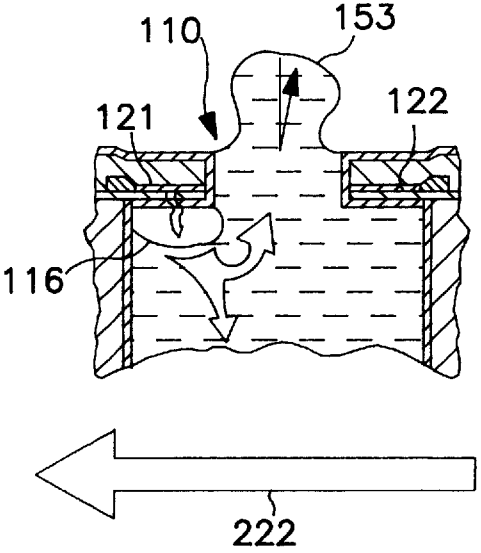

Ink Drops:

With a fault tolerant design requiring the formation of two separate heater elements 121,122, the ink drop 108 does not necessarily exit perpendicular to the ZBJ head surface. The ink drop 108 can be deflected by the shock waves of the expanding bubble at different angles depending on whether the main 121 or redundant 122 heater was fired. Such a configuration is illustrated in FIGS. 45 and 46 respectively which should be viewed in conjunction with FIGS. 10 and 12.

The angle and degree of the deflection 153 and 154 will depend upon the exact geometry of the ZBJ nozzle 110, and the mode of propagation of the bubble's 116 shock wave through the ink 106. The exit angle of the drop 108 is not important in itself. However, any difference between the exit angle of the drop fired by the main heater 121 and one fired by the redundant heater 122 will degrade the image quality slightly. The above can be reduced in two ways:

Firstly by positioning the head 200 closer to the paper 220 to reduce the distance between the two spots on the paper 220, and secondly by delaying the time of the redundant nozzle firing so that the paper movement cancels the deflection angle 153 or 154. This requires that the main and redundant heaters be aligned in the direction of paper movement 222.

Power Supply:

The A4 full width continuous tone ZBJ head 200 has a high current consumption of several amperes when operating. The distribution of this current to and across the chip 100 is not possible using standard integrated circuit construction. However, the geometry of the ZBJ chip 100 leads to a simple solution. The entire edge of the chip 100 can be used to supply power, with connections being made to a wide aluminium trace along both of the long edges of the chip 100. Power can be supplied by the busbars 201 and 202 along both sides of the chip 100 connected to the chip by tape automated bonding (TAB), compressible solder bumps, spring leaf connection to gold plated traces, a large number of wire bonds, or other connection technology.

Figure 47A:
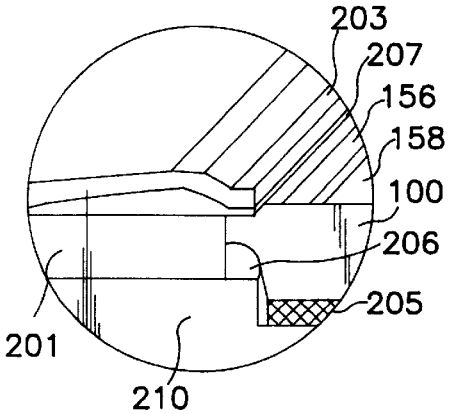
FIGS. 47A, 47B and 48 show two methods of connecting power to the ZBJ chip.
Figure 47B:
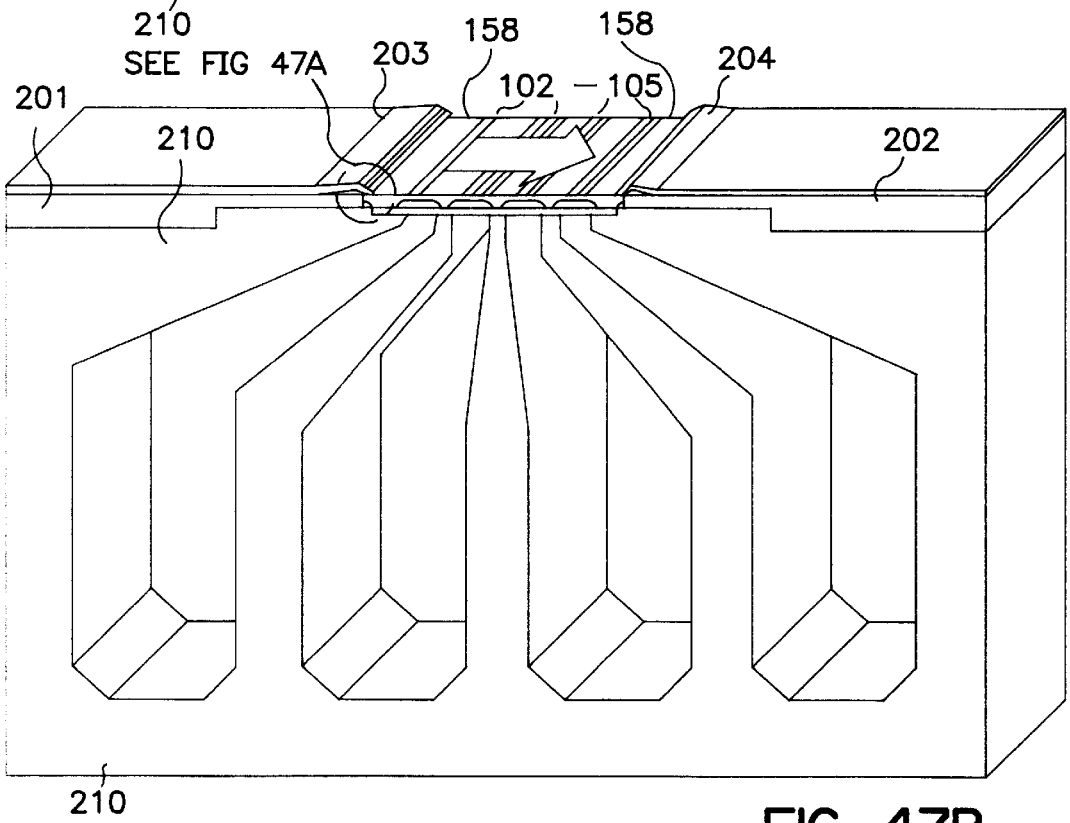
Figure 48:
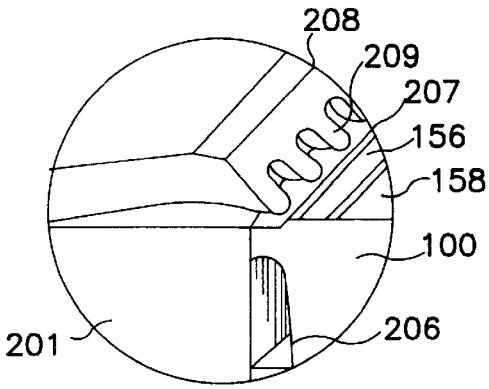

FIG. 47 illustrates one method of TAB connection along the length of the ZBJ chip 100 with the connections shown in magnified detail. FIG. 48 shows a magnification of an alternate arrangement using a knurled edge for multipoint contacts.

With reference to FIG. 47, the heatsink/busbar (51,52) (201,202) can readily be made larger, or of different shape, or of different materials without affecting the concept of the ZBJ head 200. Forced air, heat pipes or liquid cooling can also be used. It is also possible to reduce the current consumption by reducing the duty cycle of the nozzle 110. This will increase the print time, but reduce the average power consumption. The total energy required to print a page will not be affected.

Power Dissipation:

The full length full colour head can have a power dissipation of up to 500 watts when all nozzles are printing, depending on the nozzle efficiency. Before a final design of the ZBJ head can be derived, the following should be taken into account, as all these factors affect heat generation and dissipation.

(1) The number of nozzles: The number of nozzles 110 directly effects the power dissipation, but is also linked to print speed, image quality and continuous tone issues.

(2) Heater energy: The heater energy is typically 200 nJ per drop. Any reduction in heater energy allows the power dissipation to be reduced without affecting print speed.

(3) Supply Voltage: A low supply voltage is desirable, however, a reduction in voltage increases the current consumption and the size of on-chip driver transistors. Power dissipation will not be greatly affected by the supply voltage if the nozzle energy is maintained constant. In the preferred embodiment a supply voltage of +24 V is used for the heater drivers and +5 V for logic electronics.

(4) Nozzle Duty Cycle: Increases in the nozzle duty cycle directly increases the power consumption but also increases the print speed.

(5) Print Speed: Print speed is related to the number of nozzles 110, the number of drops per pixel, the pixel size and the nozzle duty cycle. A reduction in print speed can reduce power requirements, but typically will not affect the total energy per page.

(6) Permissible Chip Temperature: The chip temperature must be maintained well below the boiling point of the ink 106 (generally about 100° C.).

(7) Ink Channel Geometry: This will affect the amount of heat dissipation available through the ink 106.

(8) Cooling Method: Convection cooling is adequate for scanning heads, but full length heads require additional methods such as heat sinks, forced air cooling or heat pipes. Liquid cooling is a possible solution to the problem of high power density in the head strip. As liquid is already in contact with the head, a recirculating pumped ink system with a heat exchanger can be used if heat dissipation problems cannot be solved by easier methods.

(9) Ink Thermal Conductivity: The thermal conductivity of the ink 106 becomes relevant if the ink is to provide a significant power dissipation conduit.

(10) Ink Channel Thermal Conductivity: The thermal conductivity of the ink channel extrusion 210 is also relevant.

(11) Heat Sink Design: Heat sink size and design can be readily changed to provide optimum heat dissipation. The heat sink can be made quite large with little expense and little adverse effect at the system level. This is especially true of the full page versions as the ZBJ head 200 does not move (i.e. the paper moves relative to the head 200).

(12) High Temperatures: The operating temperature of the ZBJ heater elements 121,122 in excess of 300° C. It is important that the active elements (drive transistors and logic) Of the ZBJ chip 100 do not experience this temperature extreme. This can be achieved by locating the drive transistors as far from the heater elements 121,122 as possible. The active elements can be located at the edges of the chip 100, leaving only the heaters 120 and the aluminium connecting lines in the high temperature region. Also, obtaining an adequate heat transfer is a serious potential problem. The heater 120 should exceed 300° C. yet the overall chip temperature must be kept well below the boiling point (100° C.) of the ink 106. While heat transfer from the heat sink (51,52) to ambient should not be a problem, transferring heat from the chip 100 to the heat sink (51,52) efficiently is important.

Heater Drive Circuits

Figure 49:
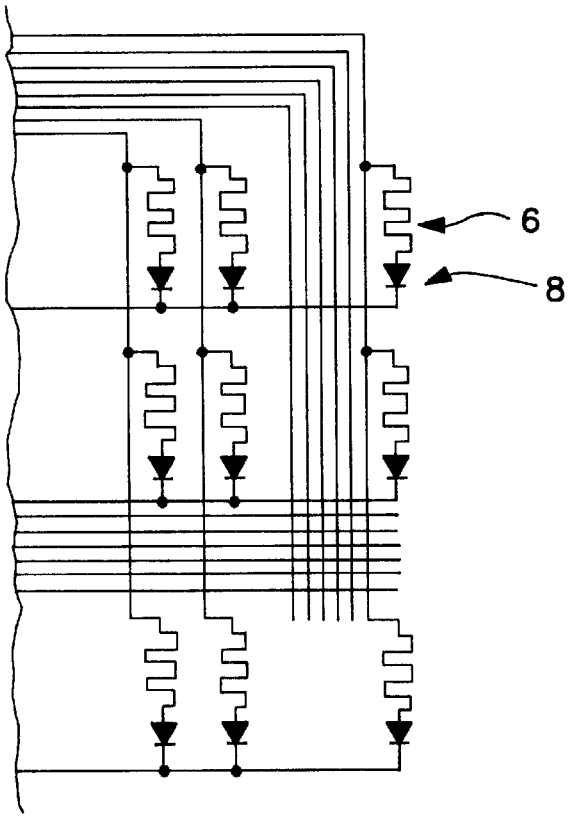
FIG. 49 PRIOR ART
FIG. 49 shows an arrangement of heaters in a prior art BJ head.

The scanning bubblejet head used in Canon's BJ10 printer has 64 nozzles energised by an array of heaters 6 which are shown in FIG. 49. These are multiplexed into an 8×8 array using diodes 8 integrated onto the chip. External drive transistors (not illustrated) are used to control the heaters 6 in eight groups of eight heaters 6.

The prior art approach has several disadvantages for large nozzle arrays. Firstly, all of the heater power must be supplied via the control signals and this can require a large number of relatively high current connections. Also, the number of external connections becomes very large.

The preferred embodiment of the ZBJ chip 100 includes drive transistors and shift registers on the chip 100 itself. This has the following advantages:

(1) Fault tolerance can be implemented at low cost, with no external circuitry;

(2) All heater power is supplied by two large connections, V+ and ground with control lines being at signal levels only;

(3) The number of external connections is small, irrespective of the number of nozzles 110;

(4) External circuitry is simplified;

(5) No external drive transistors are required; and (6) There is only one transistor in series with each of the heaters 121,122, instead of two transistors and a diode 8 as with the prior art. This allows a possible reduction in operating voltage.

However, disadvantages of this approach are:

The ZBJ chip 100 circuit is more complex; and

More semiconductor manufacturing process steps are required thus reducing the yield.

Figure 50:
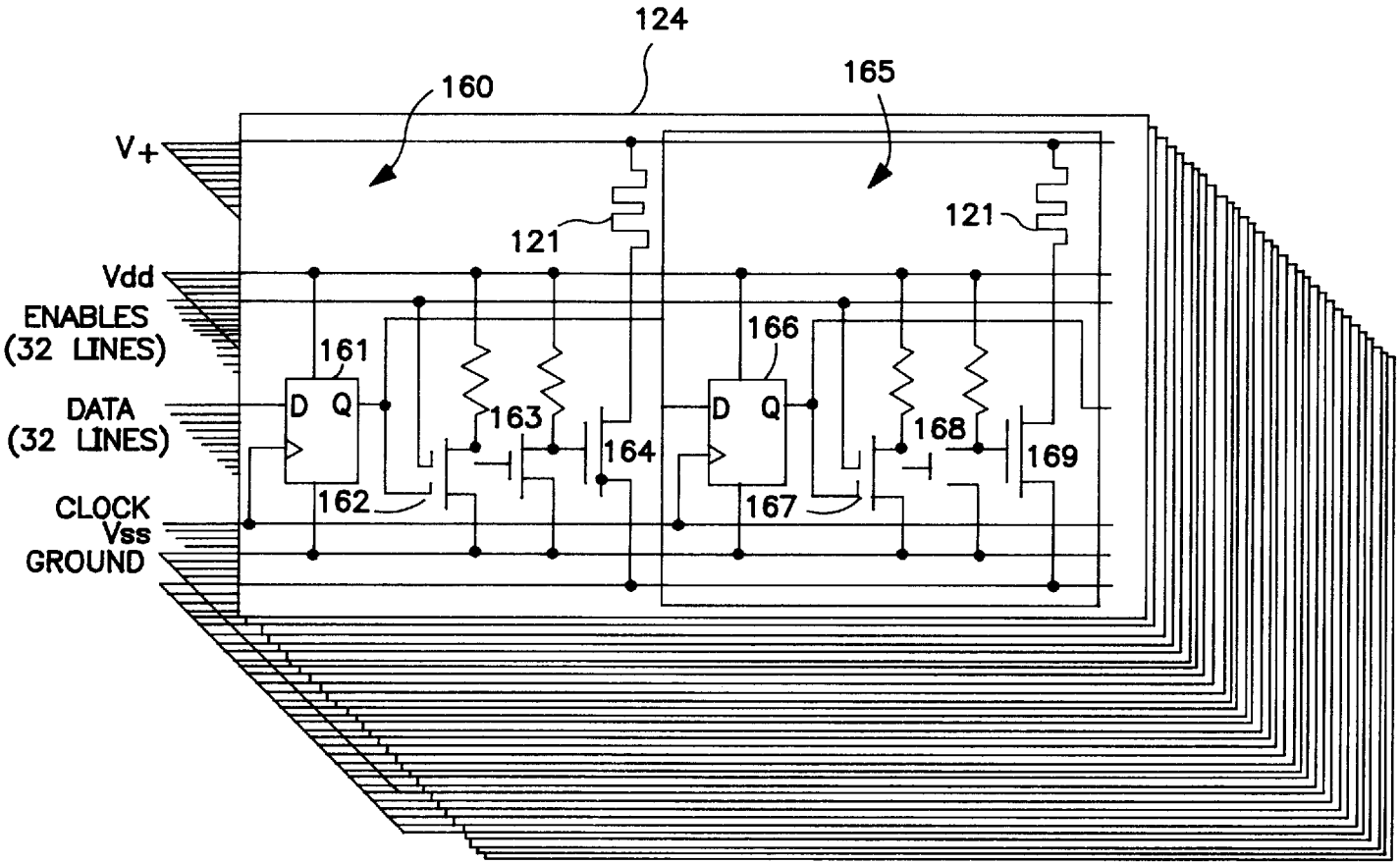
FIG. 50 shows the arrangement of heater drivers within the preferred embodiments.

FIG. 50 shows the logic and drive electronics of the ZBJ chip 100 with 32 parallel drive lines, corresponding to the 32:1 nozzle duty cycle. The enable signals provide the timing sequence, firing each of the 32 banks of nozzles 110 in turn. The enables can be generated on-chip from a clock and reset signal.

In FIG. 50, the Vdd is +5 volts and Vss is tied to a clean ground point. V+ and ground have noise of up to several amperes, so may not be suitable for logic even though they are supplied to the chip 100 at a very low impedance.

Shown in FIG. 50 is a heater driver 124 for two nozzles 110. The drivers 124 consist of two individual drivers 160 and 165 for two nozzles (without fault tolerance) showing the data connections of the shift registers.

Each heater driver 160, 165 consists of four items:

(1) A shift register 161,166, to shift the data to the correct heater drive. The shift register 161,166 can be dynamic to reduce the transistor count;

(2) A low power dual gate enable transistor 162,167;

(3) A medium power inverting transistor 163,168. This inverts and buffers the signal from the enable transistor 162,167 and combines with the enable transistor 162, 167 to provide an AND gate; and (4) A 1.5 milliamp drive transistor 164,169. The AND function is not incorporated into the drive transistor 164,169 as the capacitance on the enable lines to too large.

For a ZBJ head with 1,024 (32×32) nozzles, the clock period is the same as the pulse width, because 32 bits of data must be shifted in each shift register between nozzle firings, and there is a 32:1 duty cycle. The circuit of FIG. 50 is only suitable for a ZBJ head with less than 1,024 nozzles. However, where there is only a small number of nozzles an active circuit provides little advantage, and a diode matrix can be used.

For larger heads, with more than 1,024 nozzles, the clock required to shift all of the data to the appropriate nozzles requires a period shorter than the heater pulse. For the full width high speed full colour ZBJ head 200 of FIG. 5, 51,200 bits of information must be shifted into the head in 200 microseconds. This requires a clock rate of about 8 MHz. The data at the shift registers 161,166 therefore only need be valid for 125 nS but is required for the full duration of the 6.25 microsecond heater pulse. Disclosed herein are two solutions to this problem, one being a transfer register and the other being clock pauses.

Figure 51:
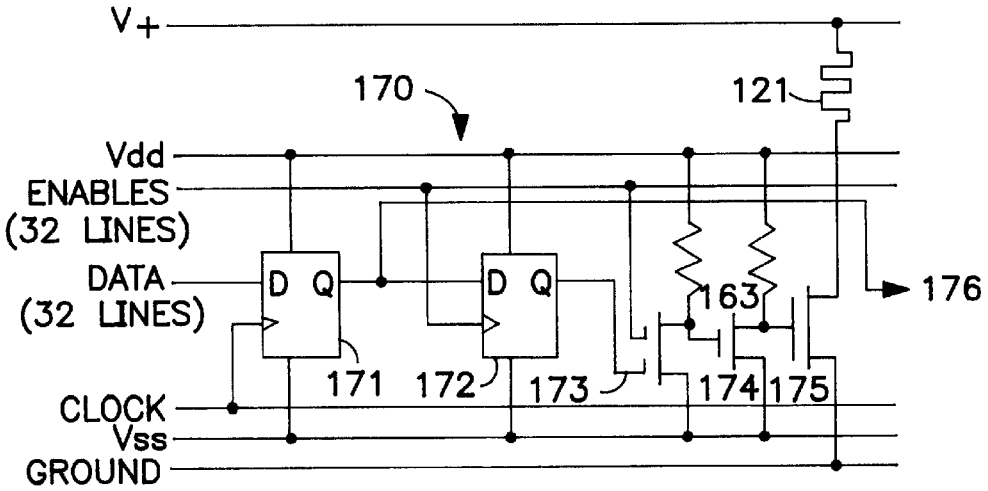
FIG. 51 shows a heater driver including a transfer element.

FIG. 51 illustrates the addition of a transfer register 172 to a main heater drive 170 having componentry otherwise corresponding to that of FIG. 50. This arrangement provides a simple solution to the above problem but has the disadvantage of increasing the amount of circuitry on the chip 100. 1,600 bits of data are shifted into each shift register 171 at 8 MHz. When the enable pulse occurs, the data is parallel loaded to the transfer register 172 where it is stable for the duration of the heater pulse.

Figure 52A:
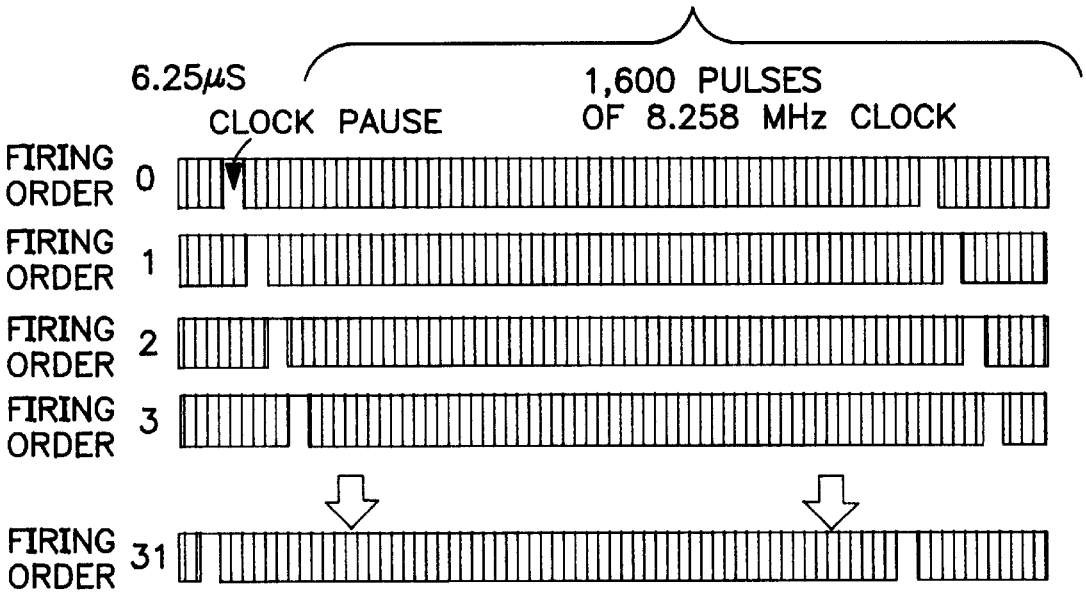
FIGS. 52A and 52B are timing diagrams of pulses used for driving the heaters.
Figure 52B:
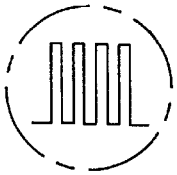

An alternative which avoids the extra transistors of the transfer register 172 is to introduce pauses into the clock stream for the duration of the heater pulse, so that the data does not change during the pulse. This is illustrated in FIG. 52 and in this case, the 1,600 bits of data re shifted into the register at a slightly higher rate—8.258 MHz—after which there is a pause in the clock for 6.25 microseconds, the period of heater pulse. Each of the 32 rows of heaters fire at different times. The clocks for each row can be simply generating by gating the constant 8.258 MHz clock with the heater enable pulses.

Figure 53:
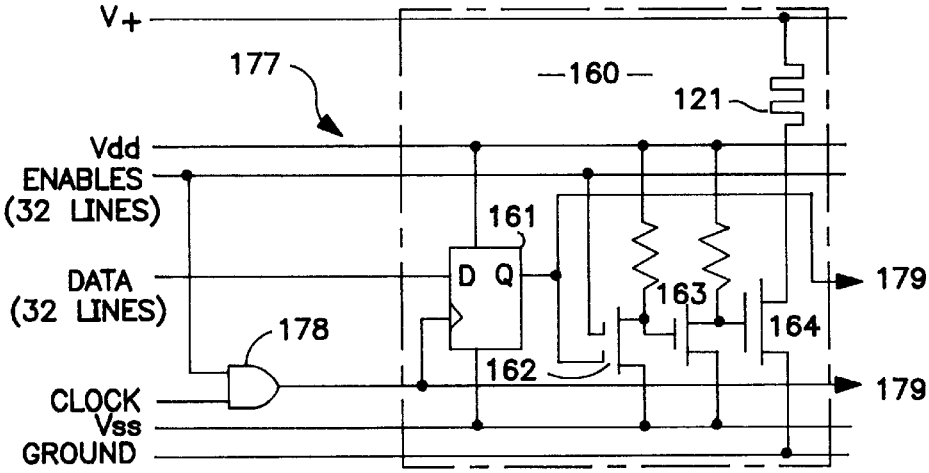
FIG. 53 shows the circuit arrangement of a heater driver using a single clock pulse.

FIG. 53 illustrates one stage of a ZBJ drive circuit 177 which incorporates clock pauses. An AND gate 178 connects between the clock and Enable lines and drives the CLK inputs of the shift registers 161 (and 166 not illustrated but connected at 179).

This approach has the disadvantage of requiring relative complex data timing on the chip 100. However, this can be supplied at low cost by the custom designing of ZBJ data phasing chips 310 such as those shown in FIG. 56 (to be later described).

Long Clock Lines:

For the full length colour ZBJ head 200 having 51,200 nozzles, with full redundancy, there are 102,400 shift register stages distributed over a length of 220 mm. These are structured as 64 shift registers each with 1,600 stages. Transmission line effects and the large fanout necessary preclude the clock from being driven by a single line. Fortunately, the clock can be regenerated at short intervals. If the clock is regenerated 32 times, each clock segment will have a fanout of 50, and will be only 6.8 mm long.

Figure 54:
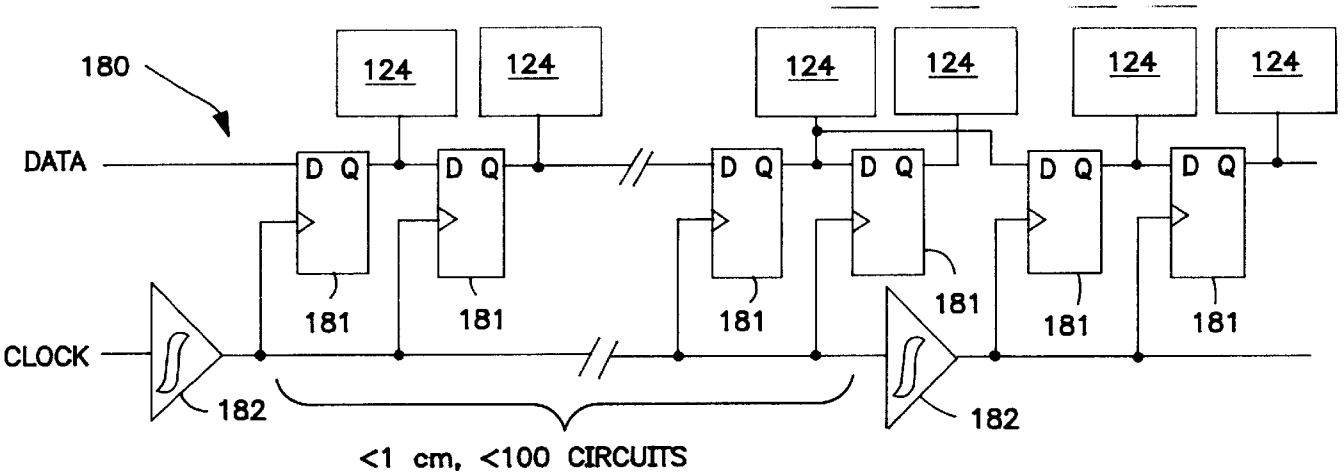
FIG. 54 shows the circuit arrangement of a clock regeneration scheme.

In FIG. 54, a simple clock regeneration scheme 180 is shown including a chain of shift registers 181 each supplying a corresponding heater driver 124. Included in the clock line are Schmitt triggers 182 equally spaced depending on the permissible fanout. As seen, where a Schmitt trigger 182 occurs in the chain, the next corresponding shift register 181 is input not from the shift register 181 immediately preceding it in the chain, but from the one before that. This compensates for the delay imposed by the Schmitt Trigger 182.

Clock regeneration is degraded by the introduction of a propagation delay ($T_{PD}$) at every regeneration stage. If the propagation delay of each regenerator is substantially less than the clock period, the ZBJ circuit will still function. This is because the data of each stage of shift register 181 will also be delayed by $T_{PD}$ every time a regenerated clock is encountered. Therefore, the valid data window will not change. With an 8 MHz clock, $T_{PD}$ must be less than 125 nS and greater than the propagation delay of the shift registor. This can be readily achieved.

Figure 55:
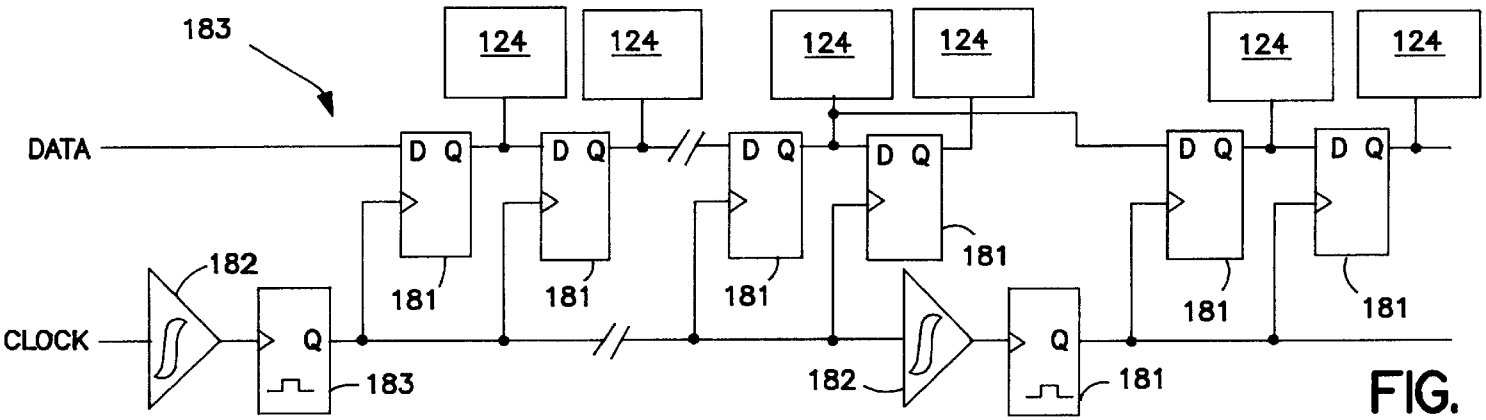
FIG. 55 shows a circuit arrangement for regenerating pulse widths within the clock line.

Any digital circuit will have a difference between rise and fall times ($T_{PLH}$–$T_{PHL}$). In a 2 micron NMOS ZBJ circuit, these times will be quite large, due to the high capacity load and passive pull-up on the clock regenerator outputs. A $T_{PLH}$–$T_{PHL}$ value of 5 nS is a reasonable assumption. Under these conditions, the clock pulse will disappear after only thirteen stages of regeneration. A solution is to regenerate the pulse width with a monostable at every stage, as shown in FIG. 55, which essentially corresponds to FIG. 54 save for the insertion of a monostable 183 after each Schmitt trigger 182 in the clock line.

The actual pulse width generated by the monostables 183 is not critical. It must be longer than the minimum pulse width required by the shift registers 181 (about 10 nS), and shorter than the clock period (125 nS). This tolerance is important to allow for the inaccuracy of component values in monolithic circuits.

External Driver Circuit

The full colour ZBJ head 200 requires a data rate of 32 MBytes per second (8 MHz average clock rate×32 bits). This data must be delayed by up to 7,600 microseconds, and requires nearly 1 megabit of delay storage. If the clock pause system described earlier (FIG. 53) is used to reduce the logic on the ZBJ chip 100, then data must also be presented to the ZBJ chip 100 with a complex timing scheme.

Figure 56:
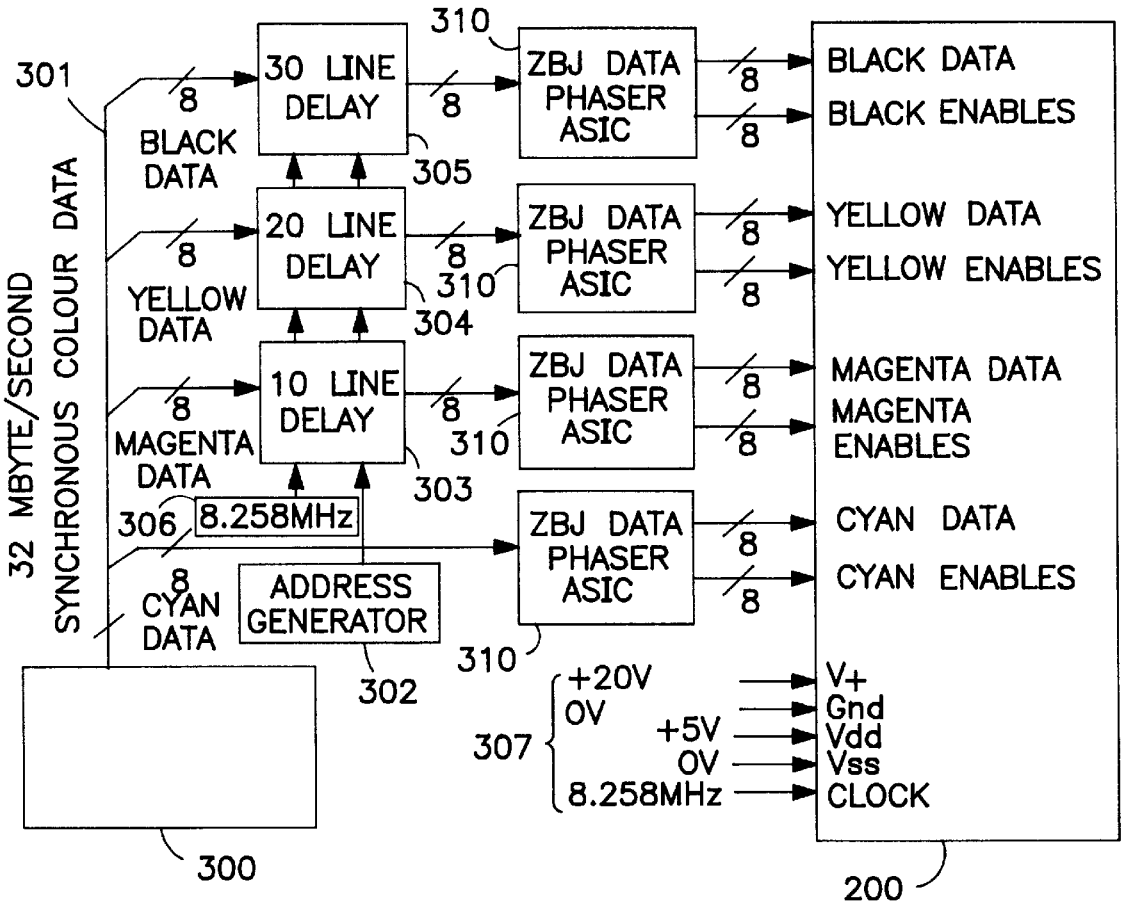
FIG. 56 is a schematic block diagram of the data driving circuit configuration used for the ZBJ head.

FIG. 56 is a block diagram of an overall data driving scheme for the full colour ZBJ head 200 in which an image data generator 300, such as a computer, copier or other image processing system, outputs colour pixel image data on a 32 bit bus 301. The colour pixel image data is normally supplied in raster format (cyan, magenta, yellow and black (CMYK)) with components for each colour being provided simultaneously on the bus 301. Because it is not possible for the nozzles for each colour to sit one on top of the other for simultaneous printing, the different colour data must be appropriately delayed prior to being supplied to the head 200. The colour data produced by the computer 300 on the bus 301 is digital data at 1600 dpi with pre-calculated screen or dithering simulating 400 dpi continuous tone colour image.

The bus 301 is divided into blocks of its component colours (cyan, magenta, yellow and black) each of which is respectively input to the ZBJ head 200. The magenta, yellow and black data are delayed by respective line 303, 304 and 305 because these colours are printed sequentially after cyan for each pixel across the head 200. An address generator 302 is used to sequence colour data through the line delays 303–305. A clock 306 of 8,258 MHz is used to sequence all pixel data and is also supplied to the head 200, which also has a number of power connections 307 as illustrated.

The 10, 20 and 30 line delays are formed using three standard 64K×8 SRAMs with a read/modify/write cycle time of less than 120 nS. This is achieved by reading and then writing the SRAMS with the data, while incrementing the address modulo 16,000, 32,000 and 48,000 respectively. The address generator 302 is a simple modulo 16,000 counter, with the two most significant bits of the address of each SRAM generated separately.

Because of the staggered configuration of the nozzles 110 for each array, as seen in FIG. 43, the delays to each data line are different. Generally the provision of these delays requires a large number of standard chips. For this reason, a ZBJ data phaser ASIC 310 is provided to buffer each nozzle array input so as to reduce system complexity. A single ASIC can be constructed which can be used to provide delays for the 8 bits of any of the four colours.

Figure 57:
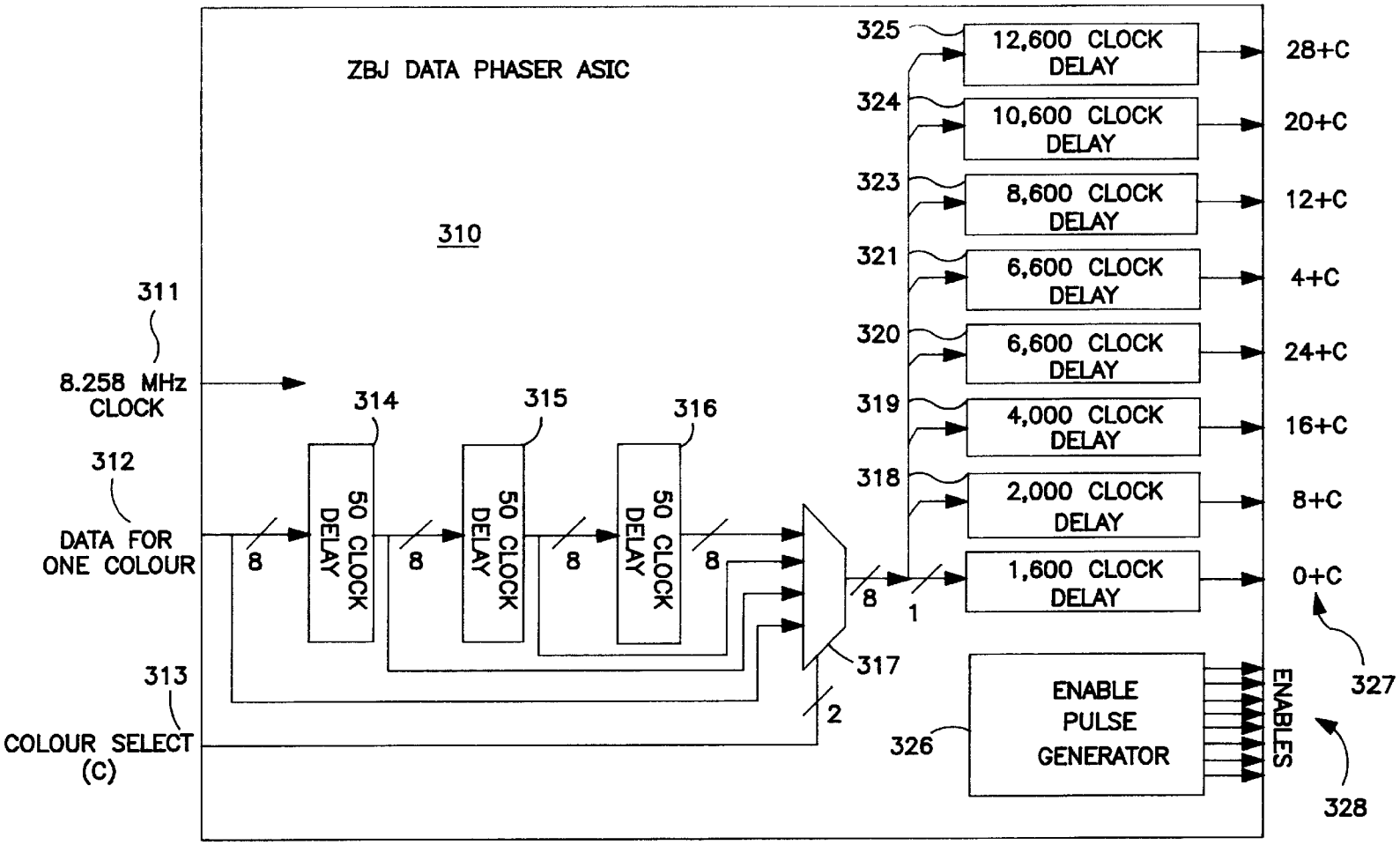
FIG. 57 is a block diagram representation of the data phaser ASIC of FIG. 56.

FIG. 57 illustrates a block diagram of a data phasor 310 suitable for the nozzle arrangement in the four nozzle per colour example earlier described. If other nozzle arrangements are used, the length of the delays must be altered to suit. The 50 clock delays 314,315,316 are selectable via a colour select input 313 and are included to allow the same chip 310 to be used for any of the four colour components. The colour select 313 operates a multiplexor which can select data output from any one of the delays 314–316 or directly from the data input 312.

The ASIC 310 of FIG. 57 has a very simple design, but requires around 56 Kbits of data storage. It is therefore most suited to standard cell or data-path compilation techniques.

The data connections 327 to the ZBJ head relate to the firing order, which determines the length of the delay required. Here, the firing order can be determined by adding the number specified to "c" representing colour (black=0, yellow=1, magneta=2, and cyan=3).

An enable pulse generator 326 provided enable pulses for the heater drivers 124 (previously described).

ZBJ Head Cost:

For full colour full length ZBJ heads to be applicable to large markets, such as colour photocopies and printers selling for less than about US$5,000, the manufacturing cost of the head should as low as possible. In general, a target assumed for each head is about US$100 or less in volume with a mature process.

The ZBJ head 200 is essentially a single piece construction and the head cost will consist almost entirely of the ZBJ chip 100 itself. The ZBJ chip 100 cost is determined by processing cost per wafer, number of heads per wafer, and yield. Assuming that the processing costs per wafer is about $800, and the number of heads per wafer is 25, the pre-yield cost per head is $32.

To achieve a head cost of $100, the mature-process yield must be about 30%. However, the chip area for the full colour full length ZBJ heads 200 is of the order of 8.8 $cm^2$. Those skilled in the art would initially believe that such a large size would imply a yield close to zero. However, there are several factors which make the expectant yield not as low as first impressions. These factors are:

(1) Most of the chip 100 consists of heaters, nozzle tips, and connecting lines, which should not be sensitive to point dislocations in the silicon wafer;

(2) The majority of the chip 100 has a three micron or greater feature size, and will be relatively insensitive to very small particles;

(3) The chips 100 are not subject to semiconductor processing steps in areas likely to be affected by wafer-etch rounding, resist-edge beading, or process shadowing (i.e. there are no active circuit elements near the nozzles).

The fault tolerance redundancy of the ZBJ head is preferably provided to improve the yield. This can allow a large number of defects to exist on the chip without affecting the operation of any of the nozzles. Furthermore, it is not necessary to incorporate 100% redundancy, but it is necessary to reduce the non-redundant region of the ZBJ head to a size consistent with an adequate yield. The effect of fault tolerance on yield is discussed later in this specification. Even with fault tolerance, there are several factors which can act to reduce yields below reasonable levels. Some of these factors are:

(1) Process variations whereby large area variations in process parameters such as etch depth and sheet resistance beyond acceptable limits will result in no yield from affected wafers. Generally, tolerances on these parameters are matched to the ZBJ head requirements during production engineering;

(2) Mechanical damages: if the mechanical strength of any ZBJ head design is adequate to withstand processing stresses, the ZBJ design can be altered to provide adequate strength. However, this alteration is normally at the expense of the chip area, and therefore yield;

(3) Wafer taper: the ZBJ chip 100 is unusually sensitive to wafer taper due to the back-etching of the nozzles 110. Wafers should be polished to reduce taper to less than 5 microns before processing;

(4) Slip: as the chips 100 extend the entire length of the wafer, major slip defects can reduce yield to zero. A special furnace design and processing can be provided to accommodate the long rectangular wafers;

(5) Etch depth: this must be consistent to within 5% over the entire wafer to ensure that the barrel plasma etch does not etch the heater. If this tolerance is unable to be achieved, the particular ZBJ design should be altered to be less sensitive to etch variations.

Fault Tolerance

As indicated earlier, fault tolerance is included in the ZBJ chip 100 so as to improve yield as well as to improve head life. The provision of fault tolerance is considered essential so as to achieve low manufacturing costs of the ZBJ chips 100. Furthermore, whilst the fault tolerance concept described herein is specifically applied to the ZBJ chip 100, the same concept can be used for other types of BJ heads if a configuration with two heaters per nozzle is created.

The disadvantage of fault tolerance is that chip complexity is doubled. However, due to the topography of the nozzles 110, there is only a slight (about 10%) increase in chip area. The yield decrease this causes is dwarfed by the yield increase provided by fault tolerance.

Figure 58A:
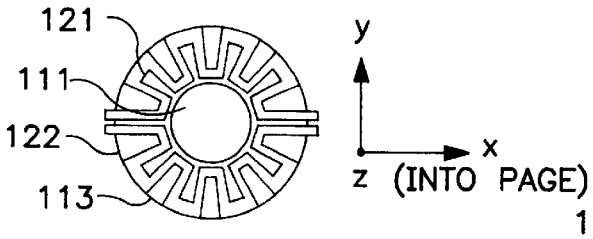
FIGS. 58A and 58B show two alternate configurations of the main and redundant heaters.
Figure 58B:
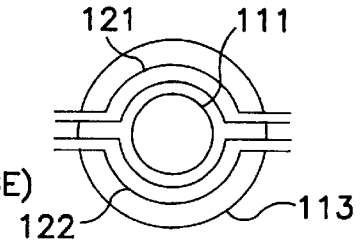

The ZBJ system described herein implements fault tolerance by providing two heater elements 121,122 for each nozzle 110. As the nozzles 110 are circular and on the surface of the chip 100, each heater 120 is provided with two heater elements 121,122 on opposite sides of the nozzle 110 and preferably having identical geometries. The heater elements are termed a main heater 121 and a redundant heater 122, as seen in FIGS. 58A and 58B, although the configuration of FIG. 13 can also be used. Accordingly, the ink drop fired from the nozzle tip 111 by either heater 121 or 122 is essentially the same.

Control of the redundant heater 122 for fault tolerance is provided by sensing the voltage at the drive transistor to the main heater 121 drive. This node makes a high-to-low transition every time the nozzle 110 is fired. Three faults are detected by the behaviour of this node:

1. Open heater: if the heater 121 is open circuit, the node will be stuck low;
2. Open drive transistor: if this occurs, the node will be stuck high; and
3. Shorted drive transistor: if the transistor is short, the heater will overheat, go open circuit and the node will be stuck low.

Figure 59:
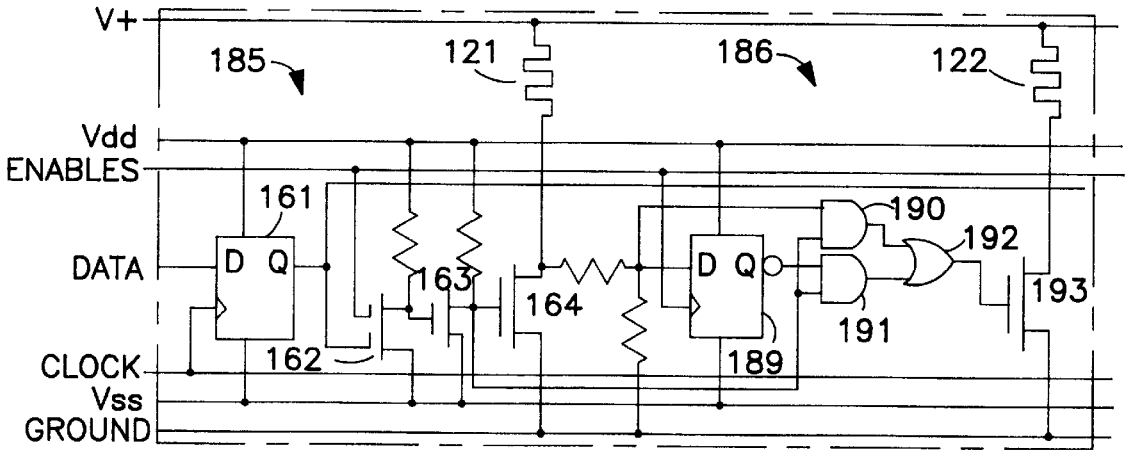
FIG. 59 shows one circuit stage of a ZBJ driver implementing digital fault tolerance.

FIG. 59 illustrates a drive circuit 185,186 for one nozzle of the ZBJ chip 100 with fault tolerance implemented as a digital circuit sampling at the drain of the main heater 121 driver transistor 164.

A latch 189 stores the fault condition detected by the node being low when the heater 121 drive is off. The latch 189 outputs to an AND gate 191 which is also supplied with the drive signal of the main heater 121 drive transistor 164, to indicate that the heater 121 should be on. Another AND gate 190 detects the open drive transistor condition. The two AND gates 190,191 are input to an OR gate 192 to control the redundant heater 122.

Figure 60:
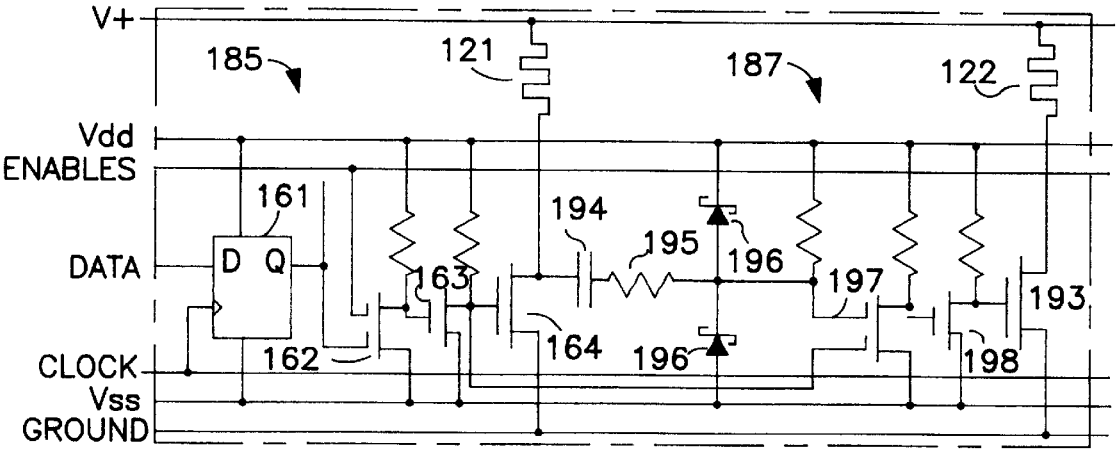
FIG. 60 is a schematic circuit diagram of a similar circuit using analog fault tolerance.

Because the pulse width and voltage of an operational circuit is stable to within narrow bounds, it is possible to replace the digital circuit of FIG. 59 with a simpler analog circuit, such as that indicated in FIG. 60. In this arrangement, a capacitor 194 and diodes 196 generate a pulse whenever the high-to-low transition of an operational circuit occurs. This pulse inhibits the firing of the redundant heater 122 when the main heater 121 circuit is operational. If the main heater 121 fails, then the redundant heater 122 will fire at the times that the main heater 121 would have fired.

Component values are chosen to ensure that the pulse is longer than the heater-on time (6 microseconds) but shorter than the pulse repetition time (200 microseconds). This permits substantial component tolerance.

The heaters 121 and 122, the drive transistors 164,193 and associated connections will consume more than 90% of the area of the ZBJ chip 110, so as a substantial degree of fault tolerance can be provided by providing redundancy in just these areas. However, protection is only provided against small area defects. Any defects with a diameter greater then approximately 10 microns will cause failure.

Fault tolerance can be readily extended to include 100% redundancy of the electronics of the ZBJ chip 100. At the same time, tolerance of some faults from defects of up to 600 microns in diameter can be introduced. This is achieved by duplicating the shift registers 181 described earlier, as well as the drive circuitry. As the shift registers 181 do not consume a substantial amount of chip area, the cost increase of this duplication is exceeded by cost decrease from yield improvement.

Figure 61:
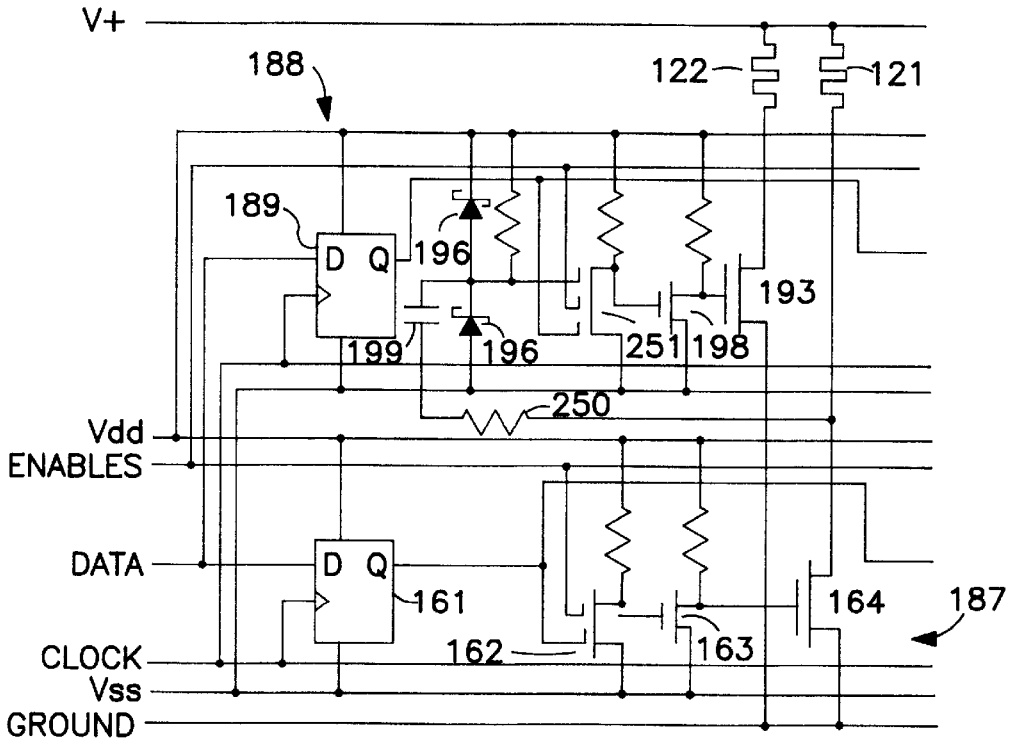
FIG. 61 is a one circuit stage of ZBJ driver using complete redundancy.

FIG. 61 shows one stage of a ZBJ drive circuit with complete redundancy in which the main drive circuit 187 is duplicated, but with the addition of a circuit (resistor 250 and capacitor 199) which inhibits the firing of the redundant circuit 188 when the main circuit 187 is operational.

Figure 62:
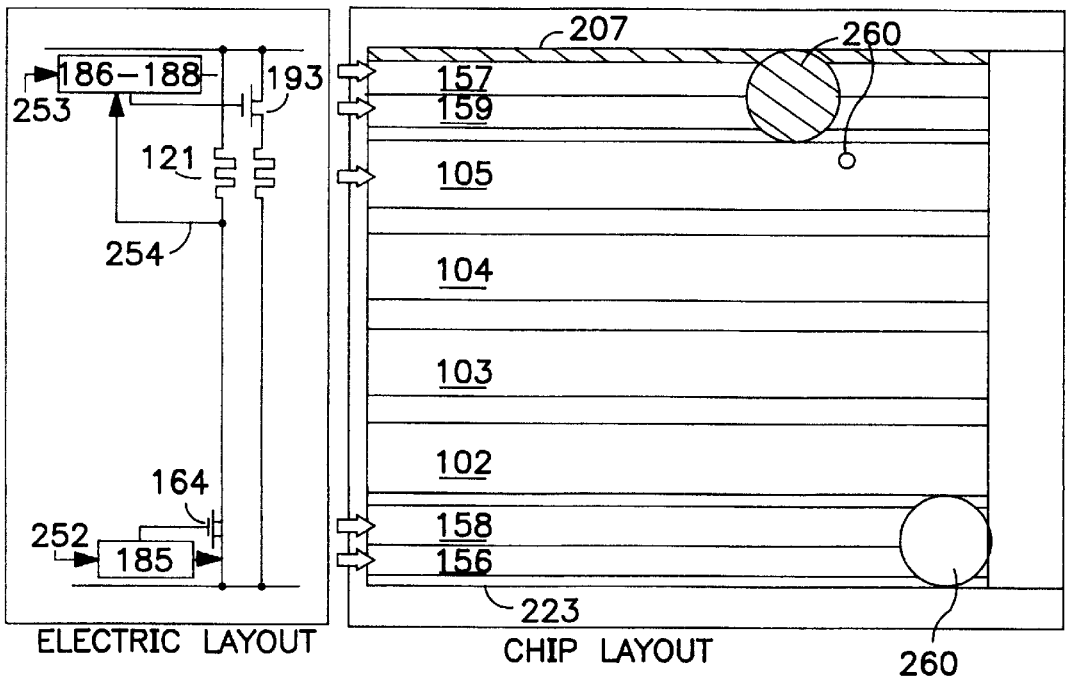
FIG. 62 illustrates both the electrical and physical layout of the drivers of the ZBJ chip.

FIG. 62 shows a simple chip layout of a small length of the ZBJ chip 100, to provide wide area fault tolerance. While large area faults in drive circuitry can be corrected, only small area faults can be corrected in the nozzle area. This is because the main and redundant heaters 121 and 122 must be in the same nozzle 110. However, the nozzle area has no active circuitry and will not be sensitive to faults in most mask layers.

A defect which happens to break the shift register chain of either the main circuit or of the redundant circuit, will mean that subsequent driver stages will not be fault tolerant. Also, a stuck-high fault in the data sequence of either the main or redundant shift register will result in chip failure, as will a Vss to Vdd short. However, these types of faults represent only a small percentage of possible faults.

Figure 63:
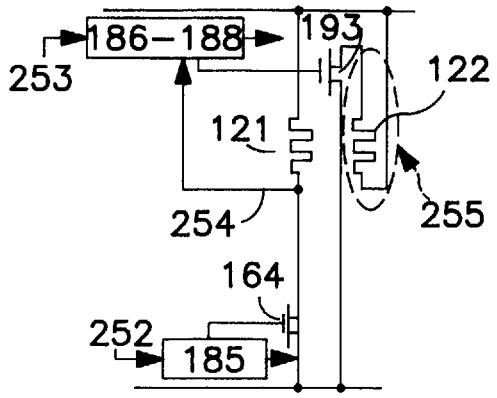
FIG. 63 shows a power wiring loop necessary for the arrangement of FIG. 58.
Figure 64:
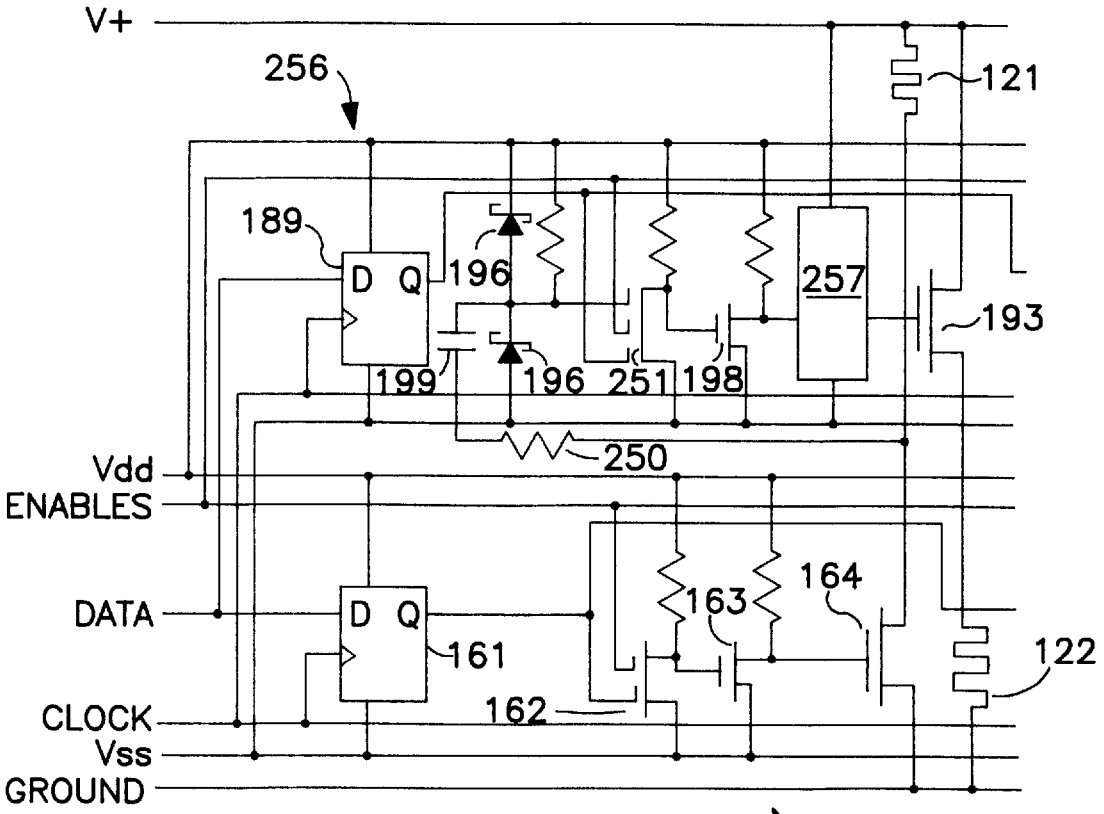
FIG. 64 illustrates one circuit stage of a ZBJ circuit designed for large area fault tolerance.

Placement of the main 156,158 and redundant 157,159 circuits on opposite edges of the chip 100 as seen in FIG. 62 introduces a problem when used in the circuit of FIG. 61. The problem is that the power wiring to the redundant drive transistor 193 must loop across the chip 100, in the manner as shown in FIG. 63. This loop can consume substantial chip area, as it doubles the total number of high current tracks across the chip. This can be corrected by reversing the series connection of the redundant heater 122 and redundant drive transistor 193. This requires the introduction of a level translator 257 to control the redundant drive transistor 193. This is illustrated in FIG. 64 which shows one stage of a ZBJ drive circuit designed for large-area fault tolerance.

Approximately 50% of the surface of the chip 100 is covered by aluminium connections between the drive transistors 164,193 and the heaters 121,122. As these interconnects use a fine line width, defects are highly probable. Table 2 lists possible fault conditions and their consequences, assuming that there is only one defect in the affected head circuit.

Each of the conditions indicated in Table 2 are fault tolerant, except where the two main drive tracks are shorted. This can be made fault tolerant by incorporating a fuse between each main drive transistor 164 and its heater 121. However, the fuse must be highly accurate and must "blow" at twice the heater current but not one times the heater current. A more elegant solution is to interleave the main drive tracks with the redundant drive tracks. This configuration increases the defect size required to short two main drive tracks by a factor of 3. Such an arrangement reduces the defect density for this source by a factor of 9.

Figure 65:
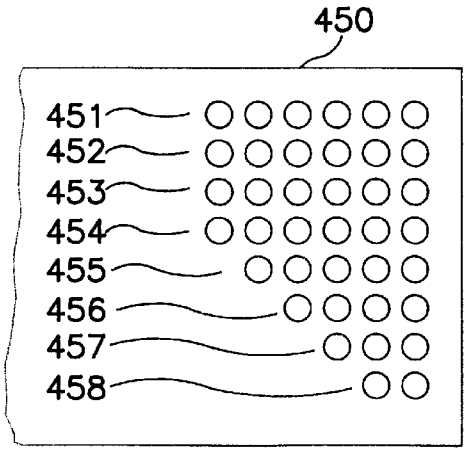
FIGS. 65, 66 and 67 show other fault tolerant configurations.
Figure 66:
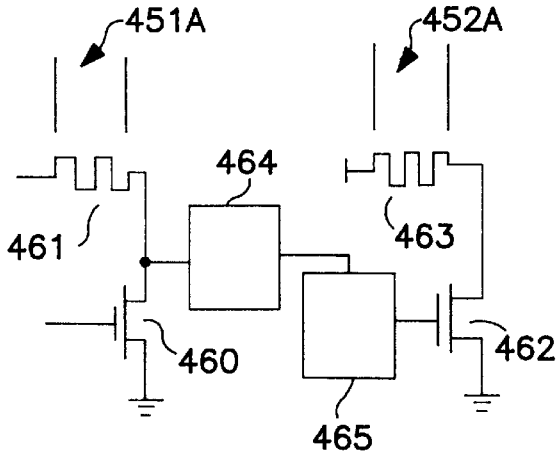

The foregoing arrangements to provide fault tolerance occur at a nozzle level through duplication of the heaters 120. However, this does not ensure correct operation if, say, a nozzle 110 becomes blocked. Where this occurs it is necessary to provide fault tolerance at a chip level through the duplication of nozzle arrays such as shown in FIG. 65.

Here a redundant nozzle ZBJ chip 450 is shown having a main cyan nozzle array 451, a redundant cyan nozzle array 452, and a similar configuration for each of magneta (453, 458), yellow (455,456) and black (457,458). In this configuration, should a nozzle in the main array fail, a corresponding nozzle in the redundant array fires. This is further depicted in FIG. 65 where a main cyan nozzle 451A is fired by a heater 461 energized through a switch 460 and a redundant cyan nozzle 452A is fired by a similar heater 463 and switch 462. Interconnecting the switches 461 and 462 is a fault detector 464 which senses a fault in the main cyan nozzle 451A and provides a firing pulse to the switch 462. Because of the physical displacement of the array 452 with respect to the array 451, it is necessary to compensate for time and/or motion of the relative movement of the paper across the chip 450. This is provided by a parallel loading shift register 465 which detects all of the faults occurring in one row of nozzles and shifts the data out as a serial data stream. This data is then delayed by an appropriate number of line delays and placed in a serial to parallel shift register, where it causes the actuation of the redundant heater 463 via the redundant switch 462.

Figure 67:
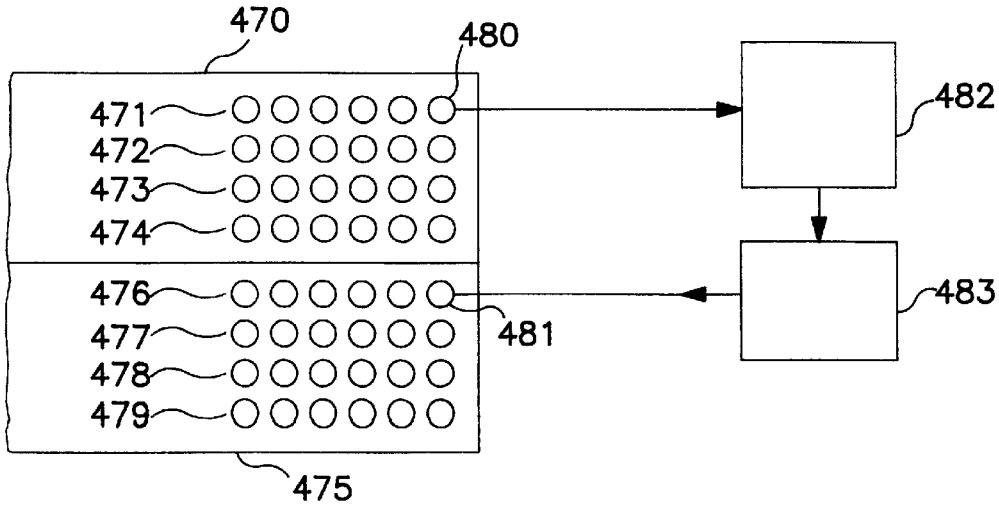

System level fault tolerance can be provided in the manner shown in FIG. 67 where two thermal ink jet chips 470 and 475 are arranged side-by-side. The chip 470 acts as a main device with the chip 475 acting as a redundant device thereby the arrays 471–474 being compensated by the arrays 476–479 in the manner described above. However, with this configuration each nozzle 480 must connect to it's corresponding nozzle 481 using a fault detector 482 and compensator 483 as before. This can be achieved by shifting the fault data off the main chip 470, delaying it, and using that data to fire the nozzles of the redundant chip 475.

Dicing and Handling

Because the ZBJ chip 100 is very long and thin, and has many holes etched through it, the mechanical strength of the chip 100 is insufficient to allow high yield dicing in the conventional manner.

Figure 68:
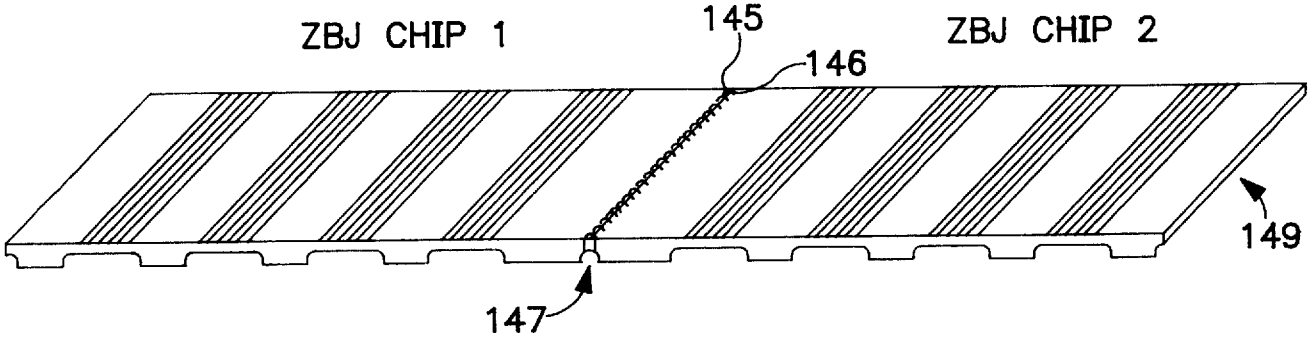
FIGS. 68, 69, 70A and 70B illustrate preferred configurations for the manufacture of multiple ZBJ heads on a single silicon wafer.

A simple solution using a diced back etch is illustrated in FIG. 68 where channels 147 are etched in the back surface of the wafer 149, most of the way through the wafer 149. The wafer 149 is then scored 145 on the front surface. The channels 147 can be etched using the same processes that are used to etch the ink channels 101 and nozzle vias 110. The spacing of vias 146 along the dice line 145 can be adjusted to give the optimum trade-off between strength for handling and ease of dicing. To prevent the ZBJ chips 100 from accidentally separating during the remaining processing steps, tags 148 (FIG. 46) can be left along the edges of the wafers 149. These tags 148 must be diced off before the ZBJ chips 100 are separated. If the tags 148 are, say, 5 mm wide, then the wafer length for 220 mm heads must be 230 mm. The wafers 149 can also be supported by these tags 148 during the various chemical processing steps to prevent processing "shadows" from affecting the regions of the ZBJ chip 100.

Lithography

The full width colour ZBJ chip 110 has dimensions of approximately 220 mm×4 mm, yet requires very fine line widths, such as 3 microns for the one nozzle per pixel design, and 2 microns for the four nozzle per pixel design. The maintain focus and resolution when imaging the resist patterns is difficult, but is within the limits of current technology.

Either full wafer projection printing or an optical stepper can be used. In both cases, the projection equipment requires modification to the stage to allow for 220 mm travel in the long axis.

In a 1:1 projection printing system, a scanning projection printer is modified to match the mask transport mechanism to permit very long masks. Defects caused by particles on the mask are projected at a 1:1 ratio and are in focus, so cleaner conditions are required to achieve the same defect level. A 1:1 projection printer also requires a mask of an image area of 220 mm×104 mm. This requires modification to the mask fabrication process. The manufacturing of 2 micron resolution masks of this size is viable for high volume production, but the masks are very expensive in small volumes. For these reasons, a stepper configuration should also be considered.

The use of 5:1 reduction stepper reduces some of the problems associated with a scanning projection printer, particularly those associated with the production of very large masks, and the particle contamination of the mask. However, some new problems are introduced. Firstly, a different imaging area of 10 mm×8 mm is used. Then the full size wafer can be imaged in 22×13 steps. This provides a total of 286 steps which generally takes about 250 seconds to print. As there are approximately 10 imaging steps required for the manufacture of the ZBJ chip 100, total exposure time per wafer can be about 2,500 seconds which substantially reduces the production rate of such devices. Also, the use of the wafer stepper introduces the following two problems which effect the ZBJ chip design:

1. The ZBJ chip 100 is longer than the step size on one axis; and

2. The mask cannot readily be changed during exposure of the wafer, therefore one mask must be used for the entire head.

The first of these problems can be countered by using a repeating design, and ensuring that alignment at the perimeters of that repeating block is not critical. As the wafer 149 is only diced in one direction, the repeating block does not have to be rectangular, but can avoid critical features such as nozzles. The left hand and right hand edges of the mask pattern can be quite irregular, provided they match each other.

Also, each signal line must terminate at the bonding pads 207, 233, which are typically arranged at the side edges of the chip 100. This normally requires that the side edges of the chip 100 be imaged with a different pattern than that of the centre of the ZBJ chip 100. This can be achieved by blading the mask to obscure the bonding pads and associated circuitry on all but the first exposure of the chip.

Figures 70A, 70B:
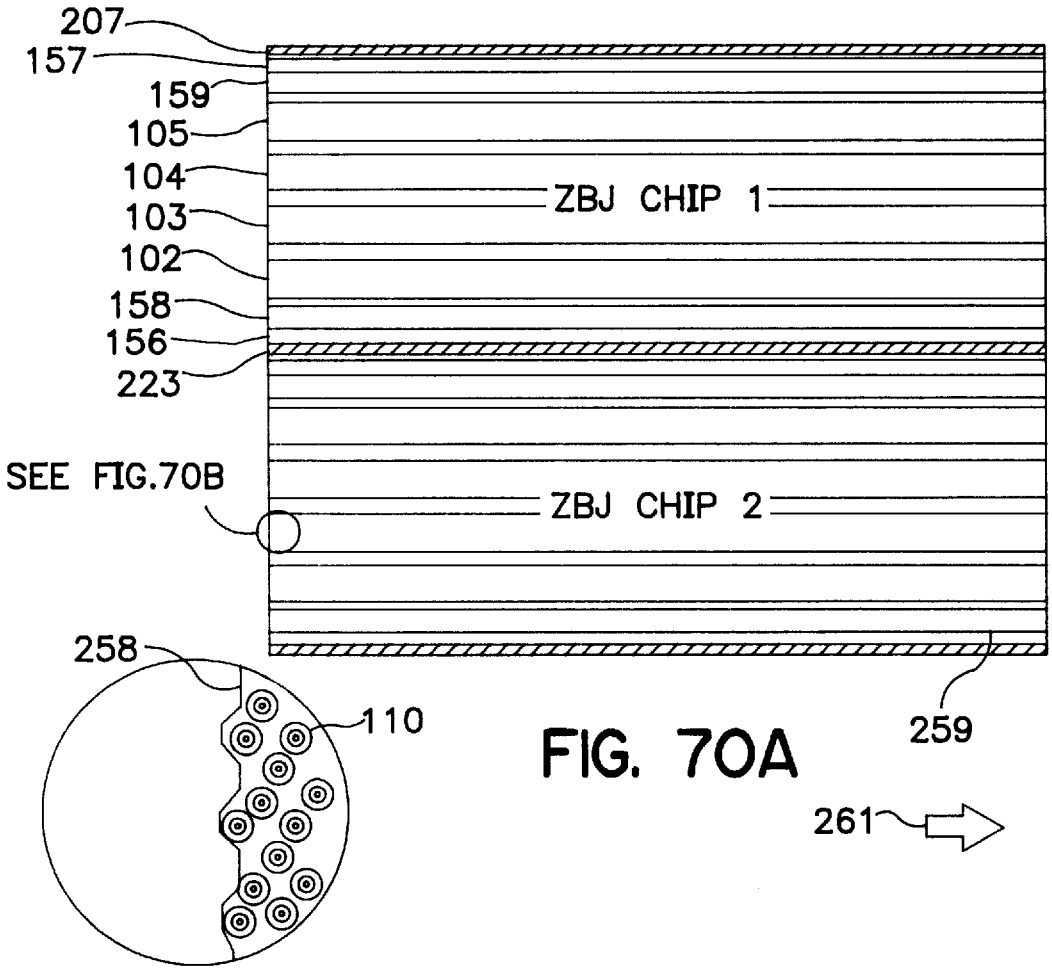

FIG. 70 shows a basic floor plan or chip layout of a stepper mask for a full width continuous tone colour ZBJ chip 100, including complete redundancy for full fault tolerance. The magnified portion of the drawing illustrates an irregular mask boundary 258.

ZBJ Production Process:

The ZBJ chips 100 can be processed in a manner very similar to standard semiconductor processing. There are however, some extra processing steps required. These are: accurate wafer thickness control, deposition of a $HfB_2$ heater element; etching of the nozzle tip; back etching of the ink channels; and back etching of the nozzle barrels.

A 2 micron NMOS process with two level metal is assumed as this is the basis of the four nozzle per pixel design. CMOS or bipolar processes can also be used.

Wafer preparation for scanning BJ heads is similar to that for standard semiconductor devices, except that the back surface must also be accurately ground and polished, and wafer thickness maintained at better than 5 microns. This is because both sides of the wafer are photolithographically processed, and etch depth from the reverse side is critical.

Full width fixed ZBJ chips require different wafer preparation than do those used in scanning heads, as the ZBJ chip must be at least 210 mm long in order to be able to print an A4 page, and at least 297 mm long for a A3 pages. This is much wider than the typical silicon crystalline cylinder. Wafers can be sliced longitudinally from the cylinder to accommodate the long chips required.

Figure 69:
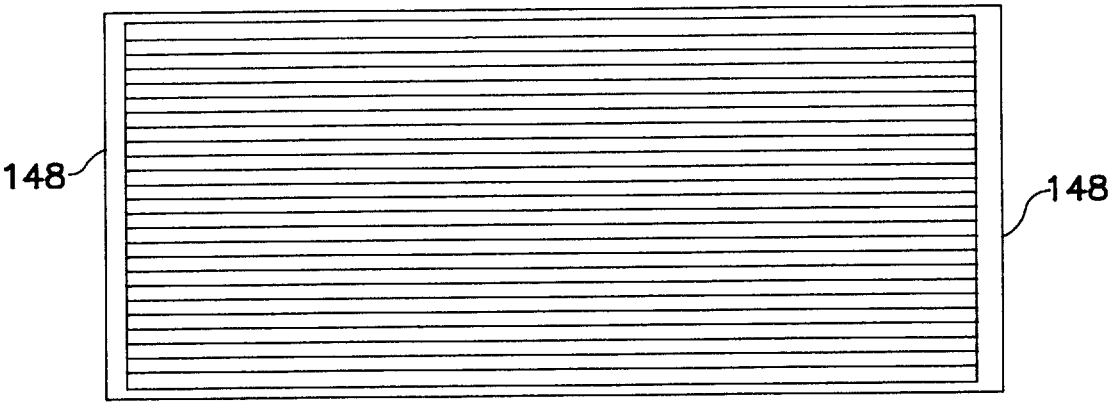

When the wafer has been ground and polished the resultant wafer should generally be about 600 microns thick. The resultant wafer is a rectangular shape approximately 230 mm×104 mm×600 microns thick. On this wafer, approximately 25 full colour heads can be processed. Such a wafer will appear similar to that of FIG. 69. A 230 mm long 6 inch cylinder can be used to produce up to 2,600 full width, full colour heads before yield losses.

Due to the one piece construction of the ZBJ print chip 100, and the use of a stepper for exposure, wafer flatness requirements are no more severe than those of the transistor fabrication processes. The wafer can be gettered using back-side phosphorous diffusion, but back-side damage can result and therefore is not recommended because the back-side is subsequently etched.

Wafer processing of the ZBJ chip 100 uses a combination of special processes required for heater deposition and nozzle formations, and standard processes used for drive electronics fabrication. As the size of the ZBJ chip 100 is largely determined by the nozzles 110 and not by the drive transistors 164,193, there is little size advantage in using a very fine process. The process disclosed here is based on a 2 micron self-aligned polysilicon gate NMOS process, but other processes such as CMOS or bipolar can be used. The process size disclosed here is the largest size compatible with the interconnect density required to the nozzles 113 of the high density four colour ZBJ head. This also requires two levels of metal. Two levels of metal can be required for simpler heads, as high current tracks run across the chip, and very long clock tracks run along the chip.

The wafer processing steps required for the formation of the ZBJ nozzles 110 are intermingled with the steps required for the drive transistors. As the process used for the drive transistors can be standard as known to those skilled in the art, there is no requirement to specify such steps in this specification.

The wafer processing of the ZBJ chip 100 is illustrated in FIGS. 71 to 80 which show the cross section for a single nozzle corresponding to the cross-sectional lines shown in FIG. 12. FIGS. 71 to 80 also illustrate the corresponding and simultaneous construction of transistors arranged outboard of the nozzle arrays.

Figure 71A:
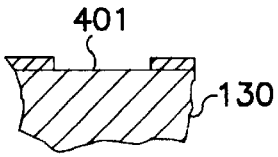
FIGS. 71A to 80B illustrate the various stages used in wafer processing of the ZBJ chip.
Figure 71B:
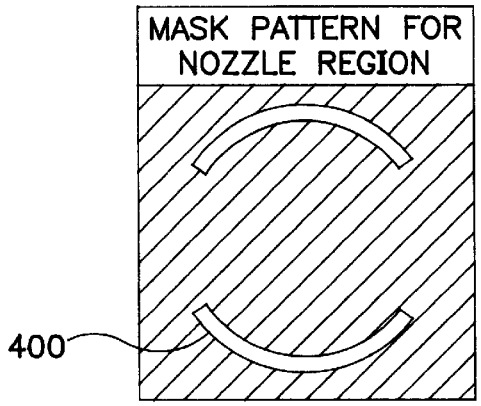
Figure 71C:
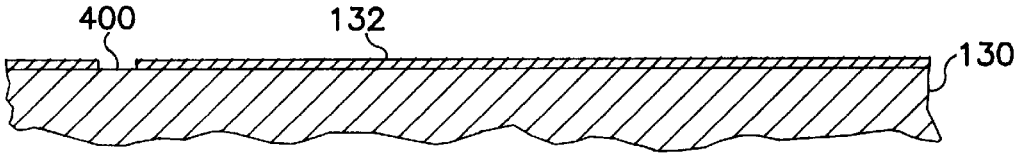

Firstly, with reference to FIG. 71, a 0.5 micron layer 132 of thermal $SiO_2$ is grown on the P-type doped substrate 130. This is patterned with the driver circuit requirements as well as with the thermal shunt vias 400.

Figure 72A:
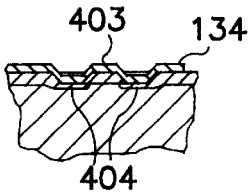
Figure 72B:
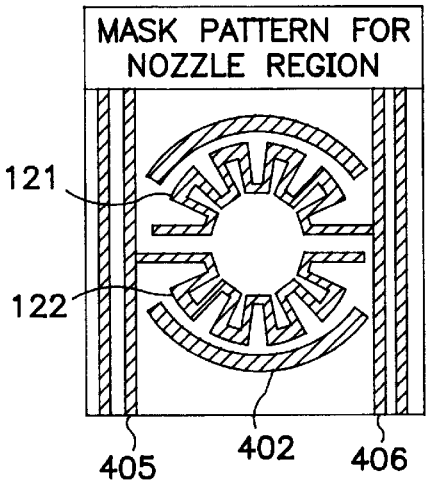
Figure 72C:
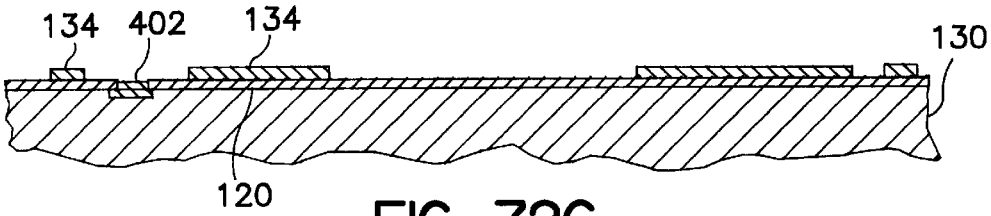
Figure 73A:
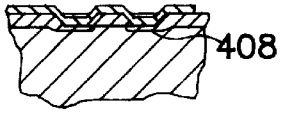
Figure 73B:
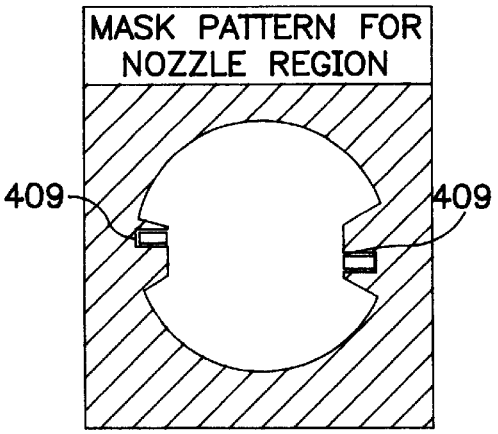
Figure 73C:
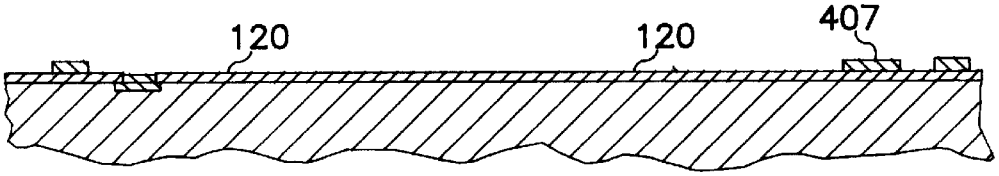

With reference now to FIG. 72, a thin gate oxide is thermally grown on the substrate 130. This will also affect the electrical connections of the thermal shunt 140 to the substrate 130, but will have an insignificant effect on thermal conduction. Polysilicon is deposited to form the gates 403 and interconnects of the transistors. The drain and source of the transistors are N-type doped using the polysilicon gate 403 as a mask. This will also dope the thermal shunt connection 403 to the substrate 130. A 0.05 micron layer of $HfB_2$ is deposited to form the heater 120. A 0.5 micron layer of aluminium is deposited over the substrate 130 to form the first level of metal 134. A resist is patterned with the sum of the heater and the first level metal 134, and wet etched with a phosphoric acid-nitrate etchant. The $HfB_2$ layer is reactive ion etched using the aluminium as a mask. The etch is performed with a halogenic gas such as $CCl_4$ (carbon tetrachloride), as described in U.S. Pat. No. 4,889,587. The wafer is then at the stage illustrated in FIG. 72. The mask shows the ground common track 405 and the V+ common track 405.

A resist is then patterned with a pattern which exposes the heater element 120, and wet etched with a phosphoric acid-nitric etchant. The wafer then corresponds to that illustrated in FIG. 73, also showing a heater connection electrode 407, and $HfB_2$ 408 under aluminium.

If the above steps are followed, there will result a 500 Angstroms layer of $HfB_2$ under all of the first level of metal 134. This includes the connections to the sources and the drains of all the FET's as well as Schottky diodes, in the control circuitry. If necessary, another masking and RIE etching can be used before the deposition of aluminium to remove $HfB_2$ from unwanted areas.

Figure 74A:
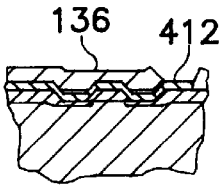
Figure 74B:
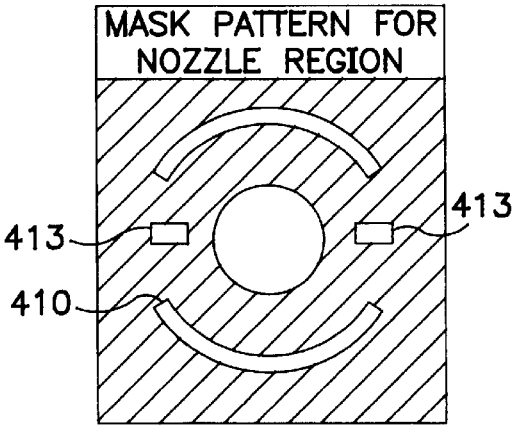
Figure 74C:
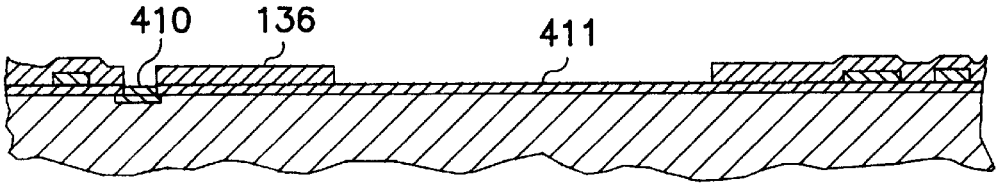

FIG. 74 illustrates the provision of the interlevel oxide 136. This layer of CVD $SiO_2$ or PECVD $SiO_2$, approximately 1 micron thick. The thickness of this layer can be determined by the thermal lag required between the heater 120 and the thermal shunt 140. FIG. 74 shows the cross-section of the wafer after this step in which 410 is a thermal shunt via, 411 represents the nozzle cavity, 412 a via for connection to the transistor and 413 the heater connection vias.

Figure 75A:
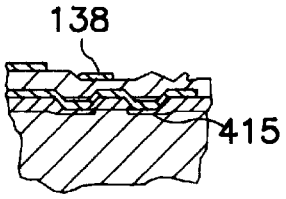
Figure 75B:
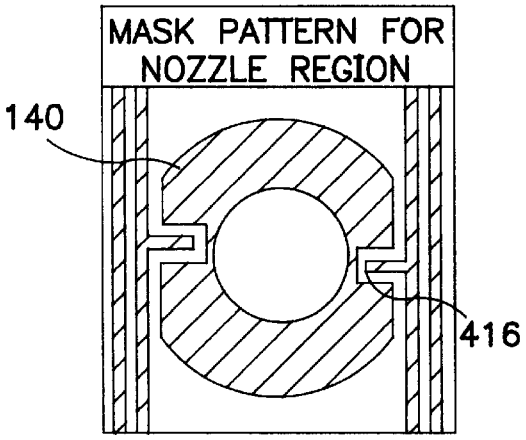
Figure 75C:
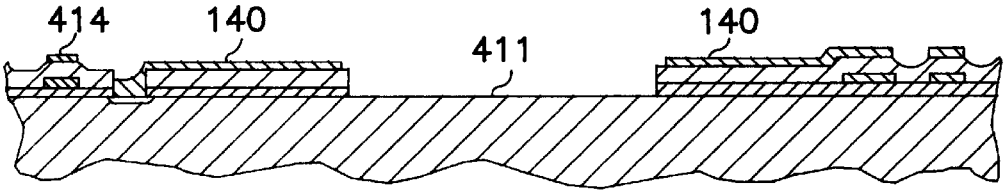

Referring now to FIG. 75, the second level metal 138 is formed as a layer of 0.5 micron aluminium which forms both the thermal shunt 140 and the second level of interconnects 144 to the heaters 120, heater connection 416 and connection 415 for the drive circuitry. Two levels of metal are unlikely to be necessary for ZBJ heads with one nozzle per pixel, but are likely to be required for high speed colour heads with four nozzles per pixel. The thickness and material of this layer can be changed to suit the thermal requirements of the heater chamber depending on the specific application.

Figure 76A:
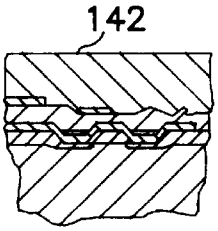
Figure 76B:
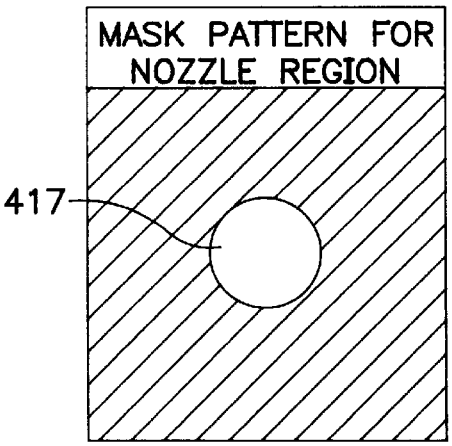
Figure 76C:
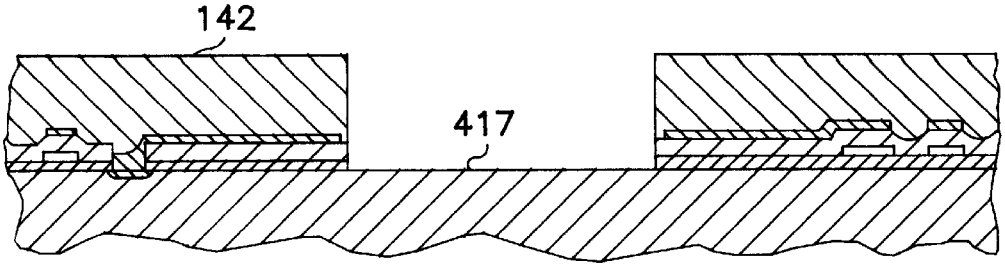

Referring now to FIG. 76, a CVD glass overcoat 142 is applied, approximately 4 microns thick. A low temperature CVD process, such as PECVD, can be used. This layer is very thick and provides mechanical strength for the nozzle tip 417, as well as environmental protection. A 17 micron diameter hole is RIE etched through the 4 micron glass overcoat with an $SiO_2$ etching species. This forms the top of the nozzle tip 417 and completes the configuration illustrated in FIG. 76.

The hole (417) formed by a RIE of $SiO_2$ is extended at least 30 microns into the silicon by further RIE, using a silicon etching gas. In this case, the $SiO_2$ overcoat is used as the RIE mask. As RIE is relatively unselective, a substantial amount of the $SiO_2$ overcoat will be sacrificed. For example, if the etch rate is 5:1 ($Si:SiO_2$), then the CVD glass overcoat is deposited to a depth of 10 microns so that 4 microns remains after etching the silicon. This hole (417) can be etched as deeply as possible to minimise accuracy requirements in the depth of back etching of the nozzle barrel (113). Reactive ion etching is used to obtain near vertical side walls, to ensure that the ink flows to the end of the nozzle by surface tension.

The wafer is back-etched to a thickness of approximately 200 microns. The actual thickness if not critical, but the variation in thickness is, however. The wafer must be etched such that the thickness variation is less than ±2 microns over the wafer. If this is not achieved, it is difficult to subsequently ensure that the process of back etching the nozzles does not over-etch and destroy the heaters.

The next step for a four colour head is to RIE etch ink channels 101 in the reverse side of the surface of the chip 100 in the manner illustrated in FIGS. 6 to 9. These channels 101 (FIG. 5) are approximately 600 microns wide×100 microns deep. These channels 101 are not essential to the operation of the ZBJ chip 100, but have two advantages. Namely, the channels 101 reduce the ink flow rate through the filter from approximately 8 mm per second to 2 mm per second. This flow rate reduction can alternatively be achieved by locating the filter differently in the ZBJ head 200. Also, the channels reduce the depth that the nozzles 110 need to be etched from 190 microns to 90 microns. As the nozzle barrels 113 are 40 microns in diameter, this has a major effect on the ratio of length to diameter of the barrels 113.

However, the ink channel back etch 420 has the disadvantage of weakening the wafer substantially. This step can be omitted if desired.

The ink channel back-etching process can also be used to thin the wafer along the dice lines in the manner earlier described with reference to FIG. 68.

The etch depth of the next step, nozzle barrel back-etching 419, is critical to ensure that the nozzle barrel 113 properly joins with the nozzle tip 417 (111) to form the thermal chamber. A solution to this problem is to incorporate end point detection using optical spectroscopy. A chemical etch stop signal can be created by filling the nozzle tips 417 previously etched from the front surface of the substrate with a detectable chemical signature, and monitoring the exhaust gases with an emission spectroscope. The nozzle barrels 113 are formed with an anisotropic reactive ion etch of silicon. Holes 40 microns in diameter (later widened to 60 microns with an anisotropic plasma etch), are etched 70 microns into the silicon from the reverse side of the wafer. These holes are at the bottom of the previously etched ink channels, which are 100 microns deep. As the wafer is thinned to 200 microns, these holes etch to within 30 microns of the front surface of the silicon.

Figure 77A:
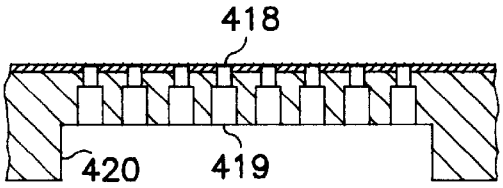
Figure 77B:
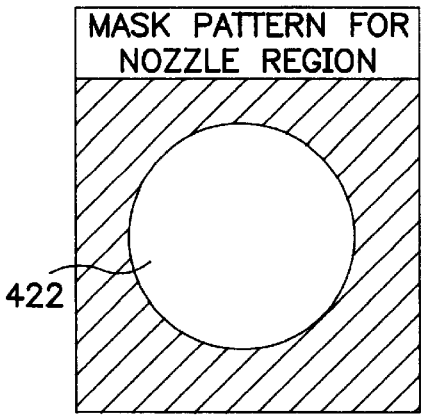
Figure 77C:
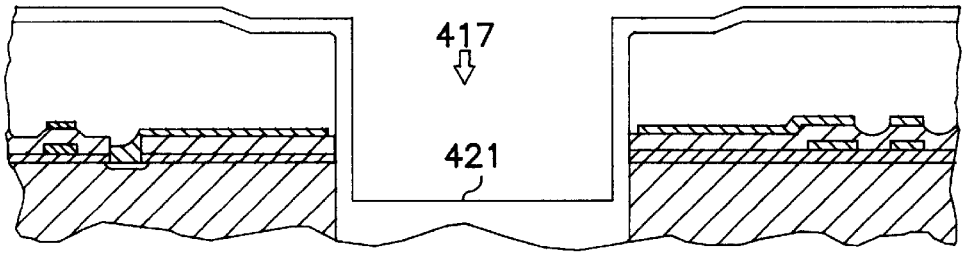

When the end point 421 detection signal from the spectroscope begins, the etch can be stopped, even if some of the nozzles have not joined up to the tips. This is because the next step (10 micron isotropic etching of all exposed silicon) joins up any that are within about 12 microns. FIG. 77 shows the ZBJ chip at the end of this step.

Etch depth uniformity over the entire wafer surface is critical. The tolerance depends largely upon the depth of each etch achievable with the 18 micron hole etched from the front of the chip. Given that the front etched hole is etched 30±2 microns, wafer thickness is 200±2 microns, ink channel back etch depth is 100±4 microns, overall isotropic etch of silicon is 10±1 microns, maximum joining distance is 12 microns, and the minimum between the nozzle barrel and the heater is 10 microns, cumulative tolerances mean that the nozzle barrel etch must be 70±4 microns. All of these tolerances can be loosened if the front etch can be deeper than 30 microns. The accuracy of alignment of the back-etching process to the front surface processes need only be to within ±10 microns, as alignment of the barrel and tip is not critical.

Figure 78:
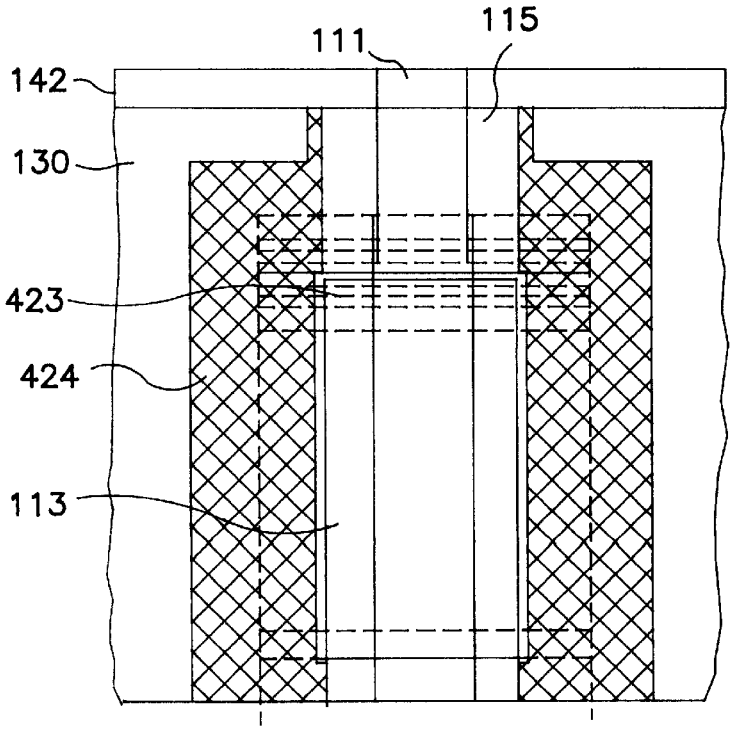
Figure 79A:
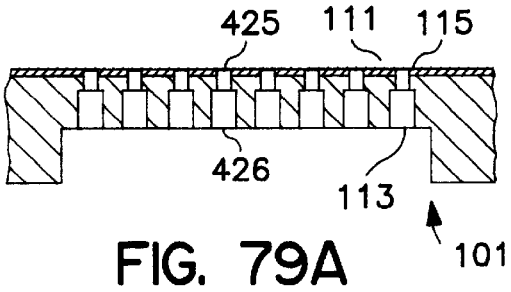
Figure 79B:
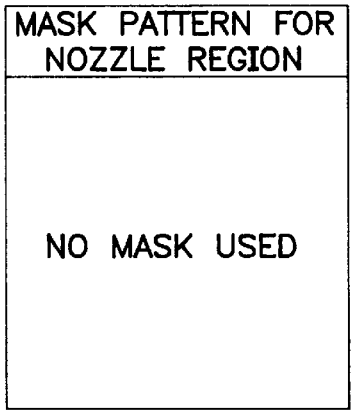
Figure 79C:
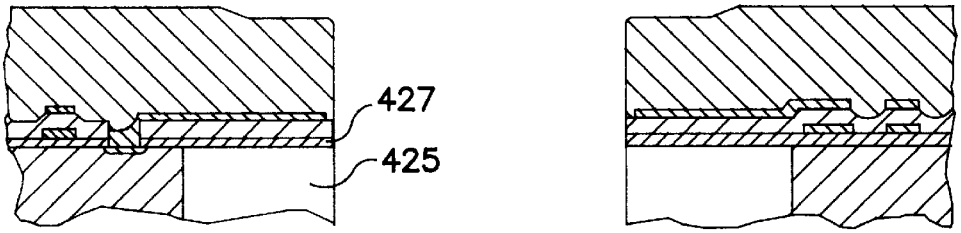

The cumulative effect of these tolerances is illustrated in FIG. 78. The cross-hatched area 424 seen in FIG. 78 shows the region of uncertainty in the final nozzle geometry, and the single-hatched area 423 shows the safety margin for the nozzle barrel to nozzle tip join using these tolerances. This safety margin is required because the reactive ion etches will not leave perfectly flat bottomed holes. The uncertainty of the wafer thickness (200±2 microns) and the channel etch (100±4 microns) are combined into one thickness figure of 100±6 microns as the channels are too large to be shown in this figure.

Other minor problems exist with this step, including: the resist must be very thick to be maintained for 70 microns of RIE; the etch is deep and narrow, giving problems with removal of spent etchant; shadowing of the projection pattern by the walls of the ink channels must be avoided; and adequate resist coverage of the stepped surface must be achieved. This is not critical as etching of the ink channel walls can be tolerated.

Figure 81:
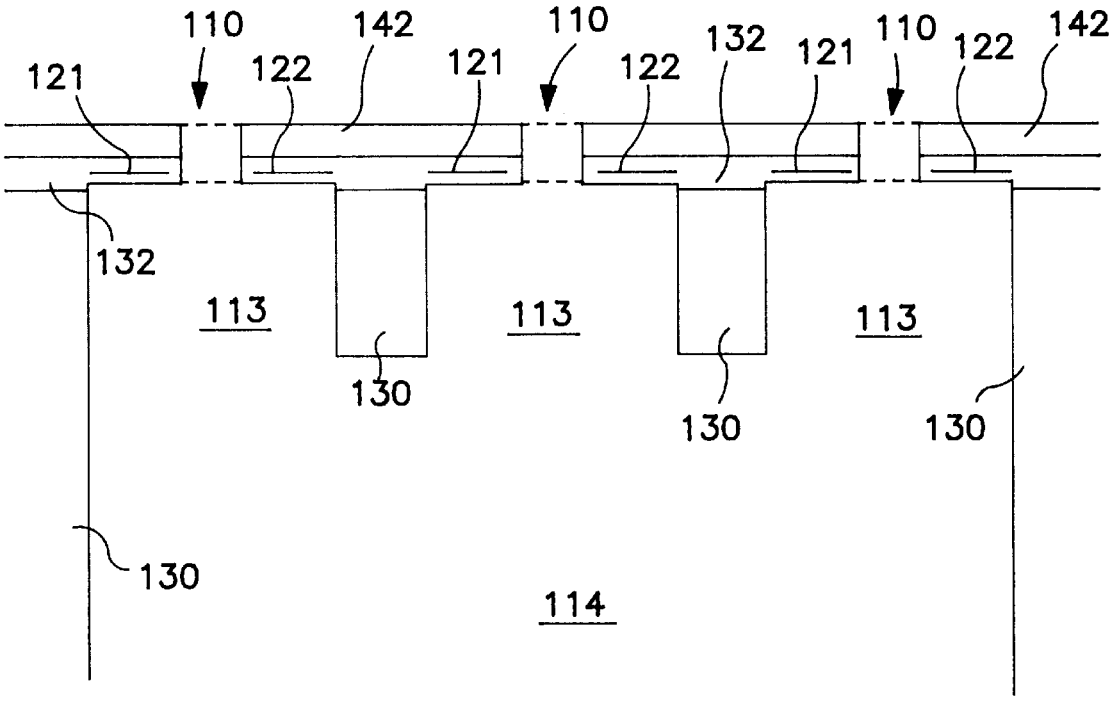
FIG. 81 is a cross-sectional schematic view through a wide hole which incorporates several nozzles.

However, the actual shape and dimensions of the rearside of the nozzles 110 is not critical. This provides considerable scope for other solutions. All that is required is that the minimum mechanical strength is maintained, and that a shape conducive to ink capillary action is achieved. Some possible alternatives are:

Multi-stage RIE with progressively narrower barrels 113 can be used. This avoids the problems of an accumulation of spent etchant and thick resists, but involves more processing steps;

Etching of wide holes which encompass several nozzles 110, with the nozzles clustered in groups to provide maximum spacing between these holes, and therefore conserving mechanical strength. This is illustrated in FIG. 81.

The entire ZBJ wafer is then subjected to a 10±1 micron isotropic plasma etch of all exposed silicon. This has two purposes. Firstly, this forms the thermal chamber 115 by undercutting 425 the thermal silicon dioxide 132 in the region of the heater 120. This is also to ensure that the nozzle barrels 113 join with the nozzle tips 111 resulting from a widening 426 of the barrels 113. As the wafer is etched from both sides, any non-joining barrels 113 and tips 111 that are within 18 microns (twice (10−1) microns) should join up. Non-joining barrels and tips within approximately 12 microns will behave essentially similarly to joined barrels and tips. This reduces the accuracy requirements of the barrel back-etch 419.

The etch must be highly selective towards silicon, and have a negligible etch rate with thermal silicon dioxide, otherwise the heater insulation layer 132 will be destroyed. This results in the configuration illustrated in FIG. 79.

The 4 micron glass overcoat 142 must now be etched to expose the bonding pads. This is not performed before the nozzle tip silicon etch because poor selectivity can cause the 30 micron RIE silicon etch to etch through the aluminium layer 139. The ZBJ chip 100 can then be passivated with a 0.5 micron layer 144 of tantalum or other suitable material. It can be difficult to achieve a highly conformal coating, but irregularities in the passivation thickness will not substantially affect the performance of the ZBJ chip 100.

The ZBJ chip 100 has no electrical output, and therefore true functional testing can only be achieved by loading the device with ink into printing and printing patterns which exercise each individual nozzle 110. This cannot be performed at multi-probe time. An effective method of functional testing the chips 100 at multi-probe time is to test the power consumption in the V− to ground path as each heater 120 is turned on in sequence. Each time a heater 120 is fired, a current pulse should occur. As this is a separate circuit with negligible quiescent current, these pulses are readily detected. The entire pattern of operational heaters and redundant circuits can be determined in approximately 1 second with inexpensive equipment. Therefore the entire wafer can be multi-probed in under one minute. The pattern of functional and non-functional heaters can be read into a computer and used for compiling process statistics and detecting local quality control problems.

Figure 80A:
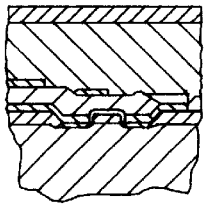
Figure 80B:
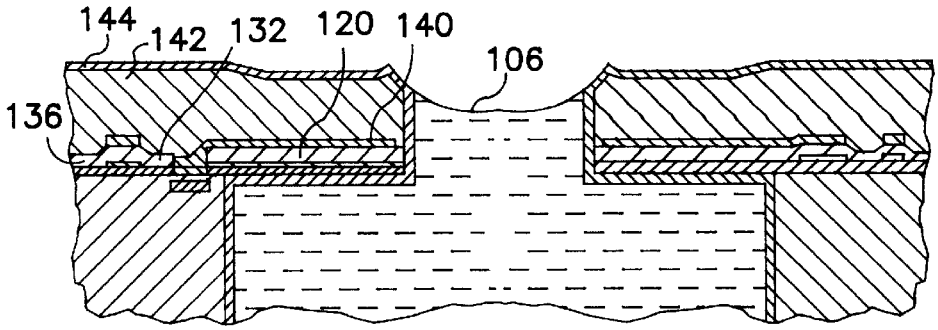

Scribing is along the top surface of the etched dice channels 147 (see FIG. 68). The end taps 148 for handling must be diced off before the ZBJ chips 100 can be separated. The chips 100 can be glued in place in the head assemblies 200 and connected using tape automated bonding, with one tape along each edge of the chip. Alternatively, standard wire bonding can be used, as long as enough wires are bonded to meet the high current requirements of the chip 100. FIG. 80 illustrates the cross-section of the completed device.

Figure 82:
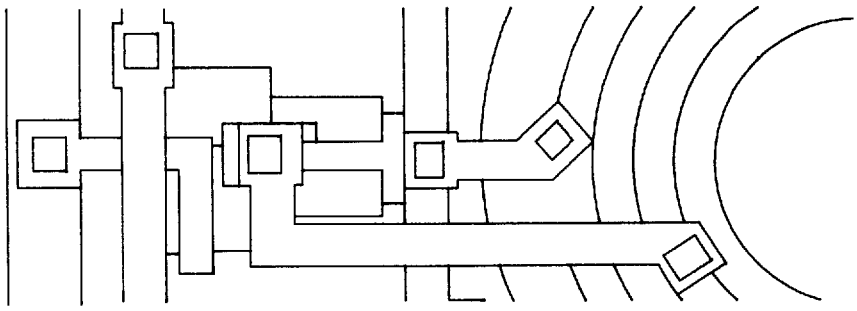
FIGS. 82 to 113 show the manufacturing stages of a preferred embodiment.

FIG. 82 is a plan view of typical components used in a ZBJ chip of the structure shown in FIG. 18. FIGS. 83 to 113 are vertical cross-sections through the centre line of FIG. 82 at various manufacturing stages.

Figure 83:
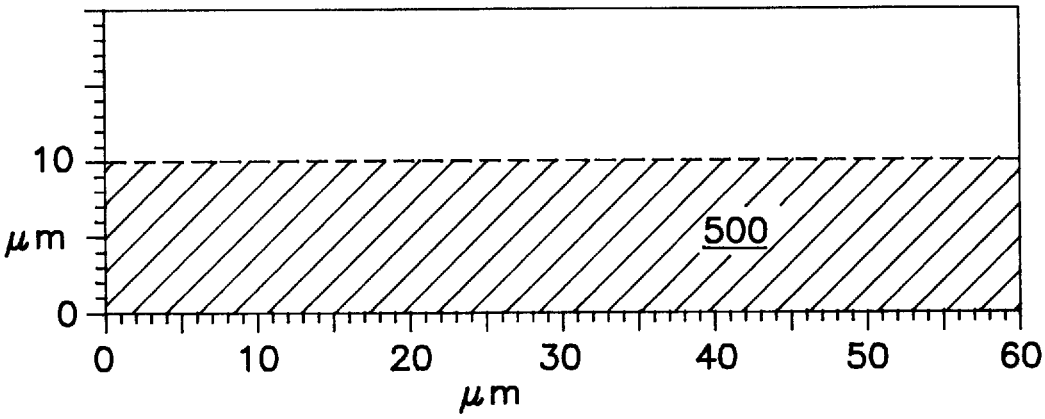

FIG. 83: The manufacturing process commences with a standard silicon wafer of P-type doping with a resistivity of approximately 25 ohm cm.

Figure 84:
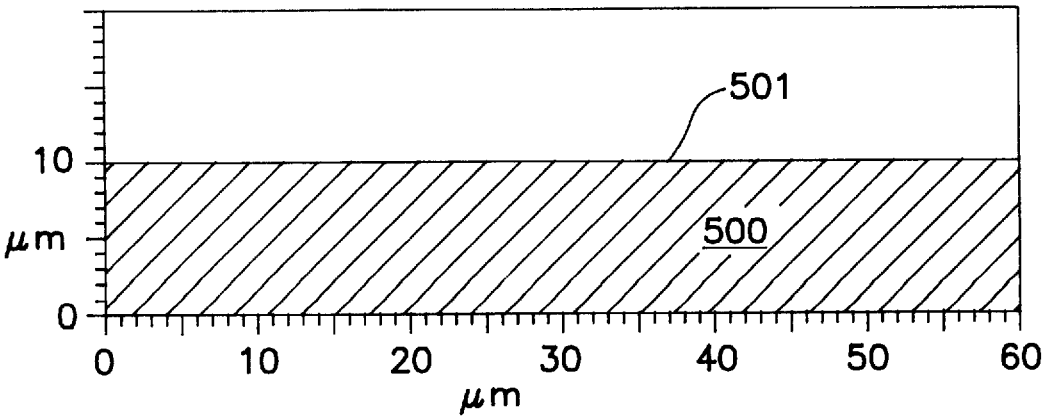

FIG. 84: A layer of silicon nitride 501 approximately 0.15 microns thick is grown on the wafer 500. This is a standard NMOS process.

Figure 85:
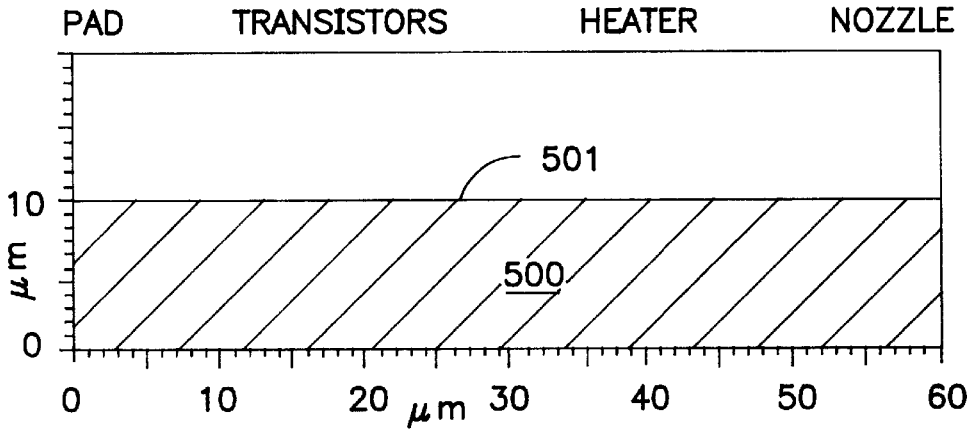

FIG. 85: A first mask 501 is used to pattern the silicon nitride 501 to prepare for boron implantation.

Figure 86:
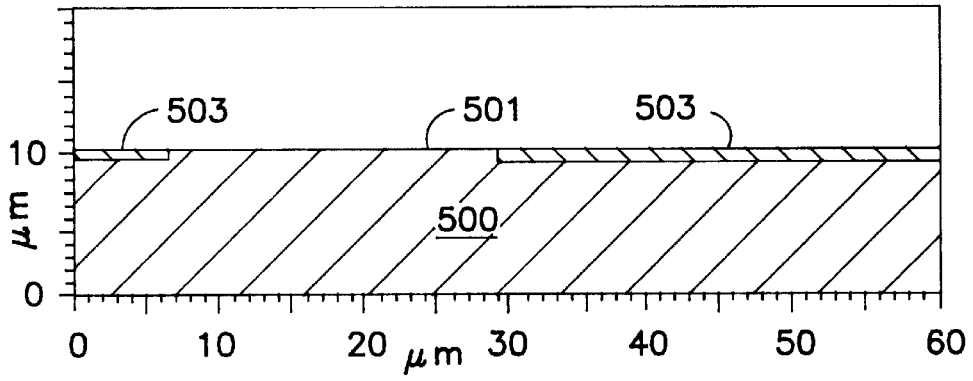

FIG. 86: The wafer 500 is implanted with a field 503 of boron to eliminate the formation of spurious transistors.

Figure 87:
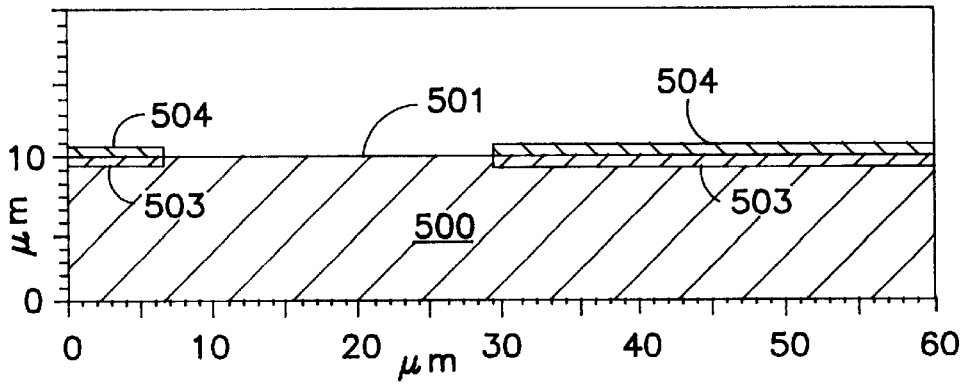

FIG. 87: A thermal oxide layer 504 approximately 0.8 microns thick is grown on the boron implanted field 503.

Figure 88:
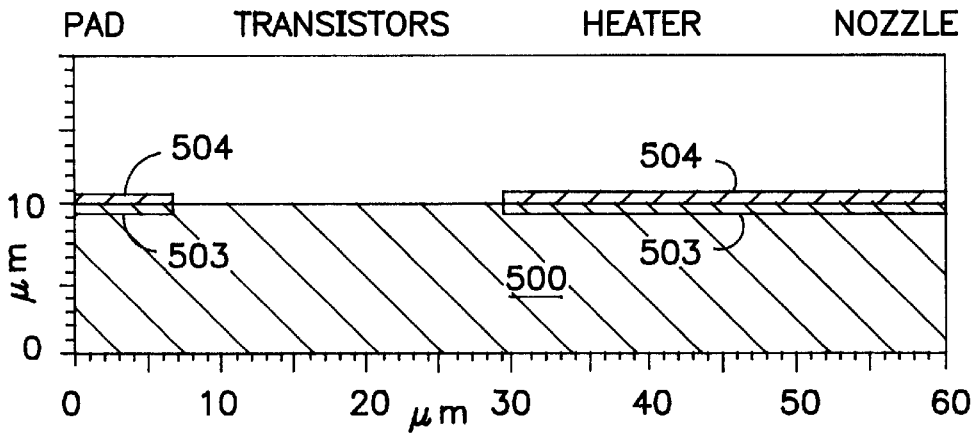

FIG. 88: The remaining silicon nitride 501 is removed.

Figure 89:
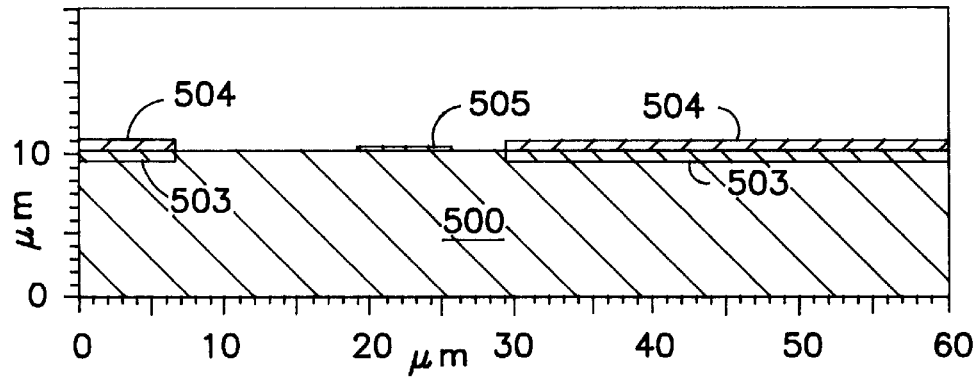

FIG. 89: This is a standard NMOS process which implants arsenic to form regions 505 for deletion mode transistors. This step involves the spin deposition of a resist, exposure of the resist to the second mask, development of the resist, arsenic implantation, and resist removal.

Figure 90:
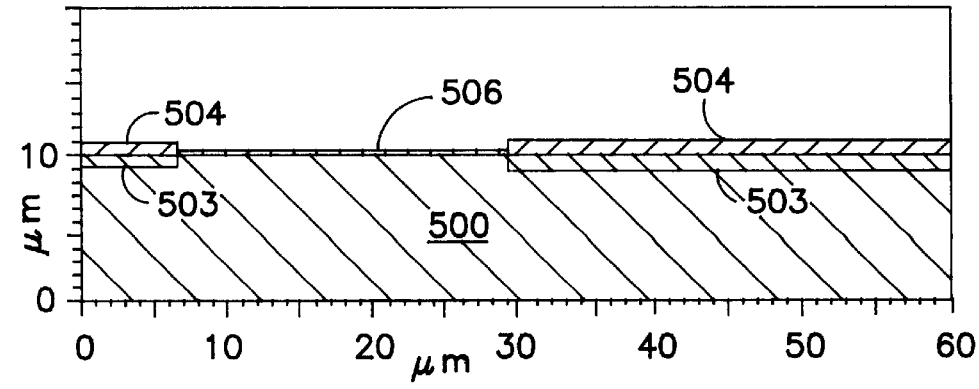

FIG. 90: A 0.1 micron gate oxide 506 is thermally grown. This is part of a standard NMOS process and increases the field oxide thickness to 0.9 microns.

Figure 91:
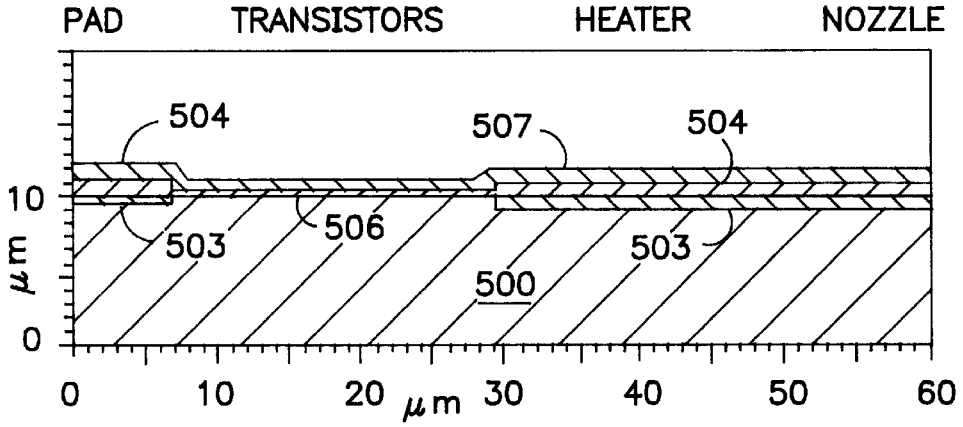

FIG. 91: A 1 micron layer of polysilicon 507 is deposited over the entire wafer 500 using chemical vapour deposition.

Figure 92:
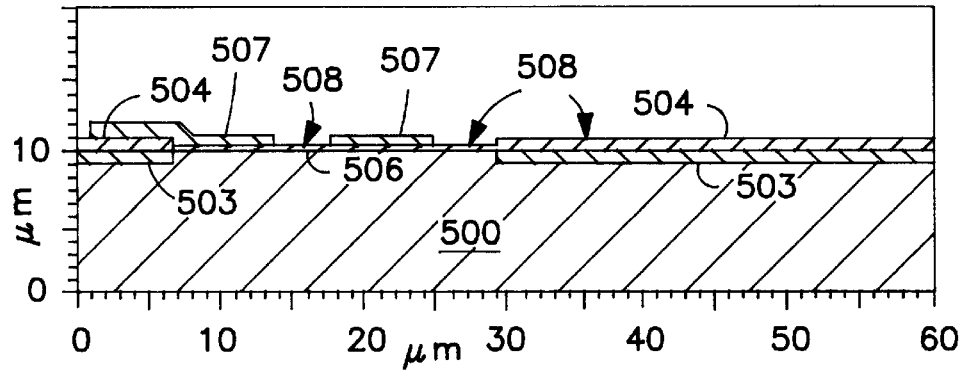

FIG. 92: The polysilicon 507 is patterned using a third mask 508. The waver 500 is spin coated with resist. The resist is exposed using the third mask and developed. The polysilicon 507 is then etched using an anisotropic ion enhanced etching to reduce undercutting.

Figure 93:
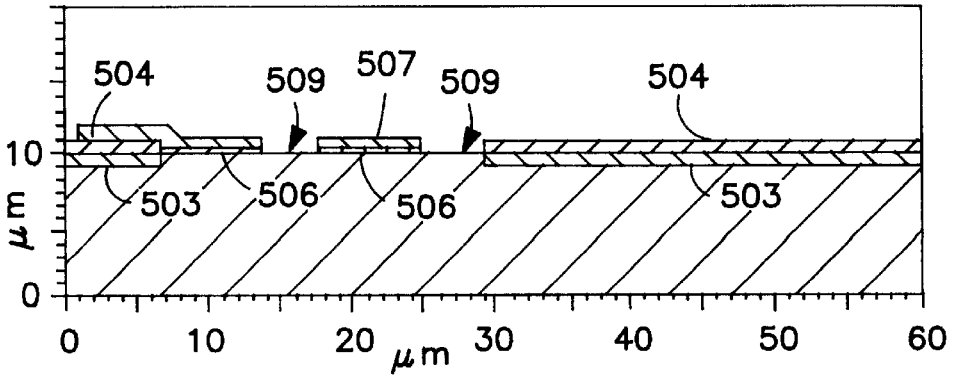

FIG. 93: The gate oxide 506 is etched where exposed by the polysilicon etch of the third mask. This results in etch diffusion windows 509 being formed and will also thin the field oxide 504 leaving a thickness of 0.8 microns.

Figure 94:
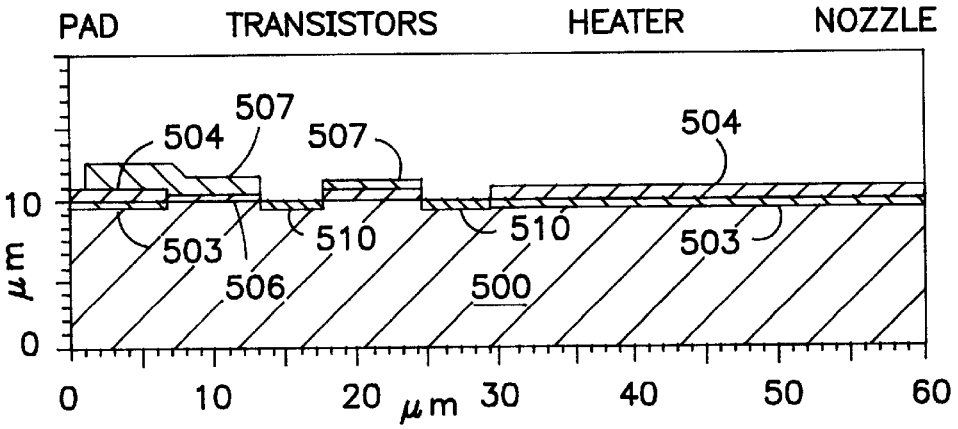

FIG. 94: N+ diffusion regions 510 approximately 1 micron deep are formed in the diffusion windows 509.

Figure 95:
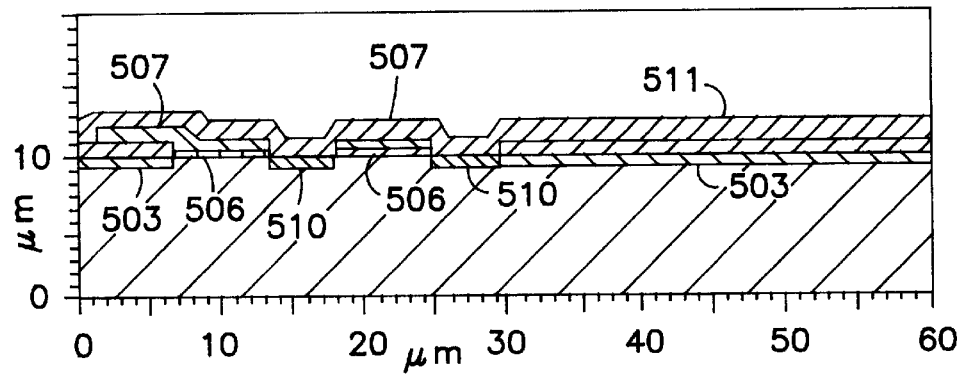

FIG. 95: A 1 micron layer of glass 511 is deposited using chemical vapour deposition.

Figure 96:
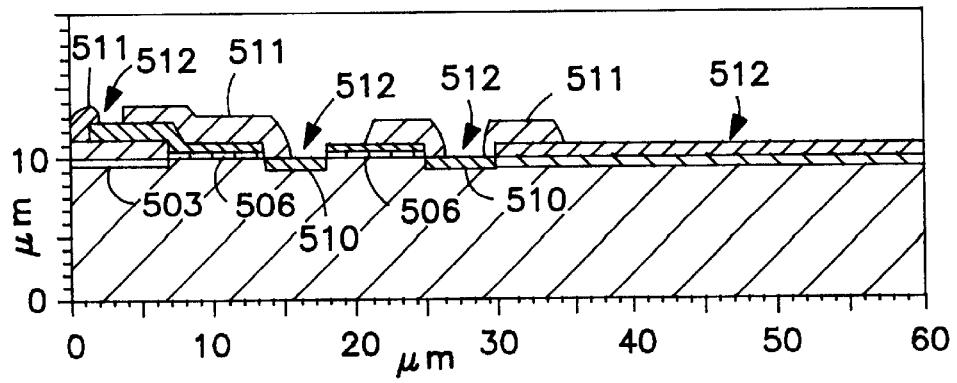

FIG. 96: The CVD glass 511 is etched where contacts are required to the polysilicon 507, the diffusions 510 and in the heater region. Contact regions 512 are formed. This process differs from the standard NMOS process in that the depth of etch is controlled so that there is an appropriate amount of thermal $SiO_2$ 504 remaining under the heaters.

Figure 97:
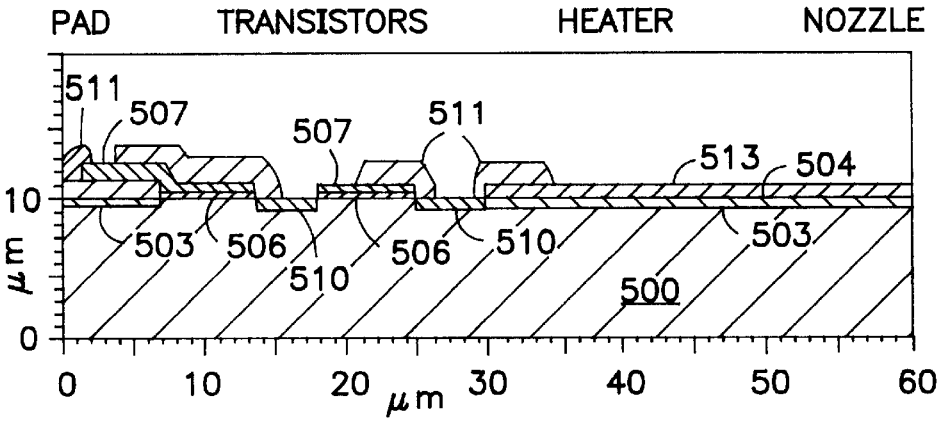

FIG. 97: A 0.05 micron layer 513 of $HfB_2$ is deposited over the wafer 500. This is not a standard NMOS process.

Figure 98:
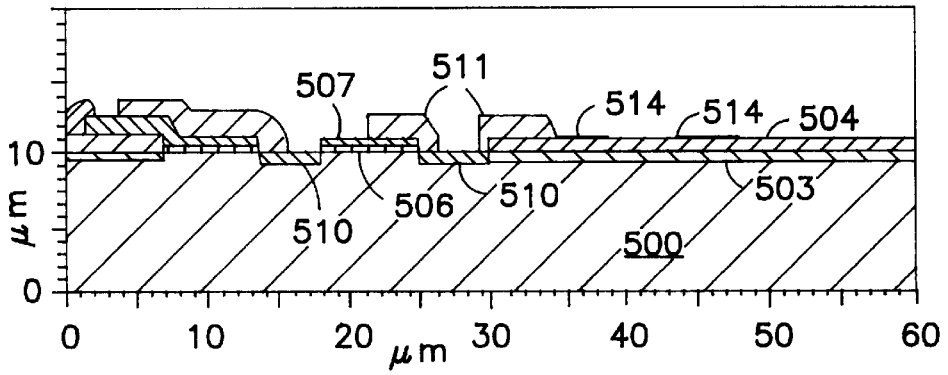

FIG. 98: A $HfB_2$ layer 513 is etched using ion enhanced etching with $CCl_4$ as the etchant. This exposes the heaters 514. This step requires spin coating of resist, exposure to a fifth level mask, development of resist, ion enhanced etching, and resist stripping.

Figure 99:
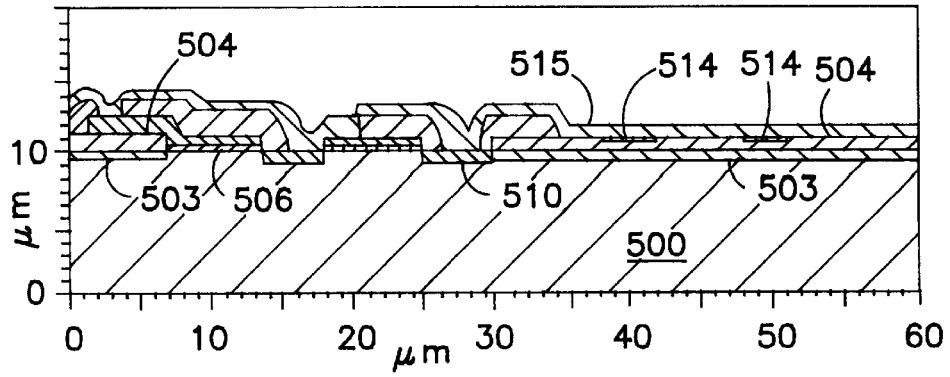

FIG. 99: A 1 micron first metal level 515 of aluminium is evaporated over the wafer 500.

Figure 100:
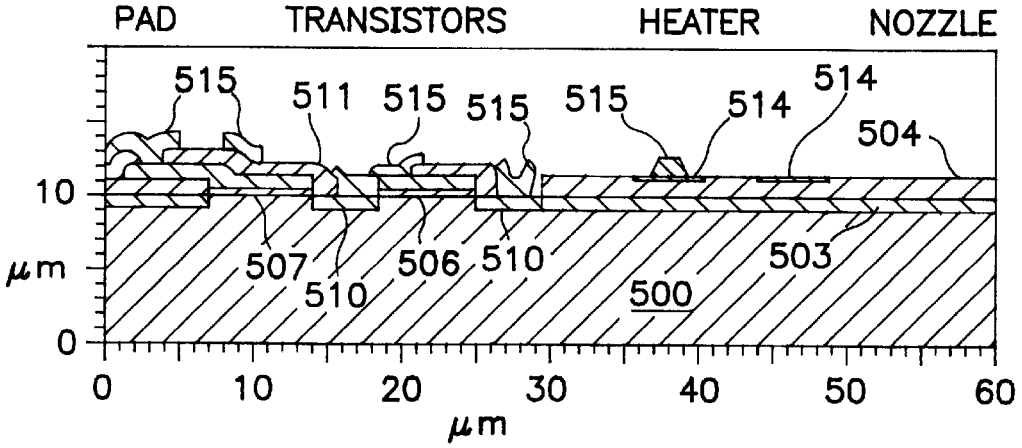

FIG. 100: The first metal level 515 is etched using a sixth level mask. This step requires spin coating of resist, exposure to the sixth mask, development of resist, plasma etching, and resist stripping. The etch must be strongly selective over $HfB_2$, as the $HfB_2$ layer is only 0.05 microns and will be exposed when the metal 515 is etched.

Figure 101:
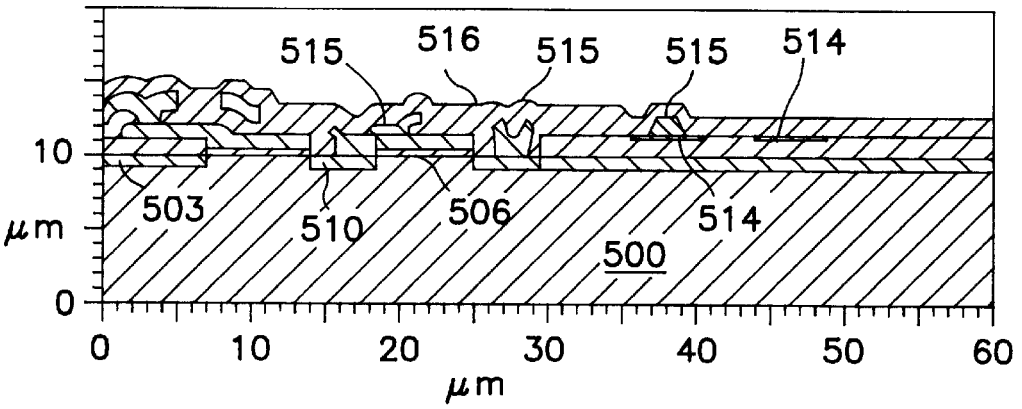

FIG. 101: A 1 micron layer 516 of glass is deposited using chemical vapour deposition.

Figure 102:
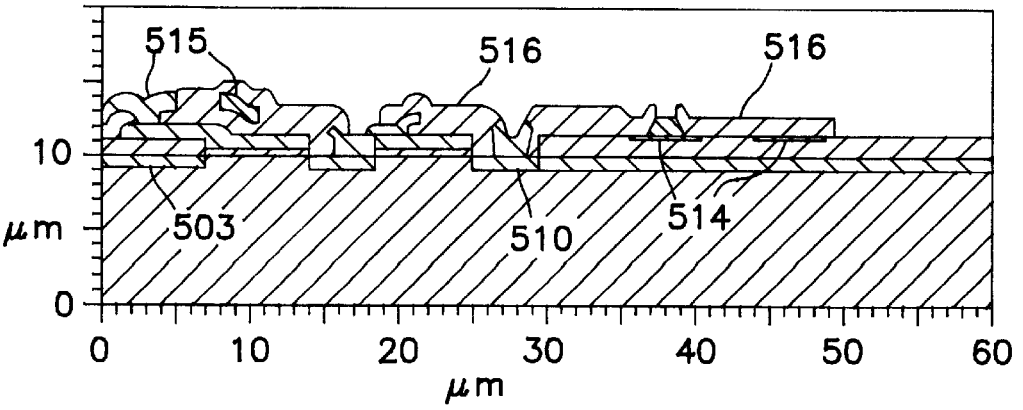

FIG. 102: Pattern contacts for the seventh level mask are made using a standard contact etch for 2 micron NMOS with double level metal. This step requires spin coating of resist, exposure to the seventh mask, development of resist, ion enhanced etching, and resist stripping.

Figure 103:
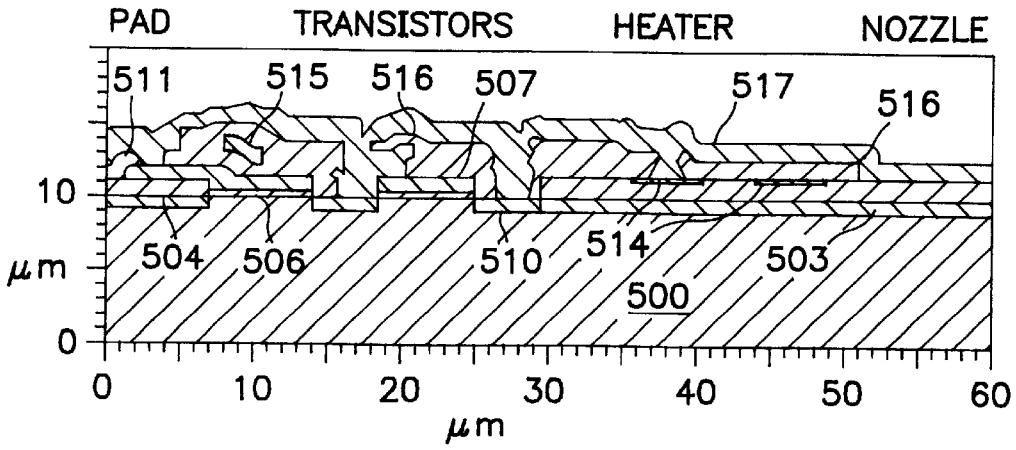

FIG. 103: A 1 micron second level metal layer 517 of aluminium is evaporated over the wafer 500. This metal layer 517 provides the second level of contacts. This is required because a high wiring density is required to the heaters 514, which must be metal for low resistance. This layer also provides the thermal diffuser or thermal shunt as described in the earlier embodiments.

Figure 104:
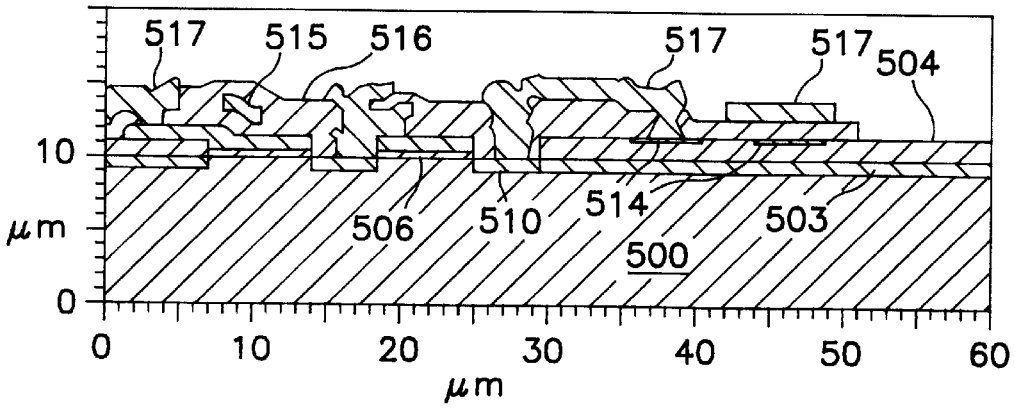

FIG. 104: The second level metal 517 is etched using an eighth mask. This step requires spin coating of resist, exposure to the eighth mask, development of the resist, plasma etching, and resist stripping. This is a normal NMOS step. The isolated metal disk above the heaters 514 is the thermal diffuser used to distribute waste heat to avoid hot-spots.

Figure 105:
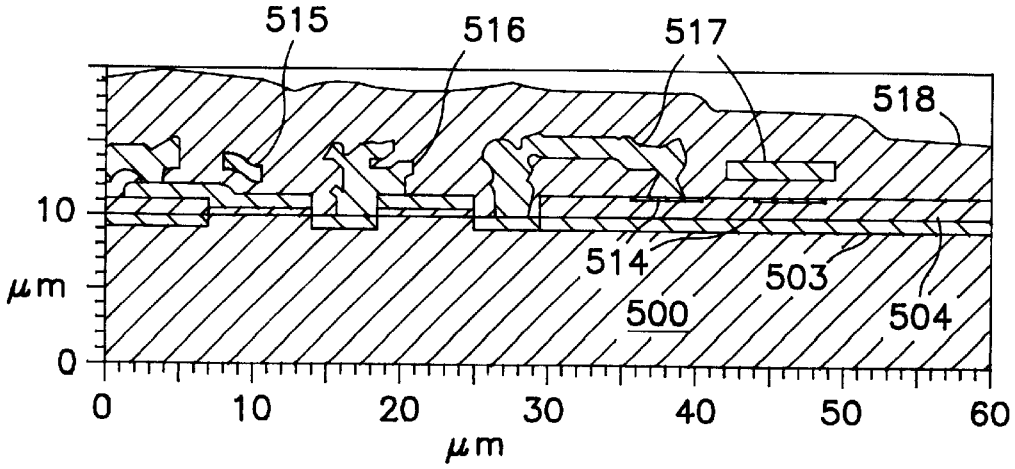

FIG. 105: A thick layer 518 of glass is deposited over the wafer 500. The layer 518 must be thick enough to provide adequate mechanical strength to resist the shock of imploding bubbles. Also, enough glass must be deposited to diffuse the heat over wide enough area so that the ink does not boil when in contact with it. 4 micron thickness is considered adequate, but can be easily varied if desired.

Figure 106:
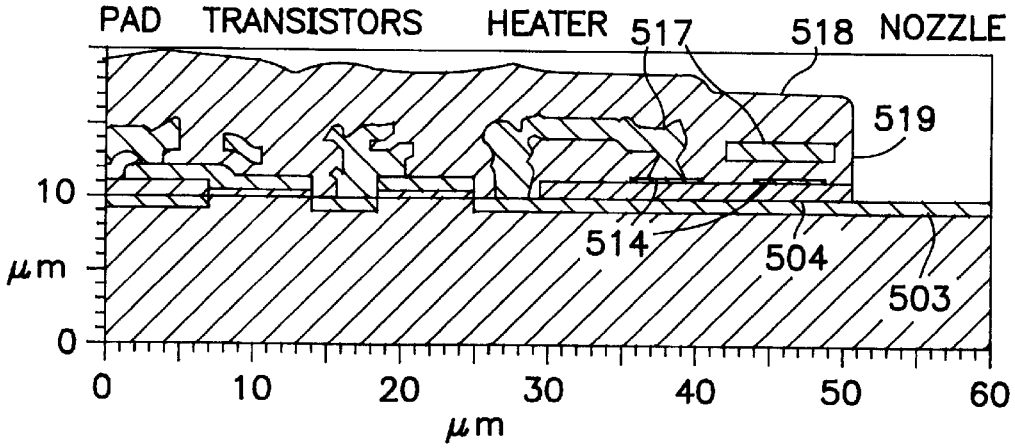

FIG. 106: This step required etching using a ninth level mask of a cylindrical barrel 519 into the overcoat 518, through the thermal oxide layer 504 down to the implanted field 503. Both CVD glass and thermal quartz are etched. This step requires spin coating of resist, exposure to a ninth level mask, development of resist, and anisotropic ion enhanced etching, and resist stripping.

Figure 107:
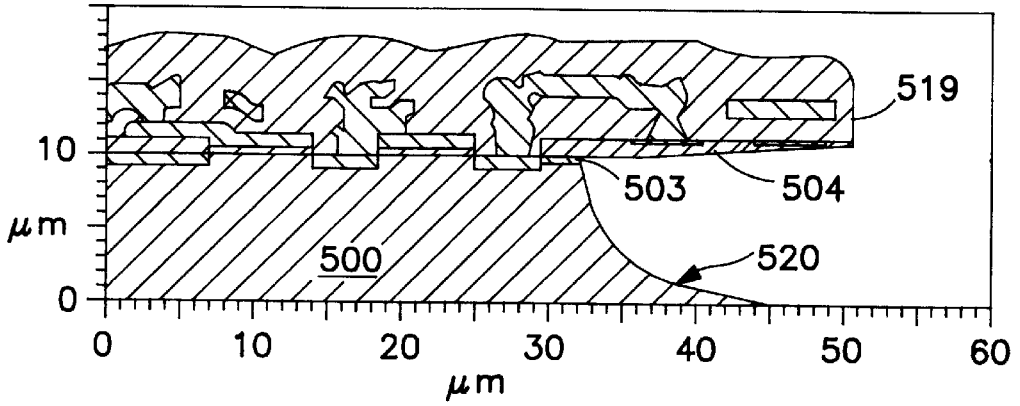

FIG. 107: The thermal chamber 520 is formed by an isotropic plasma etch of silicon, highly selective over $SiO_2$. This is essential, as otherwise the protective layer of $SiO_2$ separating the heater 514 from the passivation will be etched. The previously etched barrel 519 acts as the mask for this step. In this case, an isotropic etch of 17 microns is used. Care must be taken not to fully etch the thermal $SiO_2$ layer 504.

Figure 108:
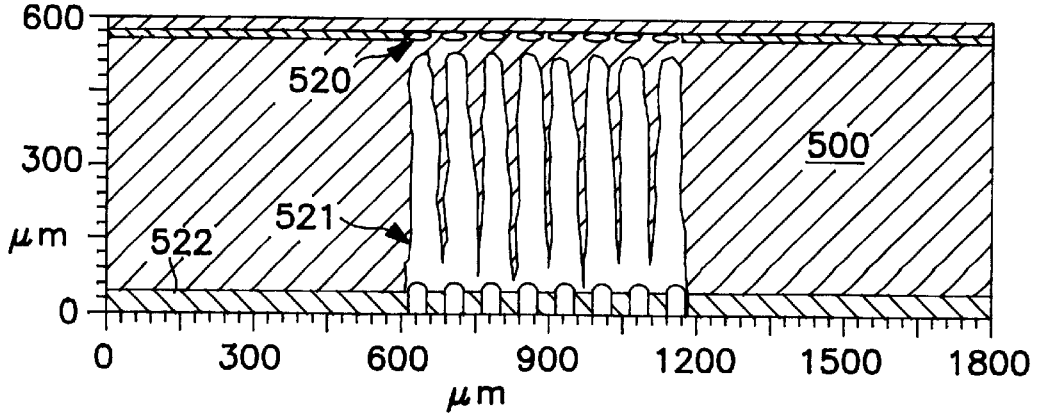

FIG. 108: Nozzle channels 521 are etched from the reverse side of the wafer 500 by an anisotropic ion enhanced etching. The channels 521 are about 60 microns in diameter, and about 500 microns deep. The depth of the channels 521 is such that the distance between the top of the channel and the bottom of the thermal chamber 520 is the required nozzle length. The etching place through a layer of resist 522.

Figure 109:
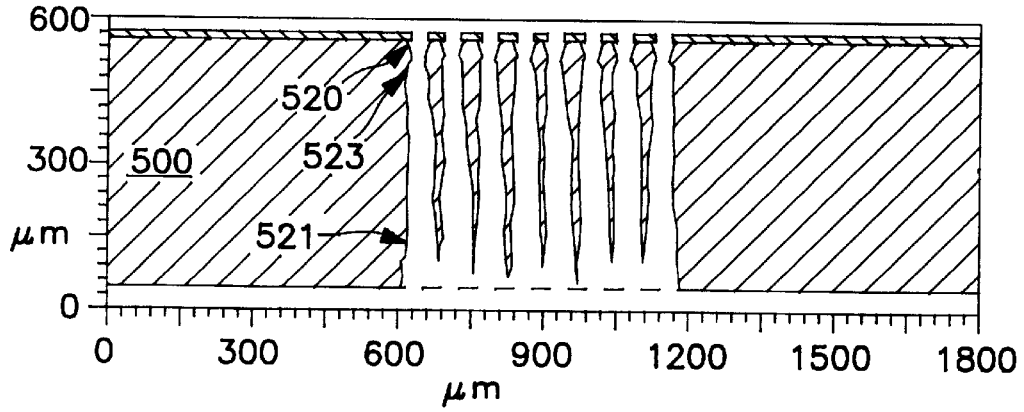

FIG. 109: The nozzle via is etched from the front side of the wafer 500 using a highly an anisotropic ion enhanced etching. This etch is from the bottom of the the thermal chamber 520 to the top of the back etched nozzle channels 521, and is about 20 microns in length, and 20 microns in diameter. The nozzle barrels 523 are formed therefrom.

Figure 110:
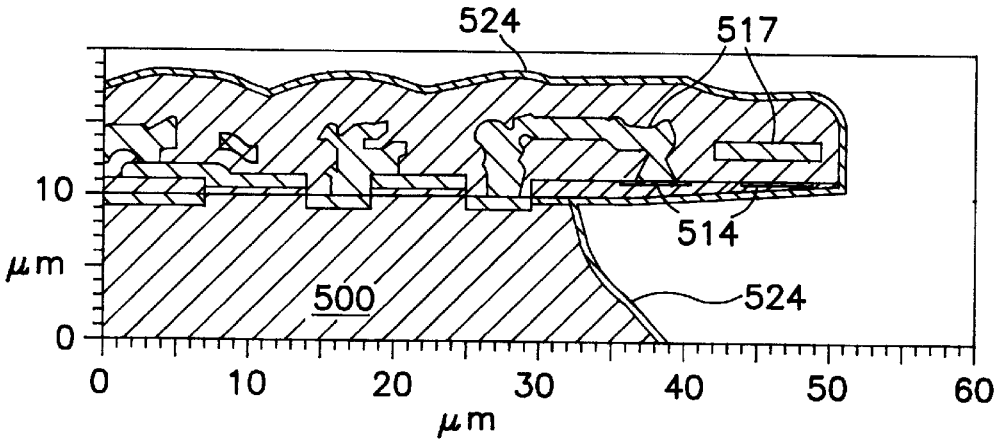

FIG. 110: A 0.5 micron passivation layer 524 of tantalum is conformably coated over the entire wafer 500.

Figure 111:
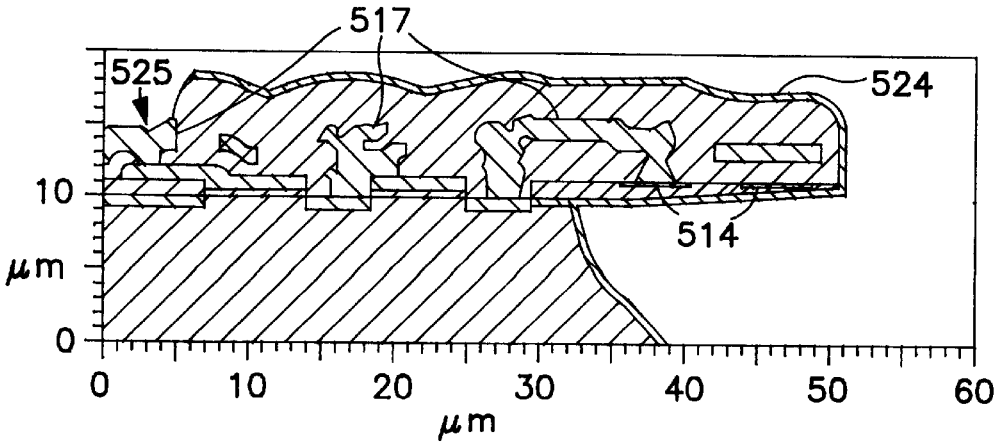

FIG. 111: In this step, windows are opened for the bonding pads 525. This requires a resist coating, exposure to a twelfth level mask, resist development, etching of the tantalum passivation layer 524, ion enhance etching of the overcoat 518, and resist stripping. As 2 microns of aluminum is available in the pad regions, it is easy to avoid etching through the pads formed by the second level metal 517.

Figure 112:
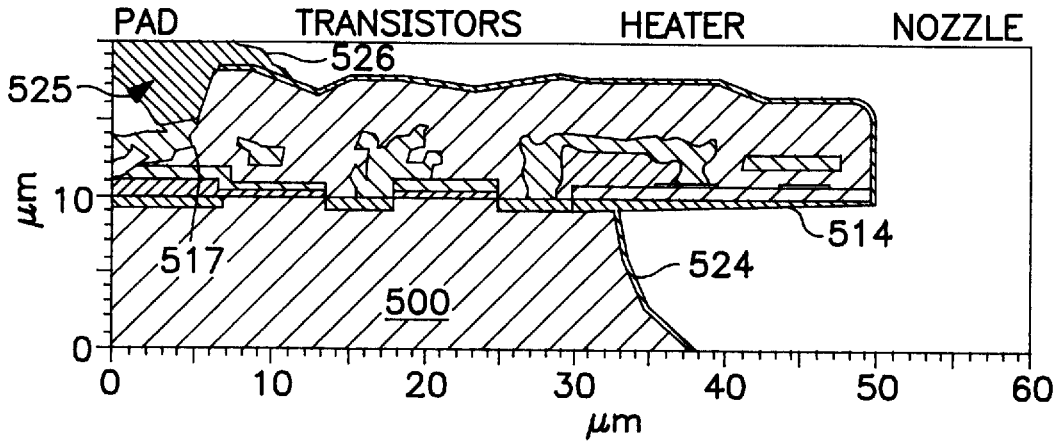

FIG. 112: After probing of the wafer 500, the ZBJ chip is mounted into a frame or support extrusion as earlier described and glued into place. Wires 526 are bonded to the pads formed by the second level metal 525 at the ends of the chip. Power rails are bonded along the two long edges of the chip. Connections are then potted in epoxy resin.

Figure 113:
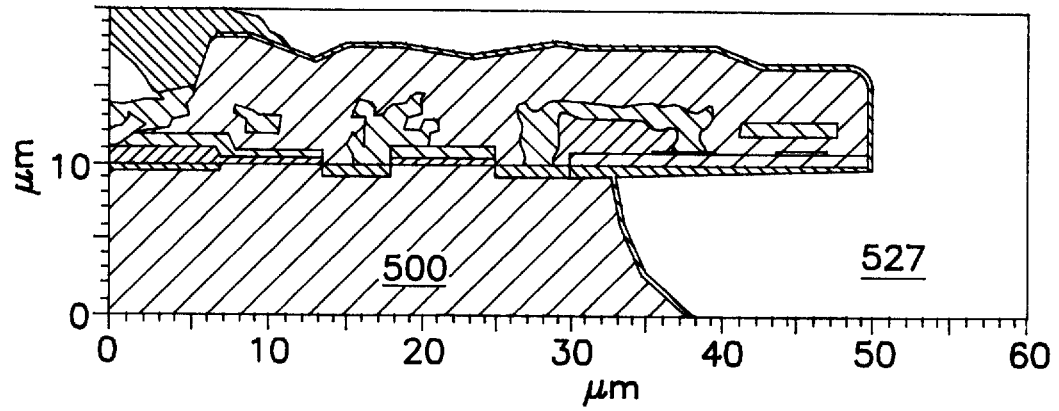

FIG. 113: This shows a forward ejection type ZBJ nozzle filled with ink 527. In this case, the droplet is ejected downwards when the nozzle fires. This type of head requires priming of ink using positive pressure, as it will not be filled by capillary action. A similar head construction can be used for reverse firing nozzles by filling the head heat chip from the other side.

Whilst the foregoing represents a fabrication process for a general, preferred nozzle structure, similar steps, although with some differences, can be used for the specific nozzle structures illustrated in FIGS. 17 to 22. Each of the following processes is a 2 micron NMOS with two level metal process as this is the simplest process which can be used to produce high resolution, high performance colour ZBJ devices. Also, the consistency between the processes permits an easier comparison therebetween.

A summary of the process steps required to provide the structure shown in FIG. 17 is as follows:

1) starting water: p type, 600 microns thick;
2) grow 0.15 microns silicon nitride;
3) pattern nitride using mask 1;
4) implant field;
5) grow 0.8 micron field oxide;
6) implant depletion arsenic using mask 2;
7) grow 0.1 micron gate oxide;
8) deposit polysilicon (1 micron);
9) pattern polysilicon using mask 3;
10) etch diffusion windows;
11) diffuse n+ regions;
12) deposit 1 micron CVD glass;
13) pattern contacts using mask 4;
14) deposit 0.05 micron hafnium boride heater;
15) etch heater using mask 5;
16) deposit first metal (1 micron);
17) pattern metal using mask 6;
18) deposit 1 micron CVD glass;
19) pattern contacts using mask 7;
20) deposit second metal (including thermal shunt), 1 micron aluminium;
21) pattern metal using mask 8;
22) deposit 10 microns CVD glass;
23) etch nozzle through CVD glass using mask 9;
24) etch thermal chamber using isotropic etch;
25) back-etch barrels through the wafer using mask 10;
26) join thermal chambers to barrels using an anisotropic, unmasked etch;
27) deposit 0.5 micron tantalum passivation;
28) open pads using mask 11;
29) wafer probe;
30) mount into head assembly;
31) bond wires;
32) pot in epoxy;
33) fill with ink. Head will fill by capillarity.

A summary of the process steps required to provide the structure shown in FIG. 18 is as follows:

1) starting wafer: p type, 600 microns thick,
2) grow 0.15 microns silicon nitride
3) pattern nitride using mask 1;
4) implant field;
5) grow 0.8 micron field oxide;
6) implant deposition arsenic using mask 2;
7) grow 0.1 micron gate oxide;
8) deposit polysilicon (1 micron);
9) pattern polysilicon using mask 3;
10) etch diffusion windows;
11) diffuse n+ regions;
12) deposit 1 micron CVD glass;
13) pattern contacts using mask 4;
14) deposit 0.05 micron $HfB_2$ heater;
15) etch heater using mask 5;
16) deposit first metal (1 micron);
17) pattern metal using mask 6;
18) deposit 1 micron CVD glass;
19) pattern contacts using mask 7;
20) deposit second metal (including thermal diffuser), 1 micron aluminium;
21) pattern metal using mask 8;
22) deposit 3 microns CVD glass;
23) etch entrance to thermal chamber through CVD glass using mask 9;
24) etch thermal chamber using isotropic plasma etch;
25) etch holes 520 microns deep, 80 microns wide from the back side of the wafer, using mask 10;
26) join thermal chambers to barrels using an anisotropic RIE using thermal chamber entrance as a mask;
27) deposit 0.5 micron tantalum passivation;
28) open pads using mask 11;
29) wafer probe;

30) bond wires;
31) pot in epoxy
32) mount into head assembly;
33) fill head assembly with ink;
34) prime head with positive ink pressure above the bubble pressure of the nozzle.

A summary of the process steps required to provide the structure shown in FIG. 19 is as follows:

1) starting water; p type, 600 microns thick;
2) grow 0.15 microns silicon nitride;
3) pattern nitride using mask 1;
4) implant field;
5) etch a circular trench around the nozzle position. 22 microns diameter, 2 microns deep, 1 micron wide using mask 2;
6) grow 0.4 micron field oxide (this also grows on the trench walls);
7) deposit 0.05 micron $HfB_2$ heater;
8) etch heater using mask 3;
9) implant arsenic using mask 4;
10) grow 0.1 micron gate oxide;
11) deposit polysilicon (1 micron);
12) pattern polysilicon using mask 5;
13) etch diffusion windows;
14) diffuse n+ regions;
15) deposit 1 micron CVD glass;
16) pattern contacts using mask 6;
17) deposit first metal (1 micron);
18) pattern metal using mask 7;
19) deposit 1 micron CVD glass;
20) pattern contacts using mask 8;
21) deposit second metal, 1 micron aluminium;
22) pattern metal using mask 9;
23) deposit 20 microns CVD glass, forming the nozzle layer;
24) anisotropically etch thermal chamber and nozzle using mask 10 (undersized diameter of less than 18 microns);
25) etch holes 520 microns deep, 80 microns wide from the back side of the wafer, using mask 11. Join to nozzles.
26) use a silicon specific isotropic "wash" etch to enlarge the thermal chamber to the edge of to the heater trench;
27) deposit 0.5 micron tantalum passivation;
28) open pads using mask 12;
29) wafer probe;
30) bond wires;
31) pot in epoxy;
32) mount into head assembly;
33) fill head assembly with ink.

A summary of the process steps required to provide the structure shown in FIG. 20 is as follows:

1) starting water: p type, 600 microns thick;
2) grow 0.15 microns silicon nitride;
3) pattern nitride using mask 1;
4) implant field;
5) etch a circular trench around the nozzle position. 22 microns diameter, 2 microns deep, 1 micron wide using mask 2;
6) grow 0.4 micron field oxide (this also grows on the trench walls);
7) deposit 0.05 micron $HfB_2$ heater;
8) etch heater using mask 3;
9) implant arsenic using mask 4;
10) grow 0.1 micron gate oxide;
11) deposit polysilicon (1 micron);
12) pattern polysilicion using mask 5;
13) etch diffusion windows;
14) diffuse n+ regions;
15) deposit 1 micron CVD glass;
16) pattern contacts using mask 6;
17) deposit first metal (1 micron);
18) pattern metal using mask 7;
19) deposit 1 micron CVD glass;
20) pattern contacts using mask 8;
21) deposit second metal (including thermal diffuser), 1 micron aluminium;
22) pattern metal using mask 9;
23) deposit 3 microns CVD glass;
24) anisotropically etch thermal chamber and nozzle using mask 10 (undersized diameter of less than 18 microns to avoid etching heaters);
25) etch holes 520 microns deep, 80 microns wide from the back side of the wafer, using mask 11. Join to nozzles.
26) use a silicon specific isotropic "wash" etch to enlarge the thermal chamber to the edge of to the heater trench;
27) deposit 0.5 micron tantalum passivation;
28) open pads using mask 12;
29) wafer probe;
30) bond wires;
31) pot in epoxy;
32) mount into head assembly;
33) fill head assembly with ink.

A summary of the process steps required to provide the structure shown in FIG. 21 is as follows:

1) starting wafer: p type, 600 microns thick;
2) grow 0.15 microns silicon nitride;
3) pattern nitride using mask 1;
4) implant field;
5) grow 0.7 micron field oxide;
6) implant arsenic using mask 2;
7) grown 0.1 micron gate oxide;
8) deposit polysilicon (1 micron);
9) pattern polysilicon using mask 3;
10) etch diffusion windows;
11) diffuse n+ regions;
12) etch a 2 micron deep circular depression slightly wider than the nozzle diameter using mask 4;
13) deposit 1 micron CVD glass;
14) pattern contacts using mask 5;
15) deposit 0.05 micron $HfB_2$ heater;
16) etch heater anisotropically (in the vertical direction only) using mask 6;
17) deposit first metal (1 micron);
18) pattern metal using mask 7;
19) deposit 1 micron CVD glass. This provides inter-level dielectric, as well as covering the heater.
20) pattern contacts using mask 8;
21) deposit second metal (including thermal diffuser), 1 micron aluminium;
22) pattern metal using mask 9;
23) deposit 20 microns CVD glass;
24) anisotropically etch nozzle into CVD glass using mask 10;
25) etch the silicon thermal chamber anisotropically using an ion assisted plasma etch specific for silicon, using CVD glass nozzle as a mask;
26) etch holes 520 microns deep, 80 microns wide from the back side of the wafer, using mask 11. Join to thermal chambers;
27) deposit 0.5 micron tantalum passivation;
28) open pads using mask 12;
29) wafer probe;
30) bond wires;
31) pot in epoxy;

32) mount into head assembly;

33) fill head assembly with ink.

A summary of the process steps required to provide the structure shown in FIG. 22 is as follows:

1) starting wafer: p type, 600 microns thick;

2) grow 0.15 microns silicon nitride;

3) pattern nitride using mask 1;

4) implant field;

5) grow 0.7 micron field oxide;

6) implant arsenic using mask 2;

7) grown 0.1 micron gate oxide;

8) deposit polysilicon (1 micron);

9) pattern polysilicon using mask 3;

10) etch diffusion windows;

11) diffuse n+ regions;

12) etch a 2 micron deep circular depression slightly wider than the nozzle diameter using mask 4;

13) deposit 1 micron CVD glass;

14) pattern contacts using mask 5;

15) deposit 0.05 micron $HfB_2$ heater;

16) etch heater anisotropically (in the vertical direction only) using mask 6;

17) deposit first metal (1 micron);

18) pattern metal using mask 7;

19) deposit 1 micron CVD glass. This provides inter- level dielectric, as well as covering the heater.

20) pattern contacts using mask 8;

21) deposit second metal (including thermal diffuser), 1 micron aluminium;

22) pattern metal using mask 9;

23) deposit 3 microns CVD glass;

24) anisotropically etch thermal chamber into CVD glass using mask 10;

25) etch silicon nozzle anisotropically using an ion assisted plasma etch specific for silicon, using CVD glass hole as a mask;

26) etch holes 520 microns deep, 80 microns wide from the back side of the wafer, using mask 11. Join to nozzles;

27) deposit 0.5 micron tantalum passivation;

28) open pads using mask 12;

29) wafer probe;

30) bond wires;

31) pot in epoxy;

32) mount into head assembly;

33) fill head assembly with ink.

The ZBJ printhead 200 incorporating the ZBJ chip 100 is useful in a variety of printing applications either printing across the page in the traditional manner, as a scanning print head, or as a stationary full width print head. FIGS. 114 to 118 show various configurations for use of a number of ZBJ heads.

Figure 114:
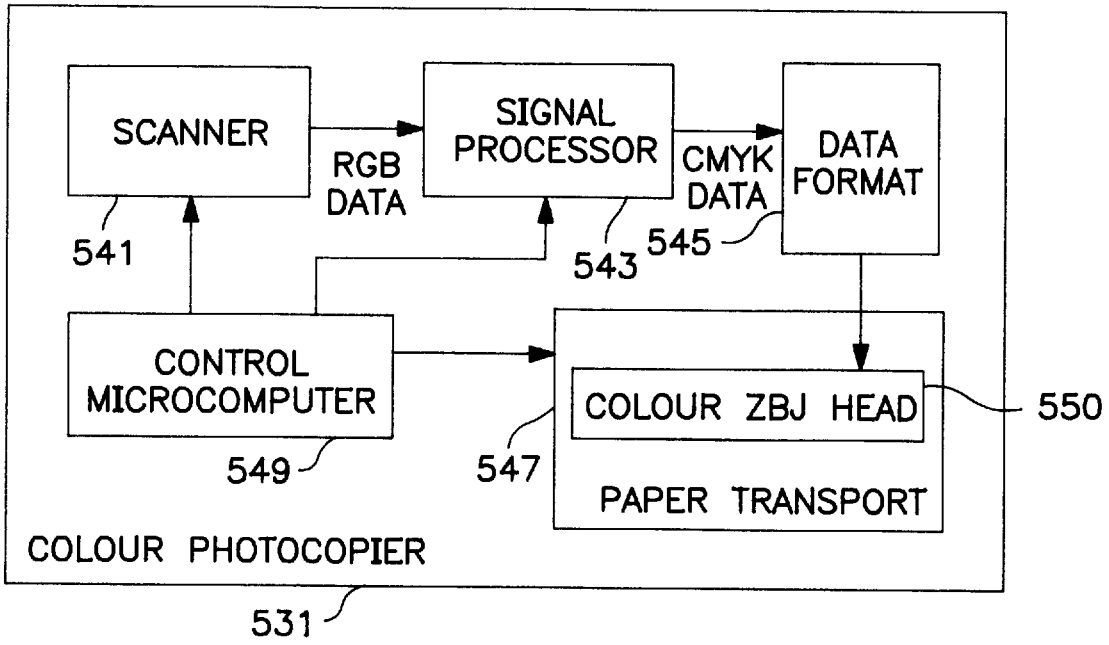
FIG. 114 is a schematic block diagram representation of a colour photo copier incorporating a colour ZBJ head.

FIG. 114 shows a colour photocopier 531 which includes a scanner 541 for scanning a page to be copied. The scanner 541 outputs red, green and blue (RGB) data to a signal processor 543 which converts the RGB data into dot screened cyan, magenta, yellow and black (CMYK) suitable for printing using the device 100. The CYMK data is input to a data formatter 545 which acts in a manner of the circuitry depicted in FIGS. 56 and 57. The data formatter 545 outputs to a full colour ZBJ head 550 capable of printing at 400 pixels per inch across an A3 page carried by a paper transport mechanism 547. A controlling microcomputer 549 co-ordinates the operation of the photocopier 531 through a sequencing control of the scanning 541, signal processor 543, and paper transport mechanism 547.

Figure 115:
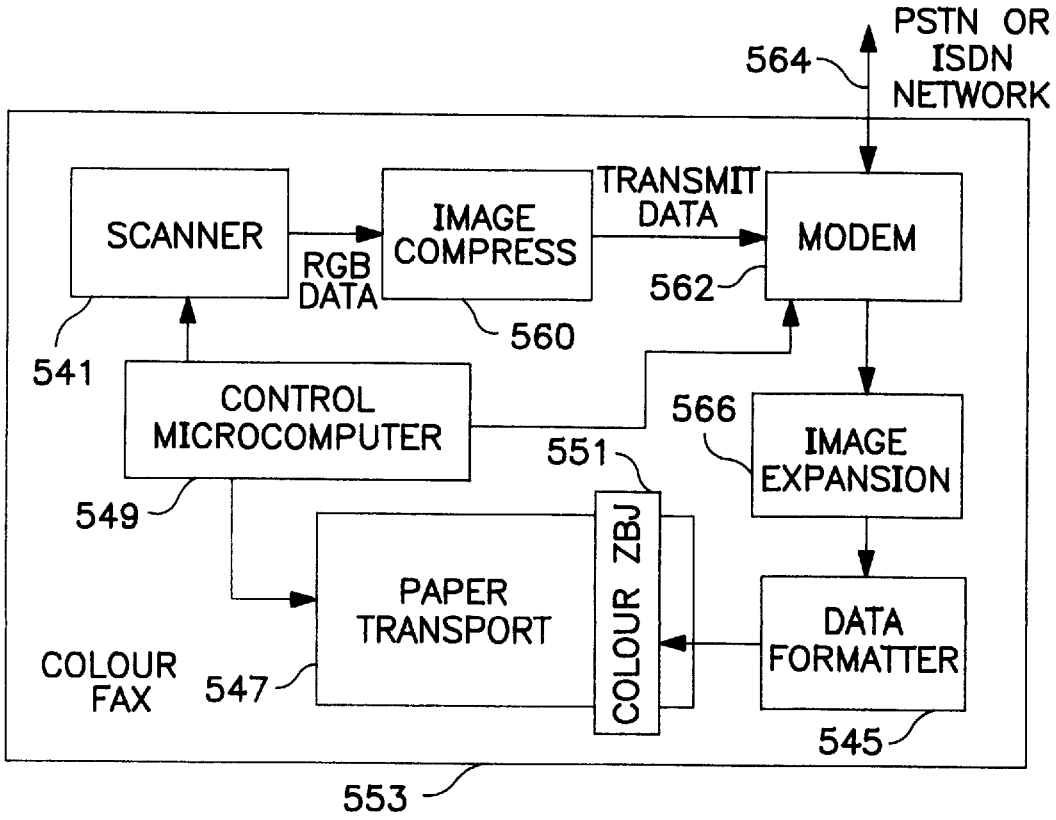
FIG. 115 is a similar representation of a colour facsimile machine.

FIG. 115 shows a colour facsimile machine 533 which includes some components designated in a similar manner to that of FIG. 114. The scanner 541 scans a page to be transmitted after which the scanned data of the image is compressed by a compressor 560. The compressor 560 can use any standard data compression system for images such as the JPEG standard. The compressor 560 outputs transmit data to a modem 562 which connects to a PSTN or ISDN network 564. The modem 562 receives data and outputs to an image expander 566, complementary to the compressor 560. The expander 566 outputs to the data formatter 545 in the manner described above. In this configuration a colour ZBJ head 551 of a size greater than the full width of the paper to be printed is used.

Figure 116:
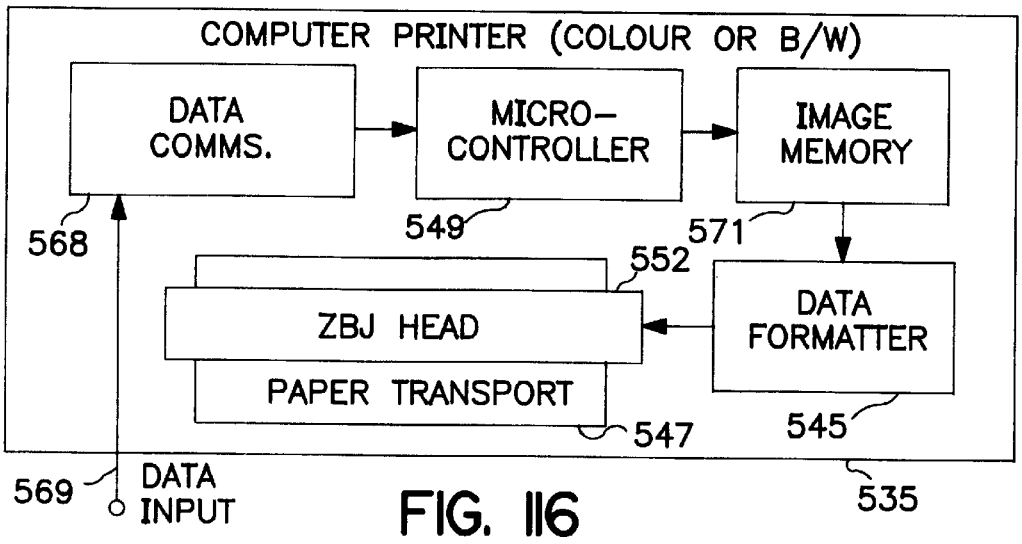
FIG. 116 is a similar representation of a printer for a computer.

FIG. 116 shows a computer printer 535 which can print either colour or black and white images depending on the type of ZBJ head used. Data is supplied via an input 569 to a data communications receiver 568. A microcontroller 549 buffers received data to an image memory 571 which outputs to a full colour data formatter in the manner described above or a simple black and white data formatter. In this embodiment the data formatter 545 outputs to a full length ZBJ head 552 for printing on paper carried by the paper transport mechanism 547.

Figure 117:
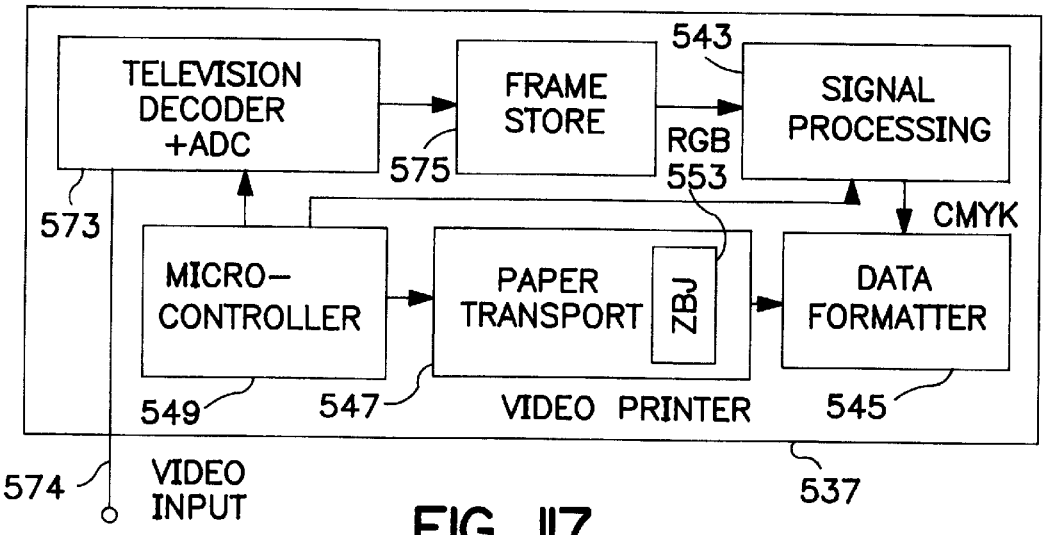
FIG. 117 is a similar representation of a video printer.

In FIG. 117 a video printer 537 is shown which accepts video data via an input 574 which is input to a television decoder and ADC unit 573 which outputs image pixel data to a frame store 575. A signal processor 543 converts RGB data to CMYK data for printing in the manner previously described. A small colour ZBJ head 553 prints on a photographed sized paper carried by the paper transport 547 for printing.

Figure 118:
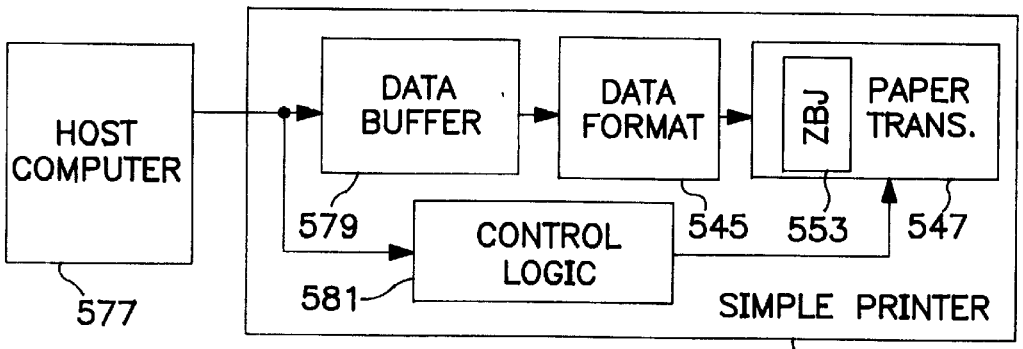
FIG. 118 is a similar representation of a simple printer.

Finally FIG. 118 shows the configuration of a simple printer 539 in which page formatting is performed in a host computer 577. The computer 577 outputs data and control information to a buffer 579 which outputs to the data formatter 545 in the manner described above. A simple control logic unit 581 also receives commands from the host computer 577 for control of the paper transport mechanism 547.

Furthermore, those skilled in the art will realise that any combination of ZBJ heads can be used in any of the above embodiments. For example, multi-head redundance as previously described can be used in both page printing and scanning heads. For ultra-high resolution (1600 dpi) monochrome printing can be used in any embodiment.

The foregoing only describes a number of embodiments of the present invention and modifications, obvious to those skilled in the art can be made thereto without departing from the scope of the present invention.

TABLE 1

| Application/ Feature | 1. Scanning Contone colour ZBJ Head | 2. Scanning Grey Tone ZBJ Head | 3. Photo Size Contone Color ZBJ Head | 4. Full Width A4 Contone Color ZBJ Head |
|---|---|---|---|---|
| Chip Size (mm) | 10 × 4 | 10 × 1.5 | 100 × 2 | 220 × 4 |
| No. of Nozzles | 2048 | 512 | 5120 | 51200 |
| No. of Pixels | 128 | 128 | 1280 | 3200 |
| Nozzles Per Pixel Per Color | 4 | 4 | 1 | 4 |

TABLE 1-continued

| | | | | |
|---|---|---|---|---|
| No. of colours | 4 | 1 | 4 | 4 |
| Print Speed | 3 mins (A4) | 3 mins (A4) | 8 sec (photo) | 3.7 sec (A4) |
| Tone | FULL GREY SCALE | | | |
| Resolution (pixel/inch) | 400 | 400 | 400 | 400 |

| Application/ Feature | 5. Full Width A4 Bilevel ZBJ Head | 6. High Speed A3 Contone colour ZBJ Head | 7. Medium Speed A3 Contone colour ZBJ Head |
|---|---|---|---|
| Chip Size (mm) | 220 × 2 | 310 × 4 | 310 × 2 |
| No. of Nozzles | 12800 | 71680 | 17920 |
| No. of Pixels | 12800 | 4480 | 4480 |
| Nozzles Per Pixel Per Color | 1 | 4 | 1 |
| No. of colours | 1 | 4 | 4 |
| Print Speed | 3.7 sc (A4) | 5.3 sec (A3) | 21 sec. (A3) |
| Tone | FULL GREY SCALE | | |
| Resolution (pixel per inch) | 1600 | 400 | 400 |

TABLE 2

| Fault | Consequence |
|---|---|
| Main drive track open | Main heater fails, redundant heater takes over. |
| Redundant drive track open | Redundant heater fails: no effect. |
| V+ track open | Block of 32 heaters fail, redundant heaters take over. |
| Ground open | Block of 32 redundant heaters fail: no effect. |
| Two main drive tracks shorted | Both nozzles will fire. |
| Two redundant drive tracks shorted | No effect. |
| Main drive track shorted to redundant drive tack | Both heaters will be in series between V+ and ground, and constantly on at half power. Either the main heater or the redundant heater will overheat and go open circuit (under normal conditions, average power is 1/32 of pulse power) The other heater will take over. |
| Main drive track shorted to V+ | Drive transistor will fuse when turned on. Redundant circuit takes over. |
| Main drive track shorted to ground | Main heater will overheat as it is constantly on. It will go open circuit. The redundant circuit will take over. |
| Redundant drive track shorted to V+ | Redundant heater will overheat as it is constantly on. It will go open circuit. No effect. |

TABLE 2-continued

| Fault | Consequence |
|---|---|
| Redundant drive track shorted to ground | Redundant transistor will fuse if ever turned on. No effect if main circuit works. |
| V+ shorted to ground | short, V+track or Ground track will fuse. If V+ track fuses, redundant circuits will take over from isolated main circuits. Other conditions have no effect. |
| Sense track open | Redundant circuit will not operate: no effect. |
| Other conditions of sense track | Same as for main drive |

The present invention has been described in detail with respect to preferred embodiments, and it will now be apparent from the foregoing to those skilled in the art that changes and modification may be made without departing from the invention in its broader aspects, and it is the intention, therefore, in the appended claims to cover all such changes and modifications as fall within the true spirit of the invention.

What is claimed is:

1. A method of fabricating a bubblejet print device using semiconductor fabrication techniques, said method comprising the steps of:

forming a heater means and an electrical connection to said heater means on a substrate;

forming a first hole adjacent to said heater means from one said of said substrate where said heater means is arranged, said first hole being served as an ejecting port for ejecting an ink; and forming a second hole on said substrate from the other side of said substrate which is opposite to the one side of said substrate where said heater means is arranged to communicate between said first and said second holes, thereby forming a through hole including said first and said second holes.

2. A method of fabricating bubblejet print device as claimed in claim 1, wherein a plurality of said heater means are formed on said substrate and a plurality of said through holes are formed in correspondence with said plurality of said heater means.

3. A method of fabricating a bubblejet print device as claimed in claim 2, further comprising the step of forming an ink channel communicating with said plurality of said through holes.

4. A method of fabricating a bubblejet print device as claimed in claim 1, further comprising the step of forming a drive circuit on said substrate and a surface portion thereof.

5. A method of fabricating a bubblejet print device as claimed in claim 4, wherein said drive circuit has a transistor.

6. A method of fabricating a bubblejet print device as claimed in claim 4, wherein each step of said step of forming said heater means and said electrical connection and said step for forming said drive circuit comprises a plurality of substeps at least a part of which are common to both of said steps.

7. A method of fabricating a bubblejet print device as claimed in claim 1, wherein said substrate is a silicon substrate.

8. A method of fabricating a bubblejet print device as claimed in claim 1, further comprising the step of etching opposing surfaces of said substrate.

9. A method of fabricating a bubblejet print device as claimed in claim 1, further comprising the step of removing at least a part of a portion of said substrate on which said heater is formed.

10. A method of fabricating a bubblejet print device as claimed in claim 1, wherein said substrate is etched along intended score lines to facilitate dicing and separation of said substrate into individual print devices.

* * * * *

UNITED STATES PATENT AND TRADEMARK OFFICE

CERTIFICATE OF CORRECTION

PATENT NO. : 5,841,452

DATED : November 24, 1998

INVENTOR(S) : Kia Silverbrook

It is certified that error appears in the above-identified patent and that said Letters Patent is hereby corrected as shown below:

Column 44, line 36, change "said"(first occurrence) to --side--.

Signed and Sealed this

Seventh Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,841,452

DATED : November 24, 1998

INVENTOR(S) : KIA SILVERBROOK

It is certified that error appears in the above-identified patent and that said Letters Patent is hereby corrected as shown below:

Title page, item

[56] REFERENCES CITED

Foreign Patent Documents

"1186700 7/1989 Japan" should read --1-186700 7/1989 Japan--.

"1259957 10/1989 Japan" should read --1-259957 10/1989 Japan--.

"40297448 12/1990 Japan" should read --2-297448 12/1990 Japan--.

COLUMN 6

Line 19, "the" (second occurrence) should be deleted.

COLUMN 9

Line 21, "lime." should read --time.--.

Line 25, "structured" should read --structures--.

Line 34, "and" should be deleted.

UNITED STATES PATENT AND TRADEMARK OFFICE

CERTIFICATE OF CORRECTION

PATENT NO. : 5,841,452

DATED : November 24, 1998

INVENTOR(S) : KIA SILVERBROOK

It is certified that error appears in the above-identified patent and that said Letters Patent is hereby corrected as shown below:

COLUMN 10

Line 13, "shunk" should read --shunt--.

COLUMN 11

Line 39, "provided" should read --provide--.

COLUMN 13

Line 46, "and these" should be deleted.
Line 54, "applying" should read --Applying--.

COLUMN 16

Line 49, "provided" should read --provide--.

COLUMN 18

Line 67, "Of" should read --of--.

COLUMN 20

Line 5, "to" should read --is--.
Line 39, "re" should read --are--.

UNITED STATES PATENT AND TRADEMARK OFFICE

CERTIFICATE OF CORRECTION

PATENT NO. : 5,841,452

DATED : November 24, 1998

INVENTOR(S) : KIA SILVERBROOK

It is certified that error appears in the above-identified patent and that said Letters Patent is hereby corrected as shown below:

COLUMN 21

Line 7, "Trigger" should read --trigger--.

COLUMN 22

Line 33, "provided" should read --provides--.
Line 39, "should" should read --should be--.

COLUMN 26

Line 30, "The" should read --To--.
Line 62, "effect" should read --affect--.

COLUMN 28

Line 55, "This" should read --This is a--.

COLUMN 29

Line 31, "if" should read --is--.

COLUMN 31

Line 28, "V-" should read --V+--.

UNITED STATES PATENT AND TRADEMARK OFFICE

CERTIFICATE OF CORRECTION

PATENT NO. : 5,841,452

DATED : November 24, 1998

INVENTOR(S) : KIA SILVERBROOK

It is certified that error appears in the above-identified patent and that said Letters Patent is hereby corrected as shown below:

COLUMN 33

Line 26, "an" should be deleted.

COLUMN 35

Line 9, "water;" should read --wafer;--.

COLUMN 36

Line 18, "to" (second occurrence) should be deleted.

COLUMN 40

Line 36, "said of said" should read --side of said--.
Line 46, "fabricating" should read --fabricating a--.

Signed and Sealed this

Thirtieth Day of May, 2000

*Attest:*

*Attesting Officer*

Q. TODD DICKINSON

*Director of Patents and Trademarks*